US010945489B2

(12) United States Patent
Conrad et al.

(10) Patent No.: US 10,945,489 B2
(45) Date of Patent: Mar. 16, 2021

(54) SOLE STRUCTURE WITH PLATES AND INTERVENING FLUID-FILLED BLADDER AND METHOD OF MANUFACTURING

(71) Applicant: NIKE, Inc., Beaverton, OR (US)

(72) Inventors: Bryan P. Conrad, Lake Oswego, OR (US); Ross Klein, Portland, OR (US); Troy C. Lindner, Portland, OR (US); Bryan R. Picco, Beaverton, OR (US); Jeffrey George Rasmussen, Portland, OR (US); Bryan K. Youngs, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/378,849

(22) Filed: Apr. 9, 2019

(65) Prior Publication Data

US 2019/0320759 A1 Oct. 24, 2019

Related U.S. Application Data

(60) Provisional application No. 62/715,056, filed on Aug. 6, 2018, provisional application No. 62/660,547, filed on Apr. 20, 2018.

(51) Int. Cl.
*A43B 13/20* (2006.01)
*A43B 13/18* (2006.01)

(52) U.S. Cl.
CPC ..... *A43B 13/20* (2013.01); *A43B 13/186* (2013.01)

(58) Field of Classification Search
CPC ..... A43B 13/20; A43B 13/203; A43B 13/206; A43B 13/18; A43B 13/183; A43B 3/0052; A43B 13/186
USPC ..... 36/29
See application file for complete search history.

(56) References Cited

U.S. PATENT DOCUMENTS

| | | | | |
|---|---|---|---|---|
| 4,771,554 | A | 9/1988 | Hannemann | |
| 5,528,842 | A | 6/1996 | Ricci et al. | |
| 6,898,870 | B1 | 5/2005 | Rohde | |
| 9,241,535 | B2 | 1/2016 | Baudouin et al. | |
| 10,149,513 | B1 | 12/2018 | Eldem et al. | |
| 2003/0172548 | A1 | 9/2003 | Fuerst | |
| 2004/0221483 | A1 | 11/2004 | Cartier et al. | |
| 2005/0102857 | A1 * | 5/2005 | Yen | A43B 3/0052 36/28 |

(Continued)

FOREIGN PATENT DOCUMENTS

KR 101726729 B1 4/2017

*Primary Examiner* — Ted Kavanaugh
(74) *Attorney, Agent, or Firm* — Quinn IP Law

(57) ABSTRACT

A sole structure for an article of footwear includes a first plate, a fluid-filled bladder supported on the first plate, and a second plate supported on the fluid-filled bladder with the fluid-filled bladder disposed between the first plate and the second plate. The first plate ascends rearward of the fluid-filled bladder and the second plate descends rearward of the fluid-filled bladder with a posterior portion of the first plate above a posterior portion of the second plate rearward of the fluid-filled bladder. A method of manufacturing footwear sole structures includes assembling sole structures for plural ranges of footwear sizes, each of the sole structures including a fluid-filled bladder with a predetermined inflation pressure that is different for at least two of the plural ranges.

20 Claims, 46 Drawing Sheets

(56) References Cited

U.S. PATENT DOCUMENTS

| | | | | |
|---|---|---|---|---|
| 2005/0102858 | A1* | 5/2005 | Yen | A43B 13/20 36/28 |
| 2005/0102859 | A1* | 5/2005 | Yen | A43B 13/181 36/28 |
| 2009/0100709 | A1 | 4/2009 | Macey et al. | |
| 2013/0031804 | A1 | 2/2013 | Abshire | |
| 2013/0125421 | A1 | 5/2013 | Stegmaier et al. | |
| 2014/0068969 | A1 | 3/2014 | Blevens et al. | |
| 2014/0075779 | A1 | 3/2014 | Bruce et al. | |
| 2014/0259747 | A1* | 9/2014 | Baudouin | A43B 13/183 36/29 |
| 2015/0027000 | A1 | 1/2015 | Barnes et al. | |
| 2017/0095033 | A1 | 4/2017 | Farina et al. | |
| 2017/0095034 | A1 | 4/2017 | Dupre et al. | |
| 2018/0213886 | A1 | 8/2018 | Connell et al. | |
| 2018/0338577 | A1 | 11/2018 | Elder et al. | |

* cited by examiner

SOLE STRUCTURE WITH PLATES AND INTERVENING FLUID-FILLED BLADDER AND METHOD OF MANUFACTURING

CROSS-REFERENCE TO RELATED APPLICATIONS

This application claims the benefit of priority to U.S. Provisional Application No. 62/660,547, filed Apr. 20, 2018, and also claims the benefit of priority to U.S. Provisional Application No. 62/715,056, filed Aug. 6, 2018, both of which are incorporated by reference in their entirety.

TECHNICAL FIELD

The present teachings generally relate to a sole structure for an article of footwear and a method of manufacturing footwear sole structures.

BACKGROUND

Footwear typically includes a sole structure configured to be located under a wearer's foot to space the foot away from the ground. Sole structures may typically be configured to provide one or more of cushioning, motion control, and resiliency.

DESCRIPTION

Figure 1:
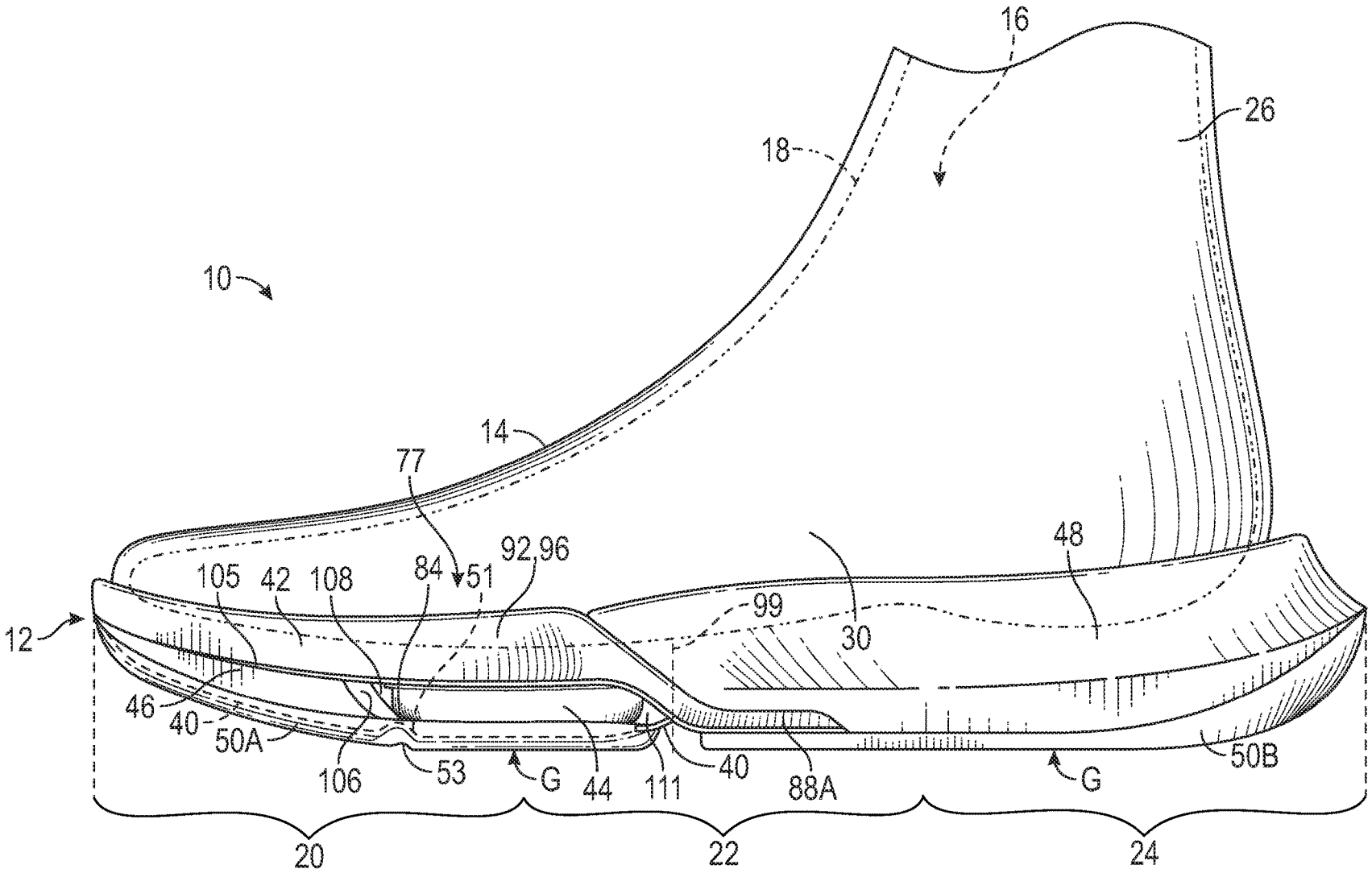
FIG. 1 is a medial side view of an article of footwear including a sole structure and an upper secured to the sole structure.

A sole structure for an article of footwear is disclosed having uniquely shaped first and second plates that disperse forces exerted on and received from a fluid-filled bladder disposed between the plates. The plates are configured so that they are in opposite relative positions rearward of the fluid-filled bladder as they are at the fluid bladder, with one plate ascending and the other descending rearward of the fluid-filled bladder.

In an example, a sole structure for an article of footwear may comprise a first plate, a fluid-filled bladder supported on the first plate, and a second plate supported on the fluid-filled bladder with the fluid-filled bladder disposed between the first plate and the second plate. The first plate may ascend rearward of the fluid-filled bladder and the second plate may descend rearward of the fluid-filled bladder with a posterior portion of the first plate above a posterior portion of the second plate rearward of the fluid-filled bladder.

In one or more embodiments, the posterior portion of a first one of the first plate or the second plate may include one or both of a medial-side trailing arm and a lateral-side trailing arm, and the posterior portion of a second one of the first plate or the second plate may be disposed adjacent to one or both of the medial-side trailing arm and the lateral-side trailing arm. For example, the posterior portion of the second plate may include both a medial-side trailing arm and a lateral-side trailing arm. The posterior portion of the first plate, which may or may not be tapered, may ascend between the medial-side trailing arm and the lateral-side trailing arm. Additionally, the medial-side trailing arm and the lateral-side trailing arm of the second plate may descend to below the posterior portion of the first plate rearward of the fluid-filled bladder. In a configuration, the posterior portion of the first plate may ascend from below the medial-side trailing arm and the lateral-side trailing arm of the second plate to above the medial-side trailing arm and the lateral-side trailing arm from the fluid-filled bladder to a terminal end of the posterior portion of the first plate. In another example, the posterior portion of the first plate includes one or both of the medial-side trailing arm and the lateral-side trailing arm which ascends, and the posterior portion of the second plate, which descends and may or may not be tapered, is disposed adjacent to the one or both of the medial-side trailing arm and the lateral-side trailing arm.

In one or more embodiments, the one or both of the medial-side trailing arm and the lateral-side trailing arm, and the posterior portion disposed adjacent to the one or both of the medial-side trailing arm and the lateral-side trailing arm may be exposed in a midfoot region of the sole structure. For example, at least portions of these components where they cross one another may be exposed and visible from a medial side view, from a lateral side view, and/or from a bottom view of the sole structure.

The terminal end of the posterior portion that is disposed adjacent to the one or both of the medial-side trailing arm and the lateral-side trailing arm may be rearward of the terminal end(s) of the one or both of the medial-side trailing arm and the lateral-side trailing arm. Alternatively, the terminal end(s) of the one or both of the medial-side trailing arm and the lateral-side trailing arm may extend rearward of the terminal end of the posterior portion that is disposed adjacent to the one or both of the medial-side trailing arm and the lateral-side trailing arm.

In one or more embodiments, the first one of the first plate and the second plate includes both the medial-side trailing arm and the lateral-side trailing arm, and the medial-side trailing arm and the lateral-side trailing arm converge. In embodiments in which the second plate includes the medial-side trailing arm and the lateral-side trailing arm, the second plate may have a central portion supported on the fluid-filled bladder, and the second plate may define an opening rearward of the fluid-filled bladder and bounded by the medial-side trailing arm and the lateral-side trailing arm. In such an embodiment, the second plate may include a continuous wall extending upward from the medial side arm and the lateral side arm.

The first plate may have features that increase its flexibility at specific locations. For example, the first plate may have a bifurcated portion forward of the fluid-filled bladder. The bifurcated portion may include a medial projection and a lateral projection, each of the medial projection and the lateral projection having a longitudinally-extending ridge extending upward on the proximal side of the first plate.

In one or more embodiments, the first plate may be bifurcated from a forward edge of the first plate rearward to a rear extent of the posterior portion where a medial rail and a lateral rail of the first plate converge. In such an embodiment, the first fluid-filled bladder may be disposed on a medial projection of the bifurcated portion, and a second fluid-filled bladder may be disposed on a lateral projection of the bifurcated portion.

In one or more embodiments, the first plate may be undivided forward of the fluid-filled bladder. Stated differently, the first plate is not bifurcated in such an embodiment.

The first plate may have a transverse ridge on a proximal side of the first plate forward of the fluid-filled bladder, and a transverse groove on a distal side of the first plate aligned with the transverse ridge. The proximal side of the first plate may define a recess, and a distal side of the fluid-filled bladder may be seated in the recess.

The posterior portion of the first plate may be tapered and may include a medial rail and a lateral rail that converge forward of a terminal end of the tapered posterior portion. Each of the medial rail and the lateral rail may have a longitudinally-extending ridge extending downward on the distal side of the first plate.

The second plate may have features that provide medial-lateral support to the fluid-filled bladder and/or the foot. For example, a distal side of the second plate may define a recess, and the proximal side of the fluid-filled bladder may be nested in the recess. The second plate may define a peripheral wall forward of the medial-side trailing arm and the lateral-side trailing arm. The peripheral wall may provide support to the periphery of the foot, as it may extend upward and away from the first plate and around a front of a forefoot region of the sole structure, such as around a toe box. The second plate may define a through hole forward of the fluid-filled bladder. The through hole may aide foot motion as discussed herein, by allowing the toes to grip a more resilient forefoot midsole unit disposed between the first plate and the second plate at the though-hole, as discussed herein. In an embodiment of a second plate without a through hole, the second plate may end rearward of the forefoot midsole unit. State differently, the forefoot midsole unit may extend forward of a forwardmost edge of the second plate. A rear extent of the forefoot midsole unit may slope upwardly and away from the fluid-filled bladder from the first plate to the second plate. Alternatively, a rear extent of the forefoot midsole unit may slope upwardly and toward the fluid-filled bladder from the first plate to the second plate.

In additional to their geometry, the materials selected for the first plate and the second plate may result in desired performance characteristics. For example, the first plate may be more rigid than the second plate. By non-limiting example, the first plate may comprise one of, or any combination of two or more of, a carbon fiber, a carbon fiber composite, a carbon fiber-filled nylon, a fiberglass-reinforced nylon, a fiber strand-lain composite, a thermoplastic elastomer, wood, or steel. For example, the first plate may comprise a fiberglass-reinforced polyamide 11 having a hardness of approximately 75 on a Shore D durometer scale. In a non-limiting example, the second plate may comprise thermoplastic polyurethane such as but not limited to an injected thermoplastic polyurethane having a hardness of approximately 95 on a Shore A durometer scale.

In some embodiments, a single fluid-filled bladder (i.e., the first fluid-filled bladder) is disposed between the plates. In other embodiments, the sole structure may further comprise a second fluid-filled bladder disposed adjacent to the first fluid-filled bladder between the first plate and the second plate. In any such embodiments, the fluid bladder(s) may each include a plurality of tethers spanning between and operatively connecting an upper interior surface of the fluid-filled bladder to a lower interior surface of the fluid-filled bladder. The positions of the plates above and below the fluid-filled bladder helps to disperse compression forces evenly over the area of the bladder having the tethers, enabling the tethers to slacken when the fluid-filled bladder is elastically deformed under compression, and return to a tensioned state in unison when the fluid-filled bladder returns the energy applied to elastically deform the bladder as the compression is relieved.

The sole structure may further comprise a rear midsole unit extending rearward of the fluid-filled bladder. The rear midsole unit may have a medial shoulder interfacing with and secured to the medial-side trailing arm, and a lateral shoulder interfacing with and secured to the lateral-side trailing arm. The medial shoulder may interface flush with the medial-side trailing arm, and the lateral shoulder may interface with flush with the lateral-side trailing arm. The rear midsole unit may define a peripheral wall extending forward of the fluid-filled bladder, and upward and away from the second plate. In such an embodiment, the second plate may terminate rearward of the forefoot midsole unit, with a forwardmost edge of the second plate rearward of the forefoot midsole unit. Additionally, rather than the second plate defining a through hole, the rear midsole unit may define a through hole extending at least partially over the fluid-filled bladder. The medial-side trailing arm may nest in a recess of the medial shoulder, and the lateral-side trailing arm may nest in a recess of the lateral shoulder.

The rear midsole unit may have a distal side with a recess between the medial shoulder and the lateral shoulder. In some embodiments, the second plate includes a wall extending upward from the medial side arm and the lateral side arm into the recess and interfacing with the rear midsole unit in the recess. The wall may be continuous, and may interfacing flush with the rear midsole unit in the recess. The wall increases the surface area of the second plate for bonding to the rear midsole unit. The posterior portion of the first plate may be seated against the rear midsole unit in the recess. The rear midsole unit may overlay and be secured to a rear portion of a proximal side of the second plate over the fluid-filled bladder.

The first plate may have a first bending stiffness, and the second plate may have a second bending stiffness that is less than the first bending stiffness. The first plate may be more rigid than the second plate. This may be due to different materials and/or geometries of the plates. For example, in one or more embodiments, the first plate may comprise a carbon fiber, a carbon fiber composite, such as a carbon fiber-filled nylon, a fiberglass-reinforced nylon, which may be an injected, fiber-reinforced nylon, a fiber strand-lain composite, a thermoplastic elastomer, wood, steel, or another material or combinations of these, but is not limited to these materials. The second plate may comprise a thermoplastic polyurethane (TPU), such as an injected TPU. In the same or different embodiments, the forefoot midsole unit and the rear midsole unit may be a resilient material, such as but not limited to a polymeric foam.

An outsole component may be secured to the distal side of the fluid-filled bladder. A first medial sidewall of the outsole component may extend upward onto and may be secured to a medial side surface of the fluid-filled bladder. A forefoot midsole unit may be disposed forward of the fluid-filled bladder between the first plate and the second plate. The outsole component may include a second medial sidewall that wraps upward and is secured to a medial side surface of the forefoot midsole unit forward of the first medial sidewall. The outsole component may define a notch between the first medial sidewall and the second medial sidewall. In some embodiments, an outsole component is secured to the distal side of the rear midsole component, and a first medial sidewall of the outsole component extends upward onto and is secured to a medial side surface of the rear midsole component.

In one or more embodiments, the sole structure may further comprise a third plate having a forward edge that defines a notch. The posterior portion of the first plate may be tapered and may be configured to fit within the notch with the third plate extending rearward from the first plate above the medial-side trailing arm and the lateral-side trailing arm of the second plate.

The third plate may define a through hole in a heel region of the sole structure. The sole structure may further comprise a rear midsole unit that is secured to a distal side of the third plate and exposed at a proximal side of the third plate at the through hole of the third plate.

The third plate may include an elongated tail curving upward and forward from a rear of the third plate. For example, the elongated tail may be used as a lever on which the opposite foot pushes to remove an article of footwear from a foot when the sole structure is included in an article of footwear that has an upper.

The sole structure may further comprise a full-length midsole unit that extends from a forefoot region to a heel region of the sole structure. The full-length midsole unit may be supported on and may interface with a proximal side of the first plate in the forefoot region forward of the second plate, with the proximal side of the second plate forward of the medial-side trailing arm and the lateral-side trailing arm, and with the proximal side of the third plate.

The full-length midsole unit may have a through hole that is disposed over the second plate so that the proximal side of the second plate may be exposed at the through hole of the full-length midsole unit. In such embodiments, the fluid-filled bladder may be disposed at a distal side of the second plate under the through hole of the full-length midsole unit.

In one or more embodiments, the sole structure may include a midsole unit that extends over the third plate in the heel region. The midsole unit may have a through hole in the heel region, which may be in addition to a through hole disposed over the second plate. The posterior portion of the first plate may extend through the through hole in the midsole unit and may be secured to a foot-facing surface of the midsole unit. Due to the bending and compression forces exerted on the first plate, securing the first plate to the foot-facing surface of the midsole unit rather than to a ground-facing surface of the midsole unit may result in less stress on a bond between the components. The midsole unit may be a full-length midsole unit extending from a forefoot region to a heel region of the sole structure, supported on and interfacing with a proximal side of the first plate in the forefoot region forward of the second plate, with the proximal side of the second plate forward of the medial-side trailing arm and the lateral-side trailing arm, and with the proximal side of the third plate.

In one or more embodiments, the posterior portion of the first plate may include a stepped rear with a relatively thick leg extending through the through hole and a relatively thin leg extending rearward from the relatively thick ledge over the midsole unit and seated in a recess on the foot-facing surface of the midsole unit. The stepped construction of the rear of the posterior portion enables the first plate to extend through the midsole unit from below while extending upward and rearward.

In one or more embodiments, the posterior portion of the first plate may be tapered and may include a plurality of recesses in a foot-facing surface of the tapered posterior portion at the through hole. For example, if the first plate is injection molded, increased conformance of production components with dimensional tolerances is possible with thinner portions. If the tapered posterior portion is relatively thick at the through hole, providing recesses at the foot-facing surface over where the tapered posterior portion is relatively thick enables the foot-facing surface to conform to dimensional tolerances. For example, the tapered posterior portion of the first plate may be flush with the midsole unit at the foot-facing surface.

The full-length midsole unit may have a wall extending from the first plate to the second plate forward of the fluid-filled bladder, and curving forward between the first plate and the second plate.

The first plate may include a medial flange at a medial side edge of the first plate and a lateral flange at a lateral side edge of the first plate. The medial flange and the lateral flange may be disposed against a rear face of a downwardly extending portion of the full-length midsole unit in the forefoot region forward of the fluid-filled bladder.

The third plate may define a through hole in a heel region of the sole structure. The sole structure may further comprise a rear midsole unit secured to a distal side of the third plate and exposed at a proximal side of the third plate at the through hole of the third plate. The full-length midsole unit may extend over the through hole of the third plate and interface with the rear midsole unit at the through hole of the third plate.

The second plate may have a central portion supported on the fluid-filled bladder. The second plate may define a through hole rearward of the central portion between the medial-side trailing arm and the lateral-side trailing arm. The posterior portion of the first plate may ascend rearward through the through hole of the second plate. The second plate may include a wall extending upward around a rear of the through hole of the second plate.

Various embodiments of sole structures, including those described herein, may provide a desirable combination of support and cushioning when the inflation pressure of the one or more fluid-filled bladders is correlated with footwear size. For example, a method of manufacturing footwear sole structures may comprise assembling sole structures for plural ranges of footwear sizes. Each of the sole structures may comprise a first plate, a second plate, and a fluid-filled bladder supported on a proximal side of the first plate, with the second plate supported on a proximal side of the fluid-filled bladder. The fluid-filled bladder may have a predetermined inflation pressure. The predetermined inflation pressure may be different for at least two of the plural ranges of footwear sizes.

In one or more embodiments, the plural ranges of footwear sizes may include a first range and a second range. The footwear sizes included in the first range may be smaller than the footwear sizes included in the second range. The predetermined inflation pressure for the first range may be less than the predetermined inflation pressure for the second range.

In one or more embodiments, the plural ranges of footwear sizes may further include a third range. The footwear sizes included in the third range may be larger than the footwear sizes included in the second range. The predetermined inflation pressure for the third range may be greater than the predetermined inflation pressure for the second range.

In one or more embodiments, the first range may include men's United States (U.S.) sizes 6 to 9, the second range may include men's U.S. sizes 9.5 to 12, and the third range may include men's U.S. sizes 12.5 to 15.

In one or more embodiments, the predetermined inflation pressure for the third range may be about 10 pounds per square inch (psi) greater than the predetermined inflation pressure for the first range.

In one or more embodiments, the predetermined inflation pressure for the second range may be from about 2 psi to about 5 psi greater than the predetermined inflation pressure for the first range, and the predetermined inflation pressure for the third range may be from about 2 psi to about 5 psi greater than the predetermined inflation pressure for the second range.

In one or more embodiments, the predetermined inflation pressure for the first range may be about 15 psi, the predetermined inflation pressure for the second range may be about 20 psi, and the predetermined inflation pressure for the third range may be about 25 psi.

In one or more embodiments, the method may further include inflating the fluid-filled bladder to the predetermined inflation pressure, and sealing the fluid-filled bladder.

In one or more embodiments of the method, the first plate may ascend rearward of the fluid-filled bladder and the second plate may descend rearward of the fluid-filled bladder. For example, the first plate may have a tapered posterior portion, the second plate may have a medial-side trailing arm and a lateral-side trailing arm, and the fluid-filled bladder may be supported on the proximal side of the first plate forward of the tapered posterior portion. The second plate may be supported on the proximal side of the fluid-filled bladder, with the fluid-filled bladder forward of the medial-side trailing arm and the lateral-side trailing arm. The tapered posterior portion may ascend rearward of the fluid-filled bladder between the medial-side trailing arm and the lateral-side trailing arm, and the medial-side trailing arm and the lateral-side trailing arm may descend rearward of the fluid-filled bladder.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 shows an article of footwear 10 that has a sole structure 12 and an upper 14 secured to the sole structure 12. The upper 14 forms a foot-receiving cavity 16 configured to receive a foot 18, indicated in phantom. The article of footwear 10 may be referred to as footwear 10, and as illustrated herein is depicted as athletic footwear configured for sports such as basketball, or for various other sports such as but not limited to running, tennis, football, soccer, etc. Although the article of footwear 10, including the sole structure 12, may be athletic footwear, it is not limited to such, and may instead be a leisure shoe, a dress shoe, a work shoe, a sandal, a slipper, a boot, or any other category of footwear.

As indicated in FIG. 1, the footwear 10 may be divided into a forefoot region 20, a midfoot region 22, a heel region 24, and an ankle region 26, which are also the forefoot region, the midfoot region, and the heel region, respectively, of the sole structure 12 and the upper 14, and the ankle region 26 defined by the upper 14. The forefoot region 20 generally includes portions of the article of footwear 10 corresponding with the toes and the metatarsophalangeal joints (which may be referred to as MPT or MPJ joints) connecting the metatarsal bones of the foot and the proximal phalanges of the toes. The midfoot region 22 generally includes portions of the article of footwear 10 corresponding with the arch area and instep of the foot 18, and the heel region 24 corresponds with rear portions of the foot 18, including the calcaneus bone. The ankle region 26 corresponds with the ankle. The forefoot region 20, the midfoot region 22, the heel region 24, and the ankle region 26 are not intended to demarcate precise areas of the footwear 10, but are instead intended to represent general areas of the footwear 10 to aid in the following discussion.

Figure 2:
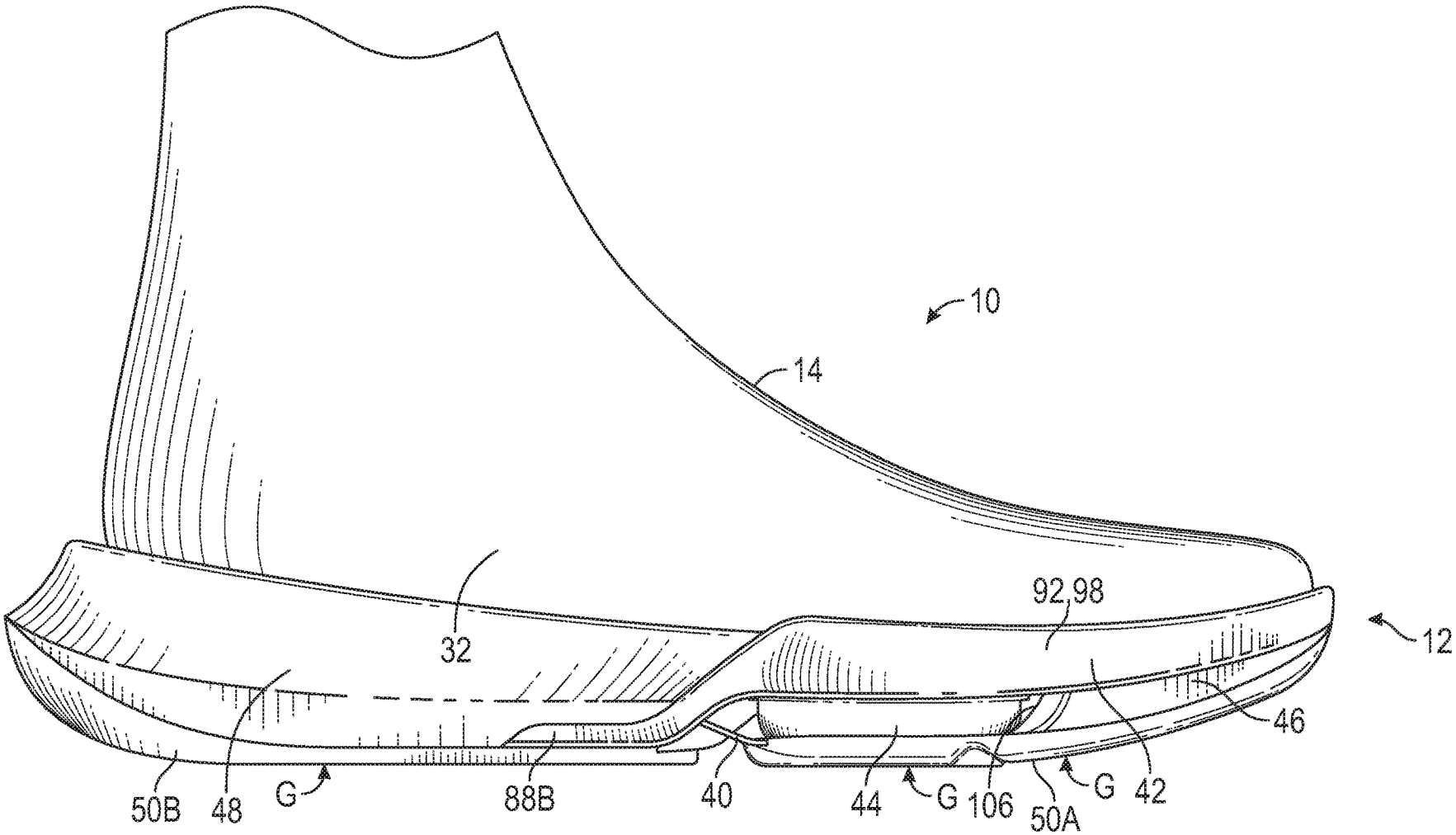
FIG. 2 is a lateral side view of the article of footwear of FIG. 1.

The footwear 10 has a medial side 30 (shown in FIG. 1) and a lateral side 32 (shown in FIG. 2). The medial side 30 and the lateral side 32 extend through each of the forefoot region 20, the midfoot region 22, the heel region 24, and the ankle region 26, and correspond with opposite sides of the article of footwear 10, each falling on an opposite side of a longitudinal midline LM of the article of footwear 10, indicated in FIG. 3. The medial side 30 is thus considered opposite to the lateral side 32.

The upper 14 may be a variety of materials, such as leather, textiles, polymers, cotton, foam, composites, etc. For example, the upper 14 may be a polymeric material capable of providing elasticity, and may be of a braided construction, a knitted (e.g., warp-knitted) construction, or a woven construction. A lower extent of the upper 14 is secured to a periphery of the sole structure 12 as shown in FIG. 1. The foot-facing surface 34 of the sole structure 12 (shown in FIG. 5) may be covered by a strobel (not shown) secured to a lower region of the upper 14. Alternatively, the upper 14 may be a 360-degree sock-like upper that extends under the foot and over the foot-facing surface 34. An insole (not shown) may rest in the foot-receiving cavity 16 on the foot-facing surface 34.

The sole structure 12 includes first and second plates 40, 42, which may also be referred to as sole plates, and are best shown in FIGS. 5-11 and 14-15. As discussed herein, the plates 40, 42 are uniquely configured to moderate forces applied to and returned from one or more fluid-filled bladders 44 disposed between the plates 40, 42. As used herein, the term "plate", such as in plate 40 and plate 42, refers to a member of a sole structure that has a width greater than its thickness and is generally horizontally disposed when assembled in an article of footwear with the sole structure resting on a level ground surface, so that its thickness is generally in the vertical direction and its width is generally in the horizontal direction. Although each plate 40, 42 is shown as a single, unitary component, a plate need not be a single component but instead can be multiple interconnected components. Portions of a plate can be flat, and portions can have some amount of curvature and variations in thickness when molded or otherwise formed, for example, to provide a shaped footbed and/or increased thickness for reinforcement in desired areas.

The fluid-filled bladder 44 that is disposed between the first and second plates 40, 42 (and, in the embodiment of FIG. 18, each of the multiple fluid-filled bladders 44A, 44B), is a fluid-filled bladder, sometimes referred to as a fluid-filled chamber, a bladder element, or an airbag, and may be referred to as such for clarity in the description. Within the scope of the disclosure, however, the fluid-filled bladders 44, 44A, 44B could be foam structures, or other resilient materials rather than fluid-filled bladders.

In addition to the plates 40, 42 and the fluid-filled bladder 44, the sole structure 12 includes a forefoot midsole unit 46 forward of the fluid-filled bladder 44, a rear midsole unit 48 rearward of the fluid-filled bladder 44, and outsole components 50A, 50B that establish a ground-contact surface G of the sole structure. Each of the components of the sole structure 12 is discussed in greater detail with respect to the several drawings in which they appear.

Figure 10A:
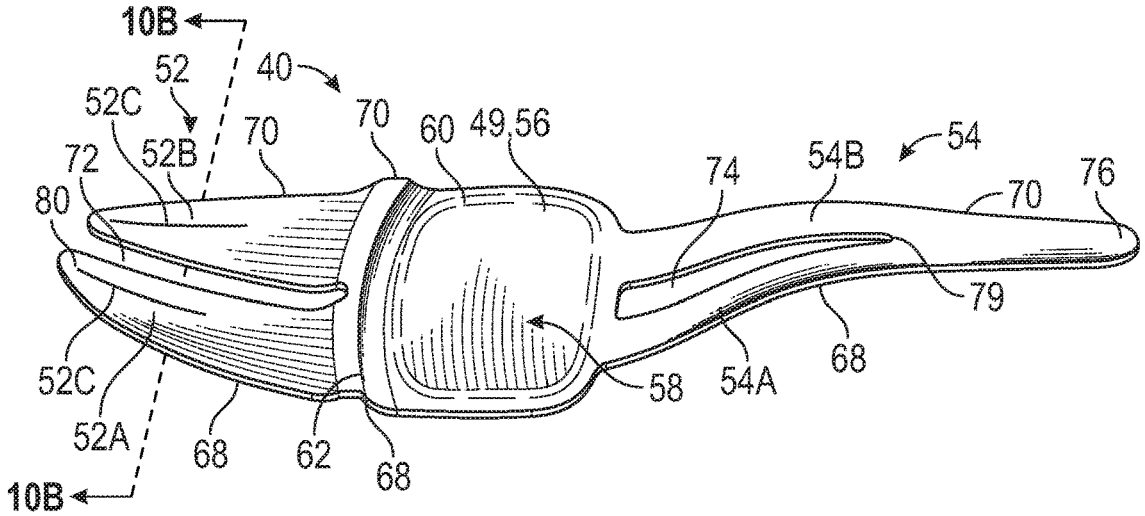
FIG. 10A is a top perspective view of the first plate of the sole structure of FIG. 1.
Figure 11A:
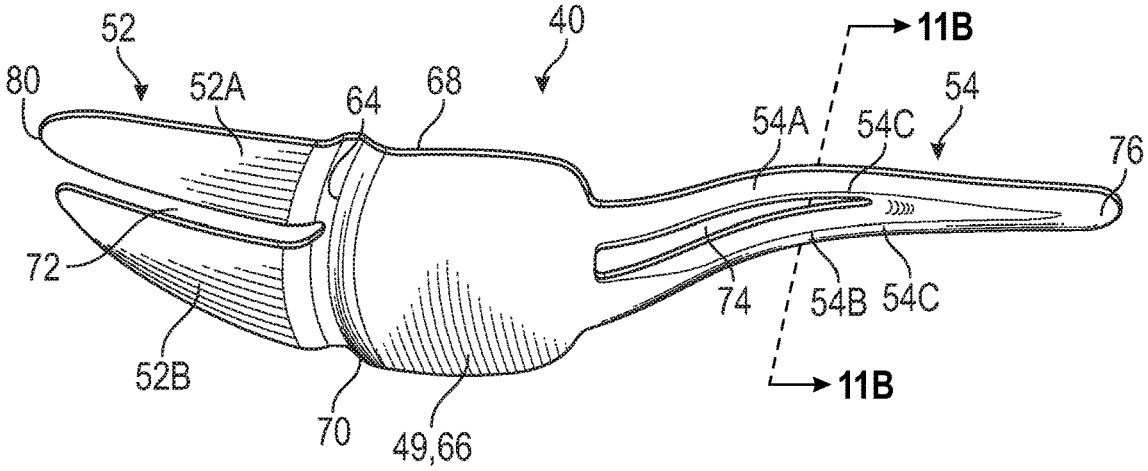
FIG. 11A is a bottom perspective view of the first plate of FIG. 10A.

The first plate 40 is shown in isolation in FIGS. 10A and 11A. Generally, the first plate is a relatively rigid material. For example, in one or more embodiments, the first plate 40 may comprise a carbon fiber, a carbon fiber composite (such as a carbon fiber-filled nylon), a fiberglass-reinforced nylon, which may be an injected, fiber-reinforced nylon, a fiber strand-lain composite, a thermoplastic elastomer, wood, steel, or another material or combinations of these, but is not limited to these materials. In one non-limiting example, the first plate 40 may be an injected, fiberglass-reinforced polyamide 11, such as RILSAN® BZM 7 0 TL, available from Arkema Inc. in King of Prussia, Pa. USA. In such an embodiment, the first plate 40 may have a hardness of approximately 75 on a Shore D durometer scale using an ISO 868 test method, a flexural modulus of approximately 1500 MPa using an ISO 178 test method, and a density of approximately 1.07 grams per cubic centimeters ($g/cm^3$).

The first plate 40 has a central portion 49, a bifurcated portion 52 (also referred to as bifurcated forward portion 52) forward of the central portion 49, and a tapered posterior portion 54 rearward of the central portion 49. In other embodiments, the forward portion 52 need not be bifurcated and/or the posterior portion 54 need not be tapered.

Figure 4:
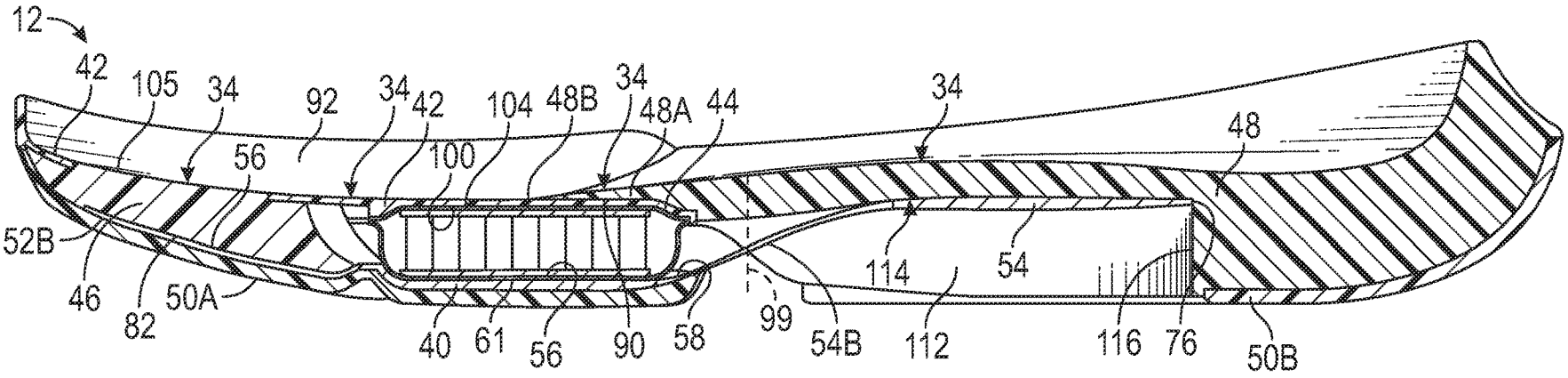
FIG. 4 is a schematic cross-sectional view of the sole structure of FIG. 3 taken at lines 4-4 in FIG. 3.
Figure 17:
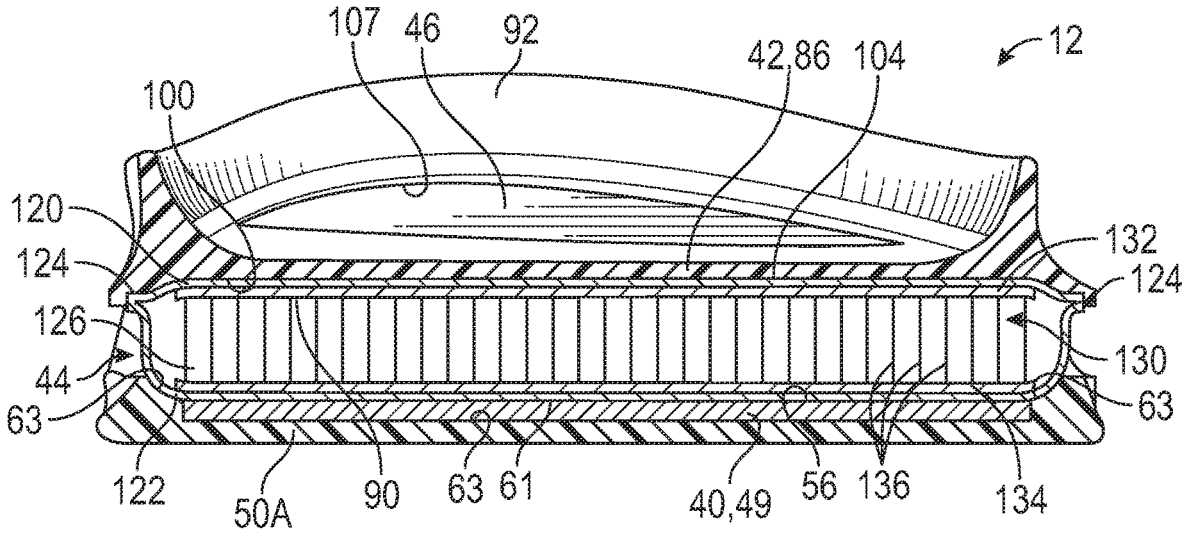
FIG. 17 is a cross-sectional view of the sole structure of FIG. 1 taken at lines 17-17 in FIG. 3.

A proximal side 56 of the first plate 40 defines a recess 58. For example, a protrusion 60 having a closed shape extends upward from the central portion 49 to define a recess 58 surrounded by the protrusion 60. When the first plate 40 and the fluid-filled bladder 44 are assembled in the sole structure 12, the distal side 61 of the fluid-filled bladder 44 is seated on the proximal side 56 of the first plate 40 in the recess 58, as best shown in FIG. 4. The fluid-filled bladder 44 is wider than both the first plate 40 and the recess 58, however, and extends onto the outsole component 50A as shown in FIG. 17. The outsole component 50A also forms a recess 63 that receives and supports the first plate 40 as well as the medial and lateral extremities of the fluid-filled bladder 44, as best shown in FIG. 17.

Figure 3:
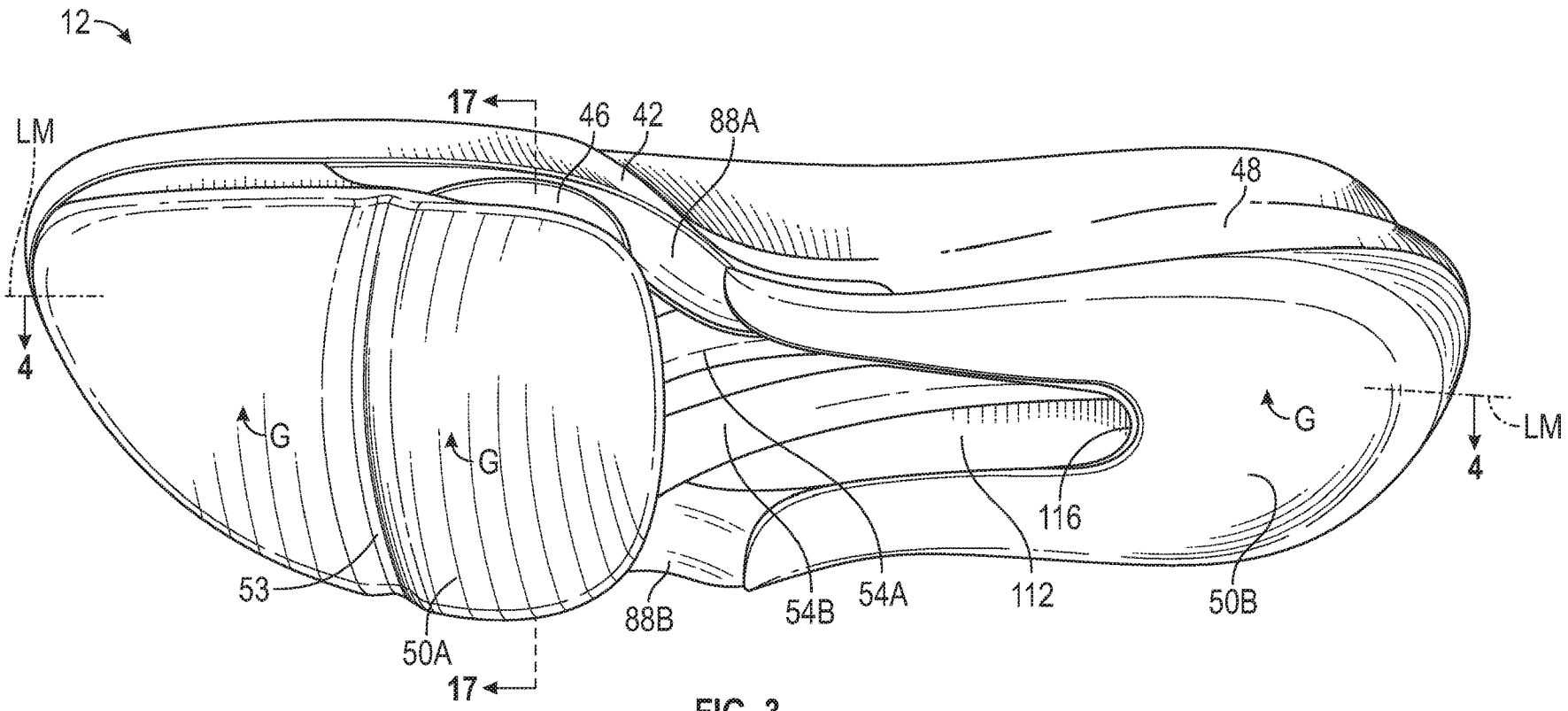
FIG. 3 is a perspective bottom view of the sole structure of FIG. 1.

Referring to FIGS. 10A and 11A, the first plate 40 has a transverse ridge 62 on the proximal side 56, and a transverse groove 64 on a distal side 66 of the first plate 40. The distal side 66 is opposite of the proximal side 56, and is further from the foot 18 and closer to the ground contact surface G of the sole structure 12 than is the proximal side when the first plate 40 is assembled in the sole structure 12. The transverse groove 64 is aligned with the transverse ridge 62, meaning that it is directly under the transverse groove 64 on the opposite side of the first plate 40, and tracks the transverse ridge 62 from a medial side edge 68 of the first plate 40 to a lateral side edge 70 of the first plate 40. The transverse ridge 62 and the transverse groove 64 thus extend the entire width of the first plate 40. The transverse ridge 62 and the transverse groove 64 are present at least when the first plate 40 is in an unstressed state as shown in FIGS. 10A and 11A (i.e., when not subjected to applied deformation forces, whether compressive or bending forces) and the first plate 40 is biased to the unstressed state. The transverse ridge 62 and transverse groove 64 are disposed generally under a bending axis of the MTP joints and lessen the longitudinal bending stiffness of the first plate 40 during dorsiflexion. The transverse groove 64 thus functions as a flex groove and encourages longitudinal flexing of the sole structure 12 to occur at the location of the transverse groove 64 such as during dorsiflexion. As best shown in FIGS. 1 and 3, the outsole component 50A also has a transverse ridge 51 and a transverse groove 53 that underlie and track the transverse ridge 62 and transverse groove 64, and extend the entire width of the outsole component 50A, from the medial side 30 to the lateral side 32 of the article of footwear 10.

Figure 22:
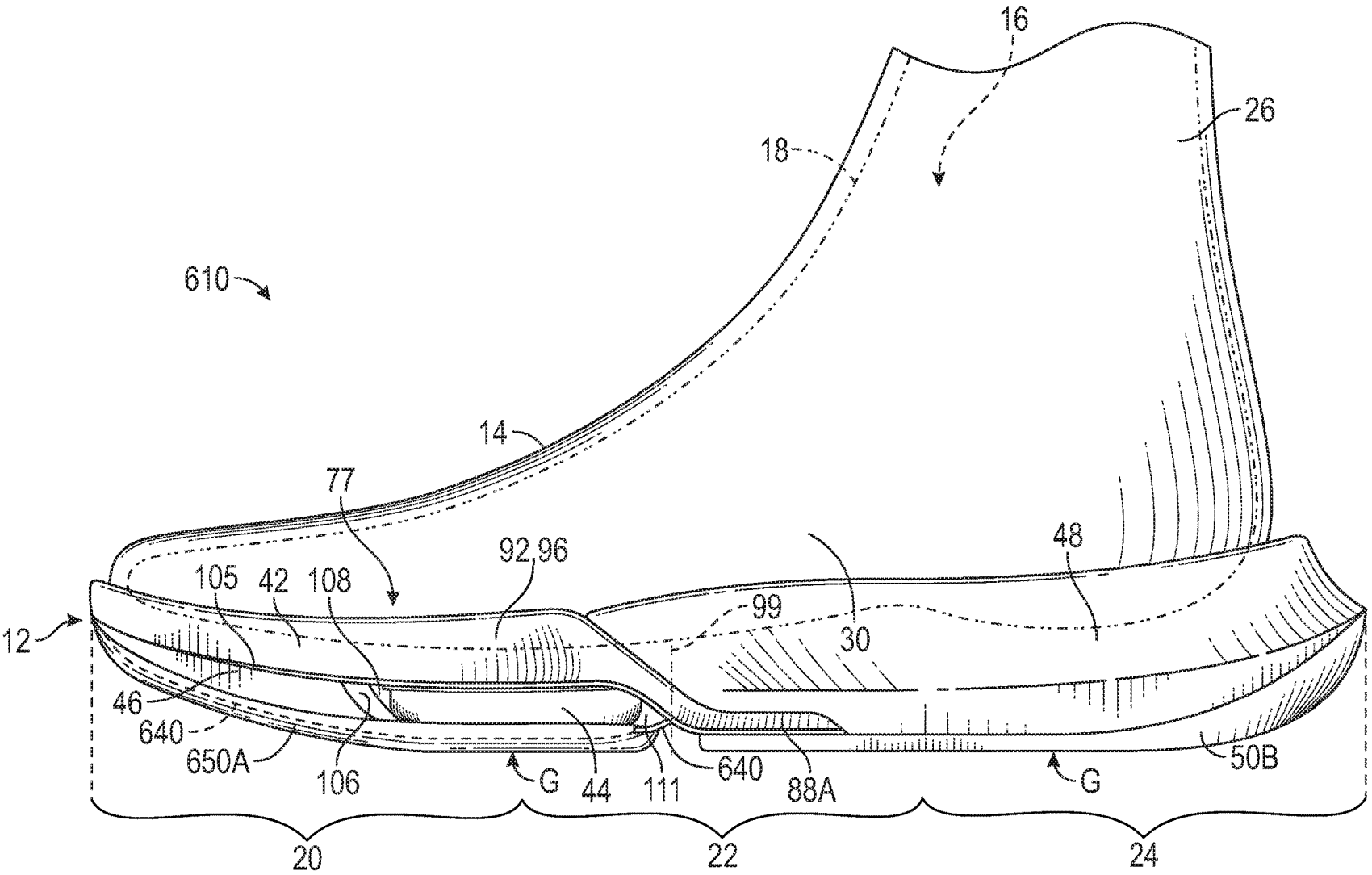
FIG. 22 is a medial side view of an article of footwear including a sole structure and an upper secured to the sole structure in an alternative aspect of the disclosure.
Figure 23:
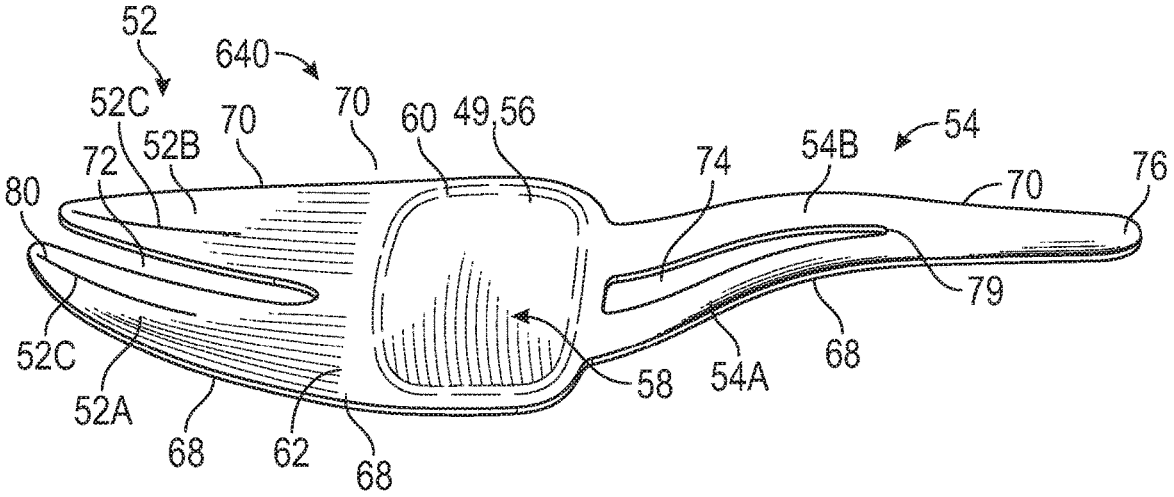
FIG. 23 is a top perspective view of a first plate of the sole structure of FIG. 22.
Figure 24:
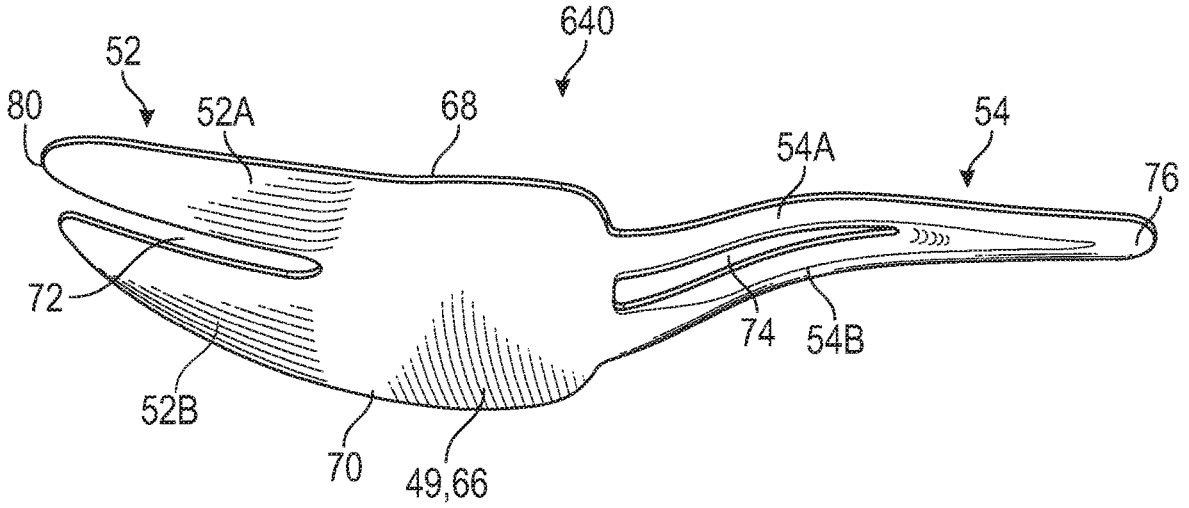
FIG. 24 is a bottom perspective view of the first plate of FIG. 23.

In other embodiments, the first plate 40 does not have a transverse ridge or a transverse groove. For example, FIG. 22 shows an article of footwear 610 that is alike in all aspects to article of footwear 10 except that the first plate 40 is replaced by a first plate 640 that does not include the transverse ridge 62 or the transverse groove 64, as best shown in FIGS. 23 and 24. Because there is no transverse ridge or transverse groove, the forward outsole component 50A is replaced with an outsole component 650A that has no transverse ridge 51 or transverse groove 53. The first plate 640 can be used in any of the sole structures shown and described herein.

Figure 25:
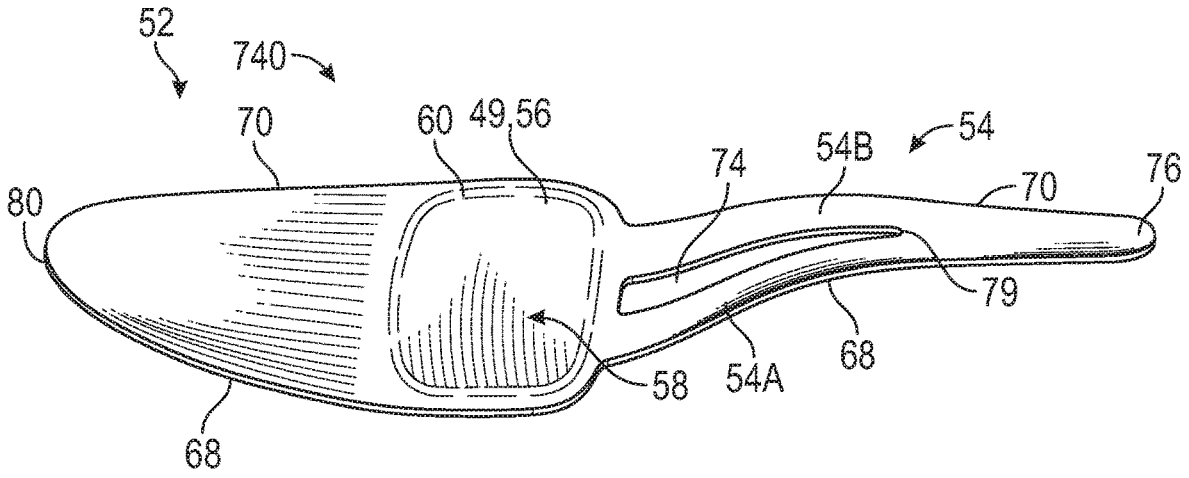
FIG. 25 is a top perspective view of a first plate in an alternative aspect of the disclosure.
Figure 26:
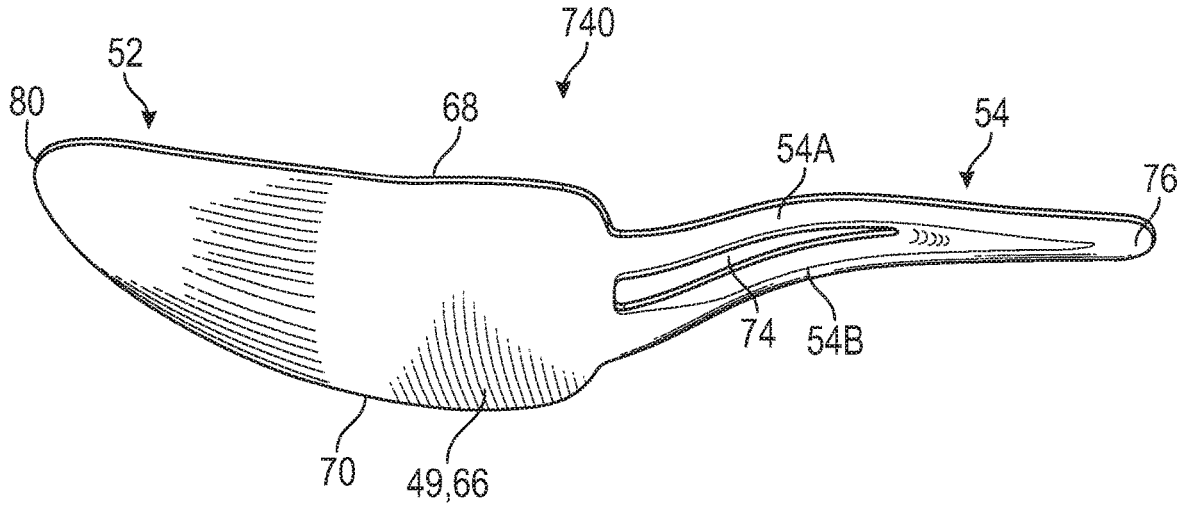
FIG. 26 is a bottom perspective view of the first plate of FIG. 25.

Other alternative embodiments of first plates that can be used in any of the sole structures shown and described herein are shown in FIGS. 25 and 26, and FIGS. 33 and 34. In FIGS. 25-26, a first plate 740 is alike in all aspects to first plate 640, except that the forward portion of the first plate 740 is undivided. Stated differently, a forward portion of the first plate 740 is not bifurcated and instead is of a unitary, solid construction without a slot 72 at a foremost extent (i.e., at forward edge 80). Accordingly, when used in the sole structure 12 or any other sole structure shown and described herein, the first plate 740 would be undivided forward of the fluid-filled bladder 44 or bladders 44A, 44B.

Figure 33:
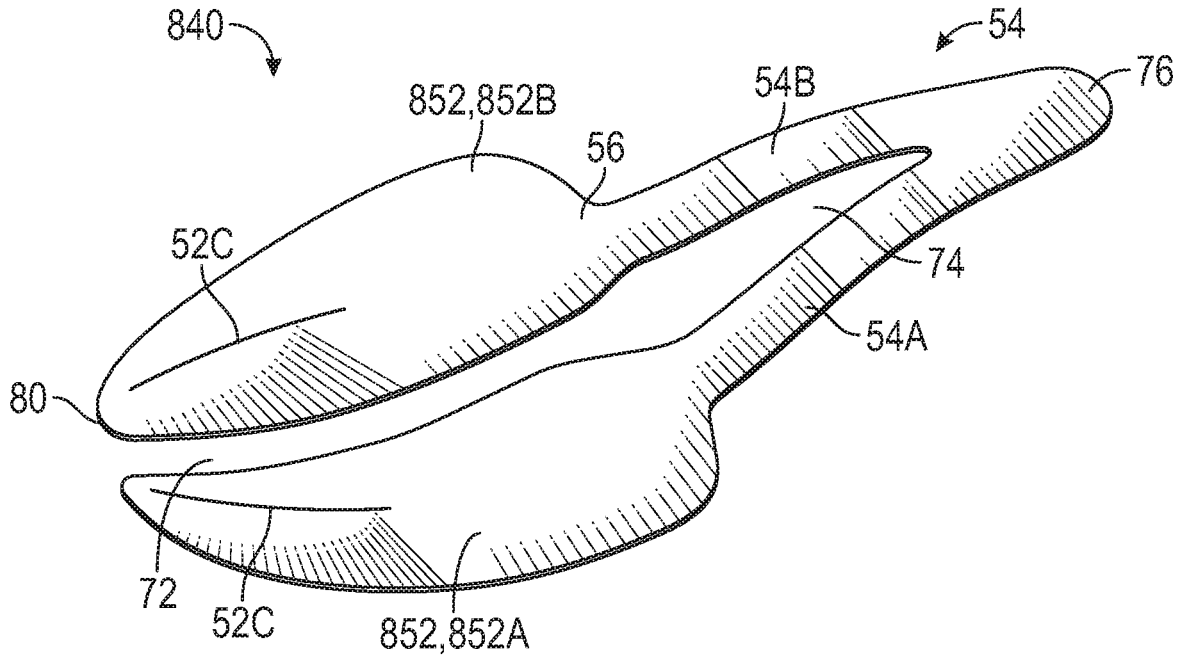
FIG. 33 is a top perspective view of a first plate in an alternative aspect of the disclosure.
Figure 34:
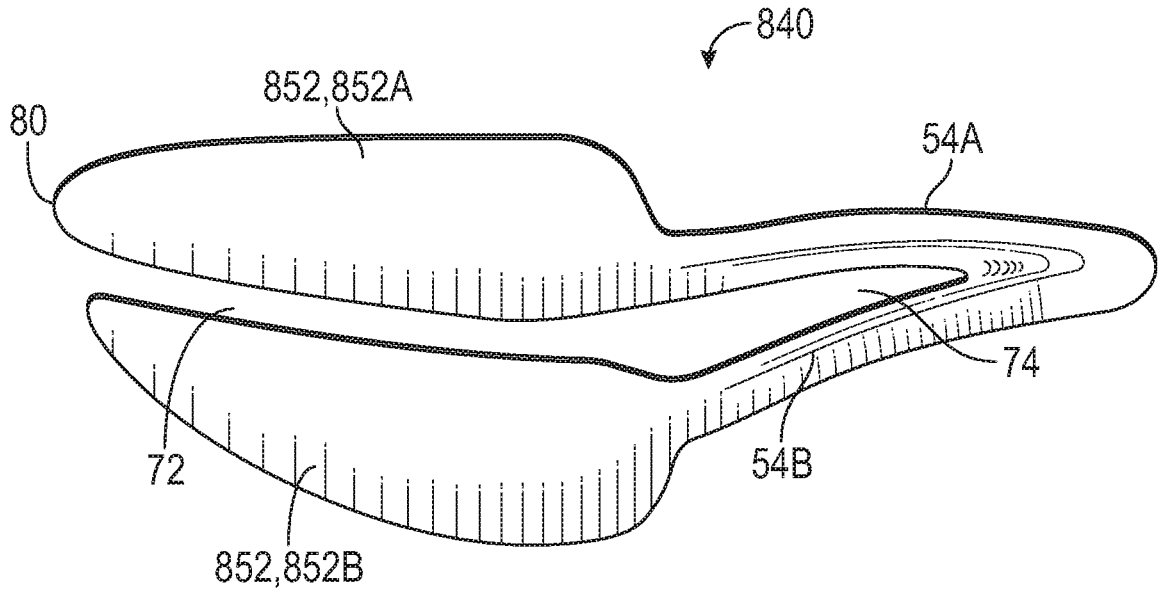
FIG. 34 is a bottom perspective view of the first plate of FIG. 33.

In another alternative embodiment of a first plate 840 shown in FIGS. 33 and 34, the first plate 840 is alike first plate 640 in all aspects except that the first plate 840 is bifurcated from the forward edge 80 of the first plate 640 rearward to the medial and lateral rails 54A, 54B, so that the slot 72 continues to and joins with the aperture 74. A bifurcated portion 852 extends to the rails 54A, 54B.

Figure 10B:
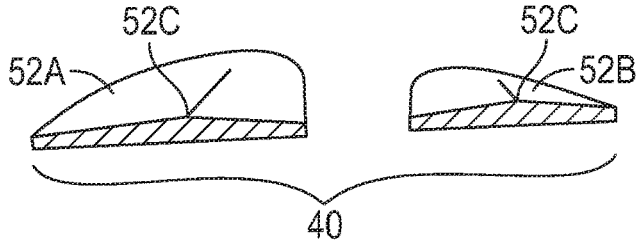
FIG. 10B is a cross-sectional illustration of the first plate taken at lines 10B-10B in FIG. 10A.

Referring to FIGS. 10A and 11A, the bifurcated portion 52 of the first plate 40 includes a medial projection 52A and a lateral projection 52B separated from one another by a slot 72 that extends from a forward edge of the first plate 40 rearward to the transverse ridge 62. The bifurcated portion 52 provides greater medial-lateral flexibility in the forefoot region 20 of the sole structure 12 than would a plate of like thickness and material but having a continuous, unslotted forward portion, as the projections 52A, 52B are each narrower in width than an unslotted plate, and can bend and flex in response to applied forces separately from one another. As best shown in FIG. 10B, the medial projection 52A and the lateral projection 52B each have a respective longitudinally-extending ridge 52C extending upward on the proximal side 56 of the first plate 40. The respective longitudinally-extending ridges 52C thicken the projections 52A, 52B such that the projections 52A, 52B are thickest at the ridges 52C when a cross-section is taken perpendicular to the ridges 52C, as shown in FIG. 10B. The ridges 52C thus strengthen the projections 52A, 52B in comparison to a configuration in which the projections 52A, 52B do not have ridges 52C, and increase the longitudinal bending stiffness of the projections 52A, 52B.

Figure 11B:
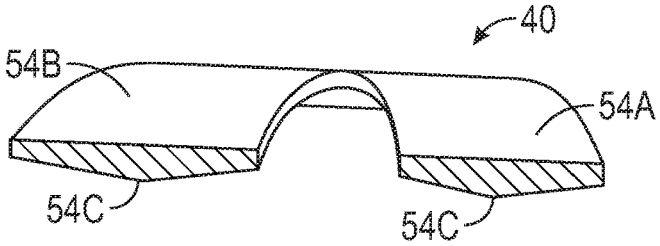
FIG. 11B is a cross-sectional illustration of the first plate taken at lines 11B-11B in FIG. 11A.

The tapered posterior portion 54 of the first plate 40 includes a medial rail 54A and a lateral rail 54B that are separated from one another by an elongated aperture 74 that begins just rearward of the central portion 49 and ends forward of a terminal end 76 of the tapered posterior portion 54, so that the medial rail 54A and the lateral rail 54B converge just rearward of the aperture 74. The tapered posterior portion 54 is referred to as "tapered" because it gradually decreases in width from the central portion 49 to the terminal end 76. Stated differently, the medial side edge 68 and the lateral side edge 70 of the first plate 40 move closer to one another as the tapered posterior portion 54 progresses rearward from the central portion 49 to the terminal end 76. As best shown in FIG. 11B, the medial rail 54A and the lateral rail 54B each have a respective longitudinally-extending ridge 54C extending downward on the distal side 66 of the first plate 40. The longitudinally-extending ridges 54C thicken the rails 54A, 54B such that the rails 54A, 54B are thickest at the ridges 54C when a cross-section is taken perpendicular to the rails 54A, 54B, as shown in FIG. 11B. The respective longitudinally-extending ridges 54C strengthen the rails 54A, 54B in comparison to a configuration in which the rails 54A, 54B did not have ridges 54C and increase their longitudinal bending stiffness.

Figure 12:
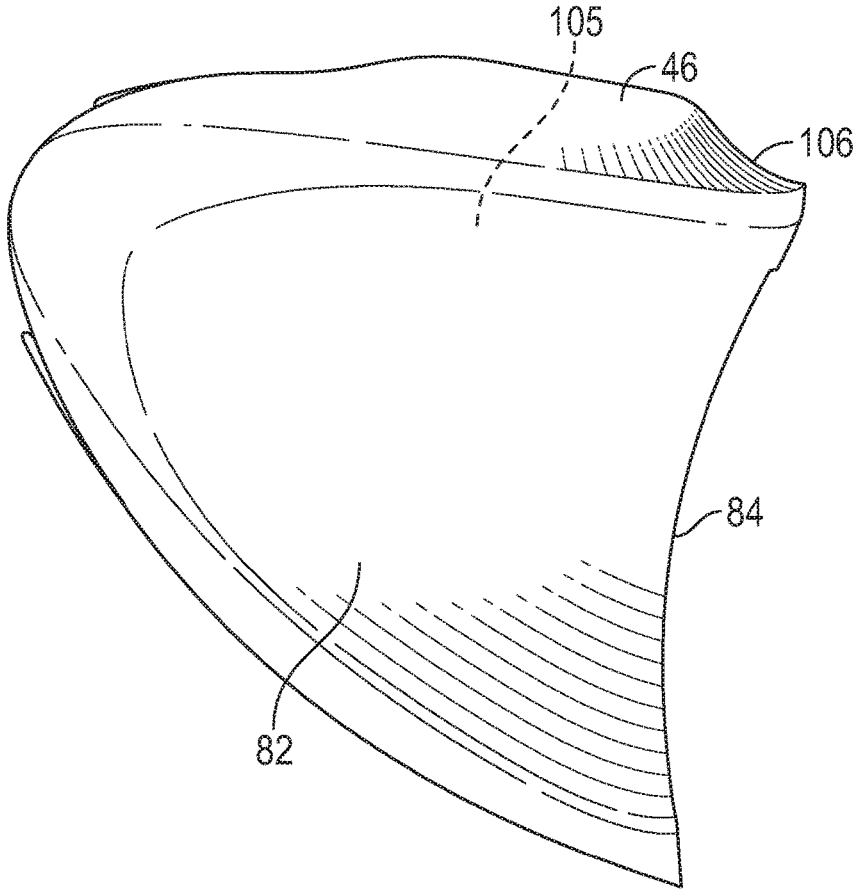
FIG. 12 is a bottom perspective view of a forefoot midsole unit of the sole structure of FIG. 1.
Figure 13:
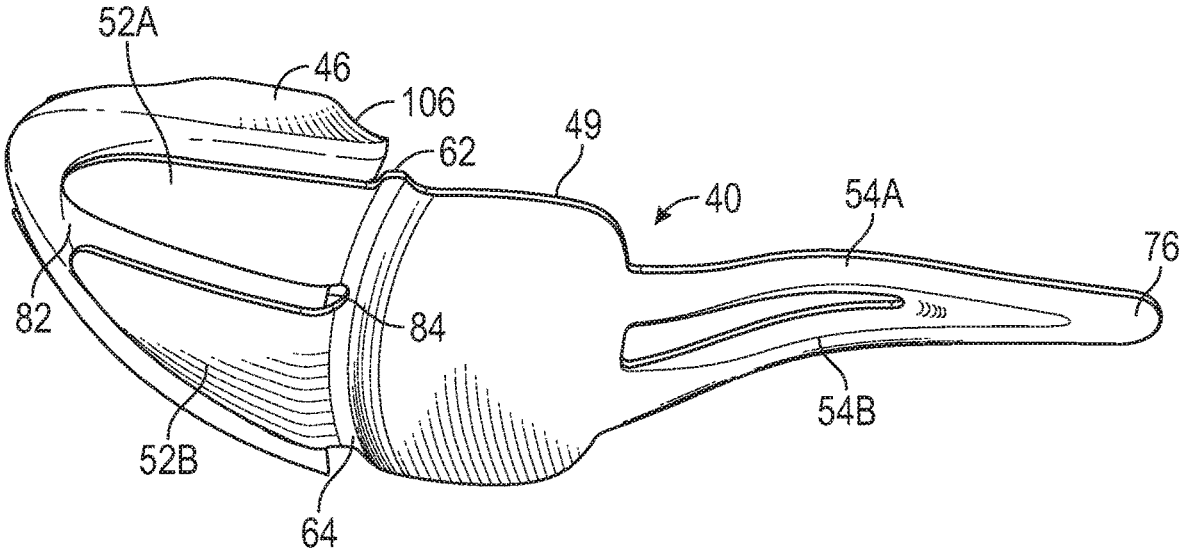
FIG. 13 is a bottom perspective view of the forefoot midsole unit of FIG. 12 stacked on the first plate of FIG. 10A.

As best shown in FIG. 13, when assembled in the sole structure 12, a distal side 82 of the forefoot midsole unit 46 rests on the proximal side 56 of the medial and lateral projections 52A, 52B. As shown in FIGS. 12 and 13, a rear edge 84 of the forefoot midsole unit 46 arcs in a forward direction so that it abuts a similarly arced forward side of the transverse ridge 62.

Figure 6:
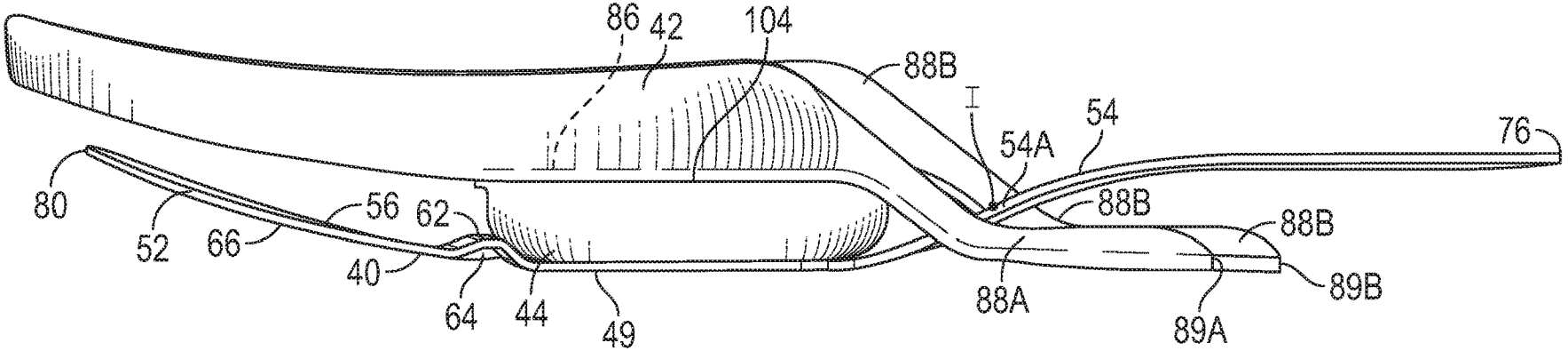
FIG. 6 is a medial side view of first and second plates and a fluid-filled bladder of the sole structure of the FIG. 1, with midsole units and outsole components not shown.
Figure 7:
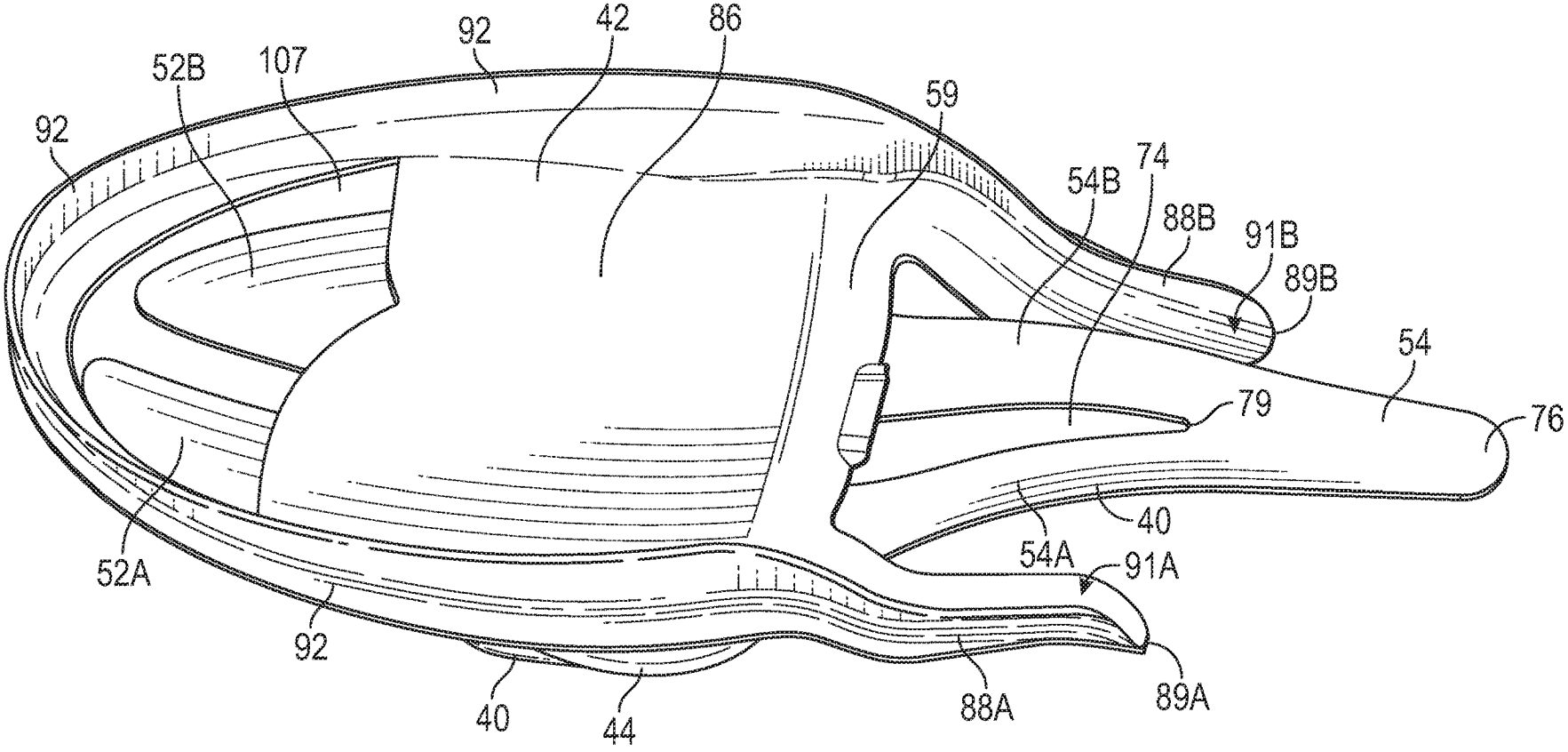
FIG. 7 is a perspective top view of the plates and fluid-filled bladder of FIG. 6.
Figure 8:
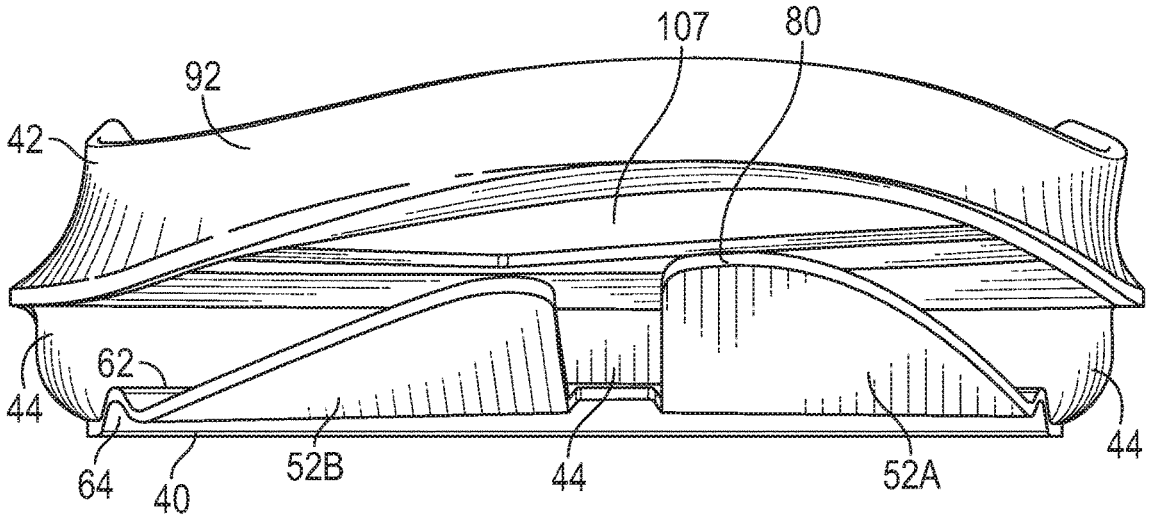
FIG. 8 is a front view of the components of the sole structure of FIG. 6.
Figure 9:
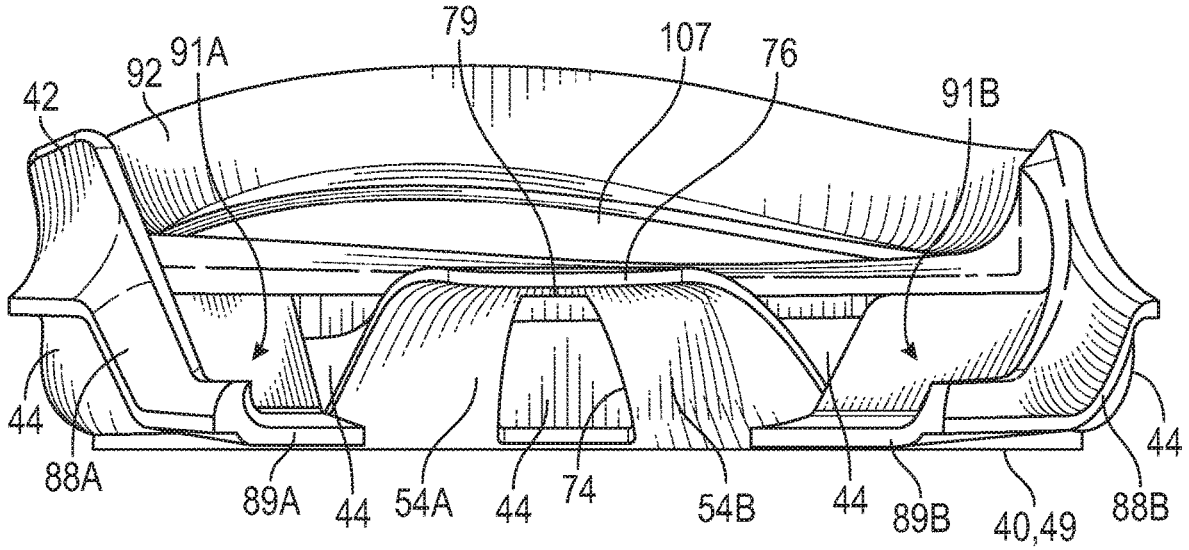
FIG. 9 is a rear view of the components of the sole structure of FIG. 6.

As best shown in FIG. 6, the first plate 40 is generally spoon-shaped (i.e., in profile in the longitudinal direction) in the unstressed state to which the first plate 40 is biased. For example, the proximal side 56 of the first plate 40 is concave in the longitudinal direction from a forward edge 80 of the forward portion 52 to an inflection point I, which falls about midway along the length of the rails 54A, 54B. The distal side 66 is convex along the longitudinal midline LM from the forward edge 80 to the inflection point I. As best shown in FIG. 8, the medial and lateral projections 52A, 52B of the forward portion 52 slope upward from just forward of the transverse ridge 62 to their tips (e.g., the tip of projection 52A is at the forward edge 80 of projection 52A). As best shown in FIG. 9, the rails 54A, 54B slope generally upward from the central portion 49 to the rear end 79 of the aperture 74. As is evident from FIGS. 6 and 9, from the rear end 79 of the aperture 74 to the terminal end 76, the first plate 40 is generally level in its unstressed state. Bending of the first plate 40 in the longitudinal direction during dorsiflexion will store, as potential energy, at least some of the energy input by the wearer to bend the first plate 40, which potential energy is then released when the sole structure 12 pushes away from the ground in a propulsive phase of the gait cycle just prior to toe off, with the first plate 40 unbending at toe-off to its unstressed, spoon shape at least partially in the direction of forward motion.

During dorsiflexion, as the heel region 24 lifts with the forefoot region 20 remaining in contact with the ground, the first plate 40 bends generally under a bending axis of the metatarsal phalangeal joints MTP which is generally at position 77 in FIG. 1, and the concavity of the proximal side 56 in the forefoot region 20 increases. The bending axis is generally transverse to the sole structure 12, and may be angled slightly forward on the medial side 30 relative to the lateral side 32 in accordance with the bones of the foot 18. The different MTP joints of the foot 18 may have slightly different bending axes, and the position 77 where the bending axis is disposed will vary depending on the specific foot. The position 77 may represent the bending axis of the MTP joint of the big toe. At toe off, when the foot 18 lifts the sole structure 12 away from the ground, the compressive forces in the first plate 40 above a neutral axis of the first plate 40 (i.e., toward the proximal side 56), and the tensile forces below the neutral axis (i.e., toward the distal side 66) are relieved, returning the first plate 40 from the dorsiflexed state of increased forefoot concavity to its unstressed state shown in FIGS. 10A and 11A. At least a portion of the wearer's own energy input may be returned, as the internal compressive and tensile forces in the first plate 40, due to the wearer bending the first plate 40, are released as the first plate 40 unbends, creating a net force at least partially in the forward direction. The spoon shape of the first plate 40 also helps the forward rolling of the foot 18 during dorsiflexion to occur with less effort in comparison to a plate with a flat side profile.

Figure 14:
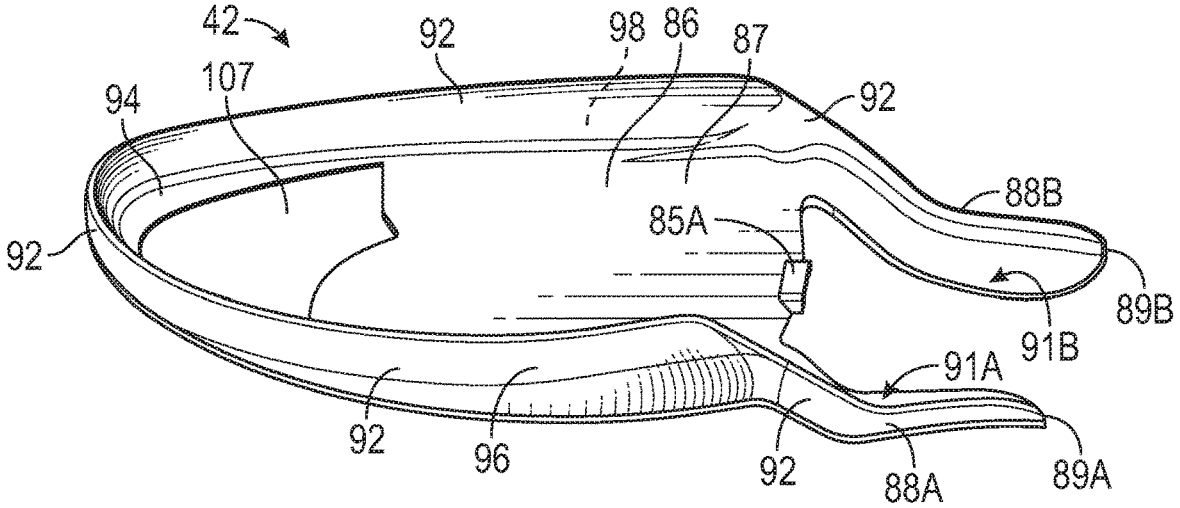
FIG. 14 is a top perspective view of the second plate of the sole structure of FIG. 1.
Figure 15:
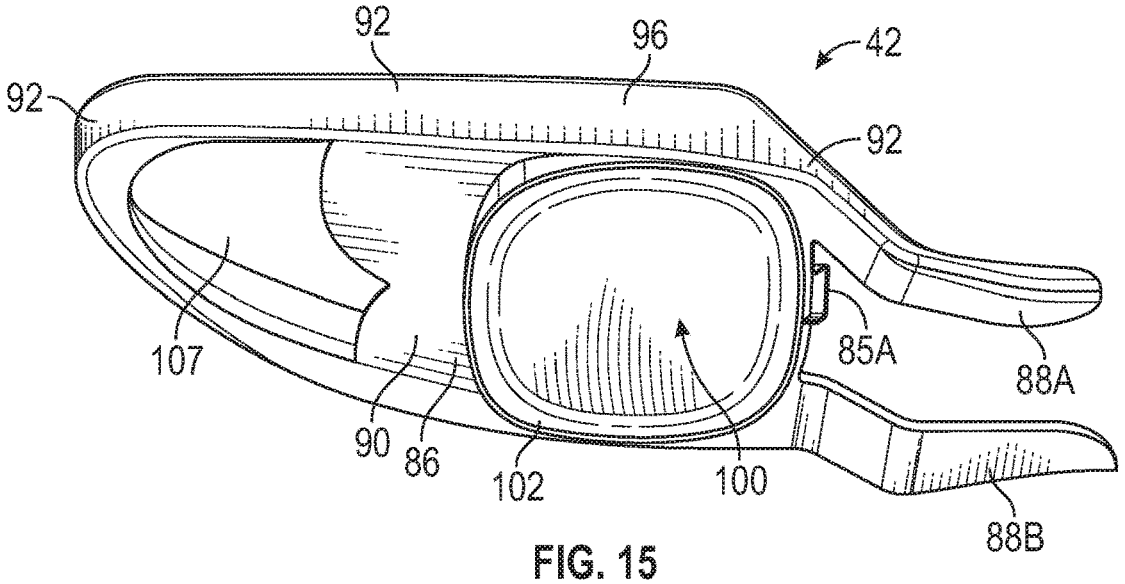
FIG. 15 is a bottom perspective view of the second plate of FIG. 14.

The second plate 42 is shown in isolation in FIGS. 14 and 15. In an exemplary embodiment, the bending stiffness and the compressive stiffness of the second plate 42 are lower than that of the first plate 40. In a non-limiting example, the second plate 42 may be an injected, polyester based TPU, such as ESTANE® SKYTHANE™ S395A available from Lubrizol Advanced Materials, Inc. in Cleveland, Ohio USA. In one non-limiting example, the second plate 42 may have a hardness of approximately 95 on a Shore A durometer scale using an ASTM D2240 test method, a specific gravity of approximately 1.22 g/cm$^3$ using an ASTM D792 test method, and a tensile stress at 100 percent elongation of approximately 140 kilogram-force per square centimeters (kgf/cm$^2$) using an ASTM D412 test method.

The second plate 42 has a central portion 86, a medial-side trailing arm 88A, and a lateral-side trailing arm 88B. Both the medial-side trailing arm 88A and the lateral-side trailing arm 88B are rearward of the central portion 86. The trailing arms 88A, 88B are referred to as "trailing" as they are positioned rearward of the central portion 86, and therefore "trail" the central portion 86 in the longitudinal direction of the sole structure 12. The trailing arms 88A, 88B slope downward and away from the central portion 86 in a rearward direction. The trailing arms 88A, 88B are concave at a proximal side 87 of the second plate 42, as shown in FIG. 14, and are convex at a distal side 90 of the second plate 42, as shown in FIG. 15.

FIG. 6 shows only the fluid-filled bladder 44, the first plate 40, and the second plate 42 in their relative positions when the sole structure 12 is assembled. The forefoot midsole unit 46, the rear midsole unit 48, and the outsole components 50A, 50B are not shown in order to best view the fluid-filled bladder 44, the first plate 40, and the second plate 42. The fluid-filled bladder 44 is supported by the first plate 40 on the proximal side 56 of the central portion 49 of the first plate 40 and forward of the tapered posterior portion 54. The central portion 86 of the second plate 42 is supported by the fluid-filled bladder 44 on a proximal side 104 of the fluid-filled bladder 44 and forward of the medial-side trailing arm 88A and the lateral-side trailing arm 88B. The tapered posterior portion 54 ascends rearward of the fluid-filled bladder 44 between the medial-side trailing arm 88A and the lateral-side trailing arm 88B (i.e., inward of the trailing arms 88A, 88B in the transverse direction of the sole structure 12). The medial-side trailing arm 88A and the lateral-side trailing arm 88B descend rearward of the fluid-filled bladder 44. Between the fluid-filled bladder 44 and the terminal ends 89A, 89B of the trailing arms 88A, 88B, the medial-side trailing arm 88A and the lateral-side trailing arm 88B descend from forward portions of the trailing arms 88A, 88B which are at a position above the first plate 40 to terminal ends 89A, 89B of the medial-side trailing arm 88A and the lateral-side trailing arm 88B, respectively, which are at a position lower than (i.e., below) the tapered posterior portion 54 (at least that part of the tapered posterior portion 54 that is rearward of the inflection point I, including the entire portion rearward of the aperture 74). Between the fluid-filled bladder 44 and the terminal end 76 of the tapered posterior portion 54, the rails 54A, 54B ascend from a position below the medial-side trailing arm 88A and the lateral-side trailing arm 88B at forward portions of the rails 54A, 54B, to a position above the medial-side trailing arm 88A and the lateral-side trailing arm 88B. The terminal end 76 of the tapered posterior portion 54 of the first plate 40 is rearward of the terminal ends 89A, 89B of the trailing arms 88A, 88B. The first plate 40 extends from the forefoot region 20, through the midfoot region 22, to the heel region 24, and the second plate 42 extends only in the forefoot region 20 and the midfoot region 22.

In an alternative embodiment, instead of a tapered posterior portion, the posterior portion of the first plate 40 includes one or both of a medial-side trailing arm and a lateral-side trailing arm that ascend. Instead of a medial-side trailing arm and/or a lateral-side trailing arm, the posterior portion of the second plate may or may not be tapered and includes a posterior portion disposed between and descending adjacent to the one or both of the medial-side trailing arm and the lateral-side trailing arm of the first plate 40.

Figure 5:
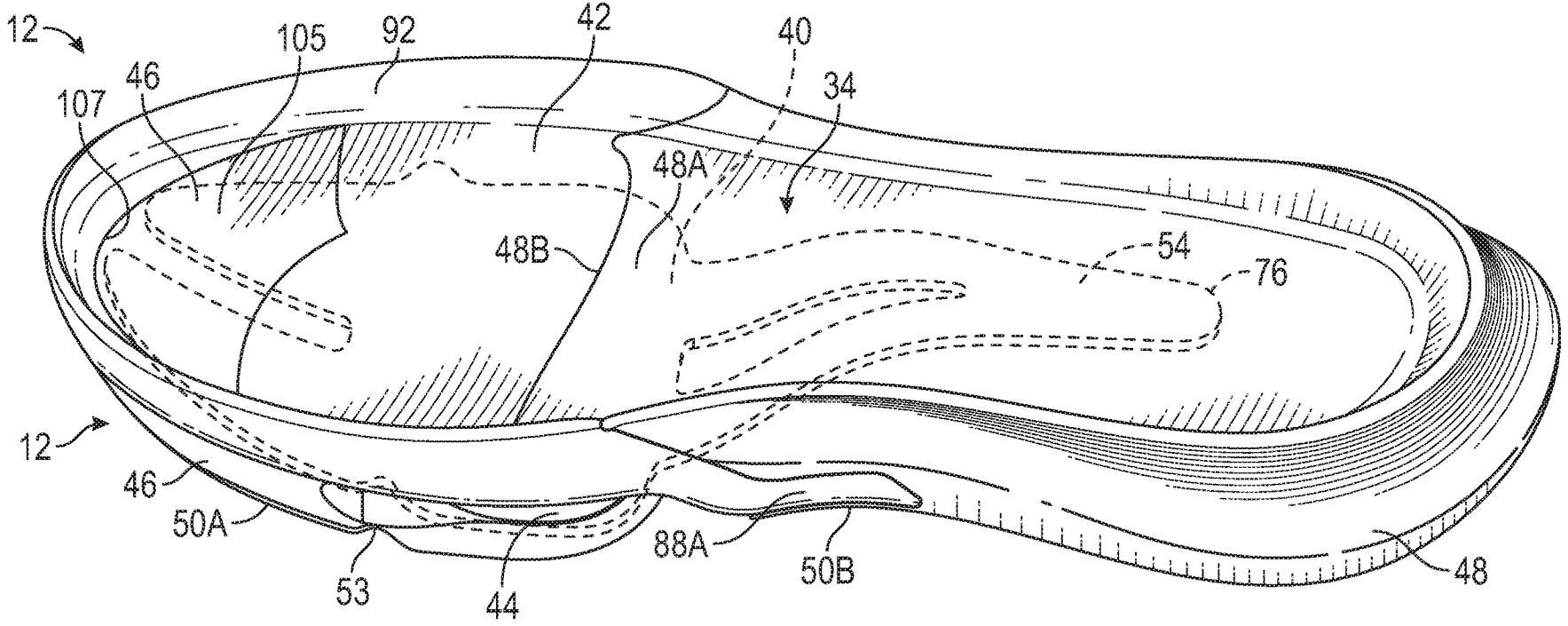
FIG. 5 is a perspective top view of the sole structure of FIG. 3.

As best shown in FIG. 5, the second plate 42 includes a peripheral wall 92 at the central portion 86 that extends from the medial-side trailing arm 88A and the lateral-side trailing arm 88B and around a forward extent 94 of the second plate 42. The peripheral wall 92 continues along a forward portion of the medial-side trailing arm 88A at the medial side 96 of the second plate 42, and along a forward portion of the lateral-side trailing arm 88B at the lateral side 98 of the second plate 42. With the peripheral wall 92, the second plate 42 is generally recessed and concave at the proximal side 87, creating a footbed with the rear midsole unit 48. When the sole structure 12 is secured to the upper 14, the foot 18 is supported on the foot-facing surface 34 (shown in FIG. 4) on the proximal side 87 of the central portion 86, with the bottom of the foot 18 resting slightly below the upper extent of the peripheral wall 92, as illustrated by the phantom-lined foot 18 in FIG. 1. The peripheral wall 92 thus provides support to the medial and lateral sides of the forefoot.

As shown in FIG. 15, the distal side 90 of the second plate 42 defines a recess 100 at the central portion 86. For example, a protrusion 102 having a closed shape extends downward from the central portion 86 so that a recess 100 is defined by and surrounded by the protrusion 102. When the second plate 42 and the fluid-filled bladder 44 are assembled in the sole structure 12, the proximal side 104 of the fluid-filled bladder 44 is seated on the distal side 90 of the second plate 42 in the recess 100, so that the fluid-filled bladder 44 is nested in the recess 100, as best shown in FIG. 4. With the fluid-filled bladder 44 nested in both the recess 100 of the second plate 42 and the recess 58 of the first plate 40, the first and second plates 40, 42 are configured to help maintain the position of the fluid-filled bladder 44. The fluid-filled bladder 44 is wider than the protrusion 60 of the first plate 40, and extends outward beyond the protrusion 60 as is evident in FIGS. 5, 7 and 17. The recess 100 is wider than the recess 58, however, and the second plate 42 is laterally-outward of the sidewalls of the fluid-filled bladder 44 when the fluid-filled bladder 44 is nested between the plates 40, 42, as best shown in FIG. 17.

Referring to FIGS. 14 and 15, the second plate 42 defines a through hole 107 forward of the central portion 86 and thus forward of the fluid-filled bladder 44 in the assembled sole structure 12. The through hole 107 is disposed over a proximal side 105 of the forefoot midsole unit 46 as best shown in FIG. 5. The forefoot midsole unit 46 may comprise an ethylene-vinyl acetate (EVA) foam or other foam that has a lower compressive stiffness than the second plate 42. This enables the phalanges of the foot 18 to grip the forefoot midsole unit 46 with greater ease than would be afforded by a stiffer component by compressing the forefoot midsole unit 46 during dorsiflexion in a propulsive phase of the gait cycle, just prior to toe off.

Figure 16:
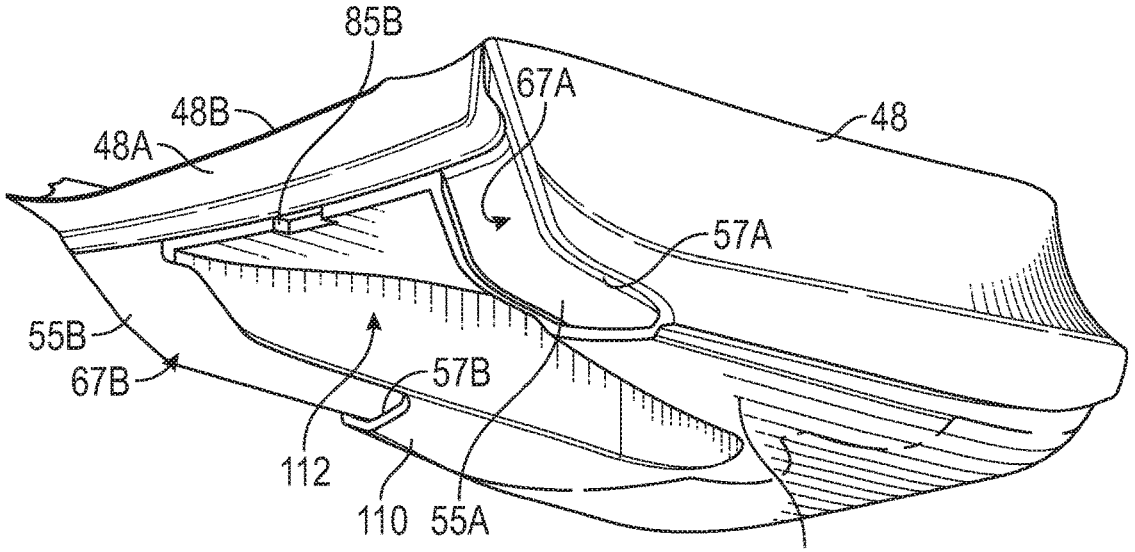
FIG. 16 is a bottom perspective view of a rear midsole unit of the sole structure of FIG. 1.

With reference to FIGS. 1, 4, and 16, the sole structure 12 includes the rear midsole unit 48 which extends rearward of the fluid-filled bladder 44. The rear midsole unit 48 is not entirely rearward of the fluid-filled bladder 44, however. A forward extent 48A of the rear midsole unit 48 overlays the fluid-filled bladder 44 as shown in FIG. 4. As best shown in FIG. 5, a forward edge 48B of the forward extent 48A fits over a rear extent 59 (labelled in FIG. 7) of the central portion 86 of the second plate 42, and provides a flush foot-facing surface 34. The forefoot midsole unit 46, the second plate 42 and the rear midsole unit 48 together provide the entire foot-facing surface 34 of the sole structure 12.

With reference to FIG. 16, a distal side 110 of the rear midsole unit 48 has a medial shoulder 55A and a lateral shoulder 55B, and defines a recess 112 between the medial shoulder 55A and the lateral shoulder 55B. The medial shoulder 55A and the lateral shoulder 55B have convex surfaces 67A, 67B, respectively, that are in slight recesses 57A, 57B of the rear midsole unit 48. The medial shoulder 55A and the lateral shoulder 55B slope downward and rearward. The medial shoulder 55A is configured to interface flush with and secure to the downward and rearward sloping medial-side trailing arm 88A at the proximal side 87 of the second plate 42, with the proximal surface 91A of the medial-side trailing arm 88A secured to the convex surface 67A of the medial shoulder 55A and nested in the recess 57A. The lateral shoulder 55B is configured to interface flush with and secure to the downward and rearward sloping lateral-side trailing arm 88B, with the proximal surface 91B of the lateral-side trailing arm 88B secured to the convex surface 67B of the lateral shoulder 55B and nested in the recess 57B. A projection 85A of the second plate 42 seats in a small recess 85B in the rear midsole unit 48 and helps to secure and locate the second plate 42 relative to the rear midsole unit 48 during assembly of the sole structure 12.

The recess 112 of the rear midsole unit 48 accommodates the ascending rails 54A, 54B of the first plate 40 as the ascending rails 54A, 54B ascend upward in the recess 112 from the central portion 49 to the terminal end 76. Only the proximal surface of the tapered posterior portion 54 of the first plate 40 is seated against and secured to a lower surface 114 of the rear midsole unit 48 in the recess 112, as best shown in FIG. 4. The ascending portions of the rails 54A, 54B are not in contact with the rear midsole unit 48, and can bend during dorsiflexion of the sole structure 12 without interference of the rear midsole unit 48 until, at a relatively large bending angle, the proximal surfaces of the rails 54A, 54B may contact the distal surface of the rear midsole unit 48 in the recess 112. The recess 112 tapers in width in the rear direction as shown in FIG. 3, so that the rear extent of the first plate 40 near the terminal end 76 fits snugly in the recess 112, and against a rear wall 116 of the recess 112, as shown in FIG. 4.

As will be understood by those skilled in the art, during bending of the sole structure 12, as the foot 18 is dorsiflexed, there is a location in the sole structure 12 referred to as a neutral plane (although not necessarily planar) or neutral axis above which the sole structure 12 is in compression, and below which the sole structure 12 is in tension. For a composite sole structure (made up of multiple layers of different materials that cannot slide relative to one another or bend independently of one another), the placement of the neutral axis is dependent in part upon the stiffness of each of the materials. The materials of the first plate 40, the second plate 42, and the rear midsole unit 48 are selected so that the compressive stiffness and the bending stiffness of the second plate 42 is greater than that of the rear midsole unit 48 and less than that of the first plate 40. The first plate 40 may be more rigid (i.e., stiffer) than the second plate 42. The first plate 40 may have a first bending stiffness and a first compressive stiffness, and the second plate 42 may have a second bending stiffness that is less than the first bending stiffness, and a second compressive stiffness that is less than the first compressive stiffness. This may be due to different materials and/or geometries of the plates.

Because the second plate 42 is above the stiffer first plate 40 at the central portions 49, 86 of the plates 40, 42, the neutral bending plane may be relatively low (close to the first plate 40) in the region of the sole structure 12 where the fluid-filled bladder 44 is disposed. Near the longitudinal position 99 shown in FIG. 4, only the rails 54A, 54B of the first plate 40, the rear midsole unit 48, and the trailing arms 88A, 88B affect the bending stiffness of the sole structure 12 as only these components are intersected by a vertical plane (i.e., a coronal plane that extends medial-laterally and perpendicular to the longitudinal midline LM of FIG. 3) through the sole structure 12 at the longitudinal position 99. The rails 54A, 54B can bend in this area without contacting any other portions of the sole structure 12. The neutral bending plane of the sole structure 12 will be closer to the foot in this region, and the longitudinal bending stiffness of the sole structure 12 will be less at the rails 54A, 54B than forward of the rails. In general, the medial-side and lateral-side trailing arms 88A, 88B will be below the neutral bending axis and thus subjected to greater tensile forces, and the central portion 86 will be above the neutral bending axis and thus subjected to greater compressive forces during longitudinal bending. The trailing arms 88A, 88B of the second plate 42 being in tension, may provide a downward and rearward force on the rear of the central portion 86 during longitudinal bending due to dorsiflexion, and may aide in dispersing forces on the central portion 86 over the fluid-filled bladder 44 in the fore-aft direction.

Referring to FIG. 1, rearward of the fluid-filled bladder 44, at a longitudinal position 99 where the ascending rails 54A, 54B are at the same elevation as the descending trailing arms 88A, 88B, the ascending rails 54A, 54B are spaced apart from the rear midsole unit 48 and are relatively thin. These structural properties may cause the sole structure 12 to have a lower bending stiffness at the longitudinal position 99 than at a position 77 of the bending axis of the MTP joint. Accordingly, when the article of footwear 10 is not on a foot, and upward and inward bending forces are simultaneously applied to the forefoot region 20 and heel region 24, the article of footwear 10 may tend to bend near the longitudinal position 99. When the article of footwear 10 is worn on a foot 18, however, the longitudinal position 99 is generally aligned with an arch or instep of the foot 18. The foot 18 bends in dorsiflexion at the bending axis of the MTP joint, i.e., position 77, rather than at the longitudinal position 99 (as arches do not tend to bend during dorsiflexion, at least not as significantly as the MTP joint). During wear, the article of footwear 10 will thus bend at an area of greater stiffness (generally directly under the MTP joint, at the central portions 49, 86 and the fluid-filled bladder 44A) rather than at the area of lower stiffness (which is at longitudinal position 99).

Other structural factors of the sole structure 12 that likewise affect changes in bending stiffness such as during dorsiflexion include but are not limited to the thicknesses, the longitudinal lengths, and the medial-lateral (i.e., transverse) widths of different portions of the sole structure 12. For example, the bending stiffness of the first plate 40 is less at its tapered posterior portion 54 than at its wider central portion 49.

As discussed, both the first plate 40 and the second plate 42 are secured to the rear midsole unit 48. At least in part because the first plate 40 is secured to the rear midsole unit 48 at a higher (more proximal) location than the second plate 42 (i.e., the tapered posterior portion 54 is higher than the trailing arms 88A, 88B where they interface with the rear midsole unit 48), the neutral bending axis of the sole structure 12 may be closer to the foot 18 (more proximal) in the region of the tapered posterior portion 54 and further from the foot 18 (more distal) in the region of the central portion 49.

In embodiments in which the medial-side and lateral-side trailing arms 88A, 88B are a material of greater compressive stiffness and greater bending stiffness than that of the rear midsole unit 48, they reduce the tendency of the rear midsole unit 48 to deform at the shoulders 55A, 55B under compressive loading. The medial-side and lateral-side trailing arms 88A, 88B of the second plate 42 may thus provide medial-lateral support such as during cutting movements (i.e., when the footwear 10 contacts the ground following a lateral foot movement, such as a sideways movement during a basketball game or other activities).

As best shown in FIG. 17, the fluid-filled bladder 44 includes an upper polymeric sheet 120 and a lower polymeric sheet 122 bonded to one another at a peripheral flange 124 to create a sealed interior cavity 126 that retains a fluid, such as air. The proximal side 104 of the fluid-filled bladder 44 is the upper surface of the upper polymeric sheet 120 and is bonded to the distal side 90 of the central portion 86 of the second plate 42 in the recess 100. Bonding of the upper polymeric sheet 120 to the second plate 42 may be by thermal bonding or adhesive. The distal side 61 of the fluid-filled bladder 44 is the lower surface of the lower polymeric sheet 122 and is bonded to the proximal side 56 of the first plate 40 in the recess 58. The distal side 61 of the fluid-filled bladder 44 is also bonded to the outsole component 50A where the fluid-filled bladder 44 extends beyond the width of the central portion 49.

As used herein, a "fluid" filling the interior cavity 126 may be a gas, such as air, nitrogen, another gas, or a combination thereof. The upper and lower polymeric sheets 120, 122 can be a variety of polymeric materials that can resiliently retain a fluid such as nitrogen, air, or another gas. Examples of polymeric materials for the upper and lower polymeric sheets 120, 122 include thermoplastic urethane, polyurethane, polyester, polyester polyurethane, and polyether polyurethane. Moreover, the upper and lower polymeric sheets 120, 122 can each be formed of layers of different materials including polymeric materials. In one embodiment, each of the upper and lower polymeric sheets 120, 122 is formed from thin films having one or more thermoplastic polyurethane layers with one or more barrier layers of a copolymer of ethylene and vinyl alcohol (EVOH) that is impermeable to the pressurized fluid contained therein such as a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. Additional suitable materials for the upper and lower polymeric sheets 120, 122 are disclosed in U.S. Pat. Nos. 4,183,156 and 4,219,945 to Rudy which are incorporated by reference in their entireties. Further suitable materials for the upper and lower polymeric sheets 120, 122 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the fluid-filled bladder 44, engineering properties such as tensile strength, stretch properties, fatigue characteristics, dynamic modulus, and loss tangent can be considered. For example, the thicknesses of the upper and lower polymeric sheets 120, 122 used to form the fluid-filled bladder 44 can be selected to provide these characteristics.

As best shown in FIG. 17, the fluid-filled bladder 44 includes a tensile component 130 disposed in the interior cavity 126. The tensile component 130 includes a first tensile layer 132, a second tensile layer 134, and a plurality of tethers 136 spanning the interior cavity 126 from the first tensile layer 132 to the second tensile layer 134. The tethers 136 connect the first tensile layer 132 to the second tensile layer 134. Only some of the tethers 136 are indicated with reference numbers in FIG. 17. The tethers 136 may also be referred to as fabric tensile members or threads, and may be in the form of drop threads that connect the first tensile layer 132 and the second tensile layer 134. The tensile component 130 may be formed as a unitary, one-piece textile element having a spacer-knit textile (i.e., the tensile layers 132, 134 and the tethers 136 knit as one piece). The first tensile layer 132 is bonded to an upper interior surface of the fluid-filled bladder 44 at the upper polymeric sheet 120, and the second tensile layer 134 is bonded to a lower interior surface of the fluid-filled bladder 44 at the lower polymeric sheet 122.

The tethers 136 restrain separation of the upper and lower polymeric sheets 120, 122 to the maximum separated positions shown in FIG. 17 under a given inflation pressure of gas in the interior cavity 126. The outward force of pressurized gas in the interior cavity 126 places the tethers 136 in tension, and the tethers 136 prevent the tensile layers 132, 134 and polymeric sheets 120, 122 from further movement away from one another in the vertical direction in FIGS. 17 and 18. However, the tethers 136 do not present resistance to compression when under a compressive load. When pressure is exerted on the fluid-filled bladder 44 such as due to a force of a dynamic impact of a wearer during running or other movements, or during longitudinal bending of the sole structure 12, the fluid-filled bladder 44 is compressed, and the polymeric sheets 120, 122 move closer together with the tethers 136 collapsing (i.e., going slack) in proportion to the pressure exerted on the upper and lower polymeric sheets 120, 122 adjacent the particular tethers 136. The central portions 49, 86 of the first and second plates 40, 42 that are secured to the fluid-filled bladder 44 are generally flat, and are spaced apart by a substantially uniform distance over their areas when the sole structure 12 is in the unstressed state shown in FIGS. 1 and 17, for example. Even localized impact forces on the central portions 49, 86 are dispersed by the plates 40, 42 to act more uniformly over the fluid-filled bladder 44. For example, a localized force on the central portion 49 that may occur due to the metatarsal heads of the foot 18 is dispersed over the central portion 49, which compresses the fluid-filled bladder 44 as a unit across its width, rather than compressing a localized portion of the fluid-filled bladder 44. This generally allows all of the tethers 136 to grow slack and return to their tensioned state in unison, rather than causing one or more localized groups of tethers slackening and tensioning differently than surrounding tethers, as may occur when a fluid-filled bladder is compressed under loading by a foot without plates above and below the fluid-filled bladder.

Figure 18:
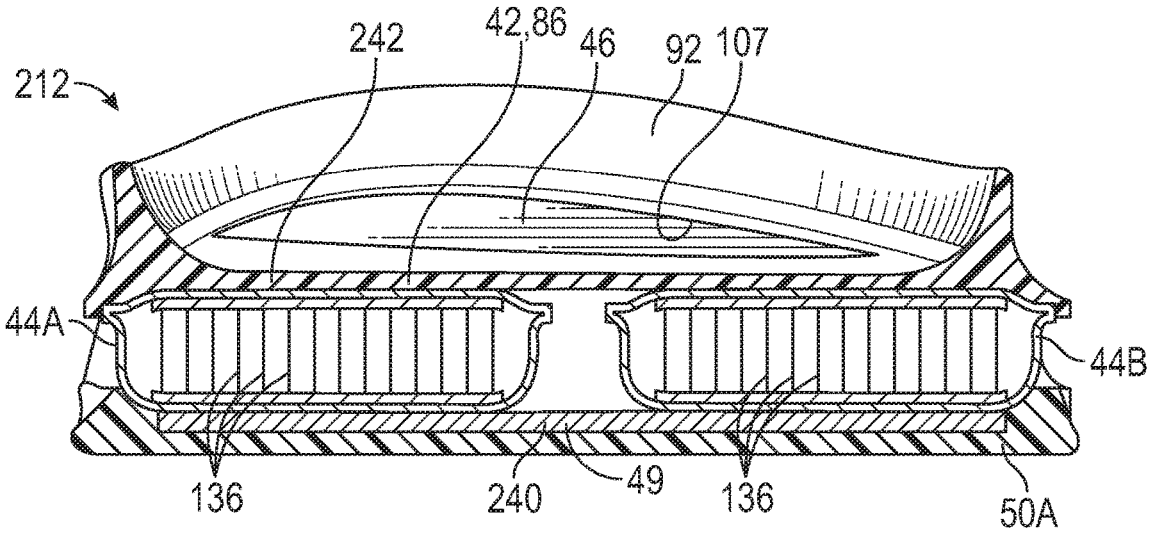
FIG. 18 is a cross-sectional view of an alternative sole structure for the article of footwear of FIG. 1.

FIG. 18 shows another example of a sole structure 212 that is configured and functions the same as sole structure 12 except that two side-by-side fluid-filled bladders 44A, 44B are used instead of a single fluid-filled bladder 44 and plates 40, 42 are replaced with plates 240, 242 respectively to accommodate the fluid-filled bladders 44A, 44B. The sole structure 212 may be secured to the upper 14 in place of sole structure 12. The fluid-filled bladders 44A, 44B are fluid-filled bladders each configured as described with respect to fluid-filled bladder 44. More particularly, the fluid-filled bladder 44A is a medial-side fluid-filled bladder, and the fluid-filled bladder 44B is a lateral-side fluid-filled bladder. The medial-side fluid-filled bladder 44A is disposed nearer to the medial side 30 of the article of footwear 10 than the lateral-side fluid-filled bladder 44B, and the lateral-side fluid-filled bladder 44B is spaced apart from the medial-side fluid-filled bladder 44A and disposed nearer to the lateral side 32 of the article of footwear 10 than the medial-side fluid-filled bladder. The medial-side fluid-filled bladder 44A and the lateral-side fluid-filled bladder 44B are disposed generally between the plates 240, 242 at the same longitudinal position along the longitudinal midline LM of the article of footwear 10. In other words, a transverse line taken perpendicular to the longitudinal midline LM will intersect both fluid-filled bladders 44A, 44B. The plates 240, 242 may be identical to plates 40 and 42, respectively, or may be configured to provide two separate recesses, one for each of the fluid-filled bladders 44A, 44B, instead of one recess 100, and the first plate 240 may be configured to provide two separate recesses, one for each of the fluid-filled bladders 44A, 44B, instead of one recess 58. The plates 240, 242 enable compressive forces applied anywhere on the either plate 240 and/or 242 inward toward the fluid-filled bladders 44A, 44B to be dispersed by the plate 240 and/or 242 over the entire upper and lower sides of the fluid-filled bladders 44A and 44B in contact with the plate 240 or 242. The fluid-filled bladders 44A, 44B could have different inflation pressures to provide a different compressive stiffness at the medial side and the lateral side.

As shown in FIGS. 1 and 12, a rear extent 106 of the forefoot midsole unit 46 slopes forward from the rear edge 84 to the proximal side 105. As shown in FIG. 1, in the assembled sole structure 12, the rear extent 106 slopes upwardly and away from the fluid-filled bladder 44 from the first plate 40 (shown in hidden lines) to the second plate 42. This creates a gap 108 between the fluid-filled bladder 44 and the forefoot midsole unit 46 that extends transversely from the medial side 30 to the lateral side 32 of the footwear 10. The gap 108 provides room for the fluid-filled bladder 44 to expand forward when compressed during loading, and the rear extent 106 acts as a reaction surface for the forward wall of the fluid-filled bladder 44, moderating its compression. FIG. 1 also shows an additional gap 111 rearward of the fluid-filled bladder 44 that permits the fluid-filled bladder 44 to expand rearward when compressed during loading.

FIGS. 1, 2 and 17 show that the fluid-filled bladder 44 is exposed at the medial and lateral sides 30, 32 so that the fluid-filled bladder 44 can also expand laterally outward when under compression. As best shown in FIGS. 1-3, the tapered posterior portion 54 (e.g., medial and lateral rails 54A, 54B), the medial-side trailing arm 88A and the lateral-side trailing arm 88B are exposed in the midfoot region 22 of the sole structure 12. For example, at least portions of these components where they cross one another are exposed and visible from a medial side view (see FIG. 1), from a lateral side view (see FIG. 2), and/or from a bottom view (see FIG. 3) of the sole structure 12.

Figure 19:
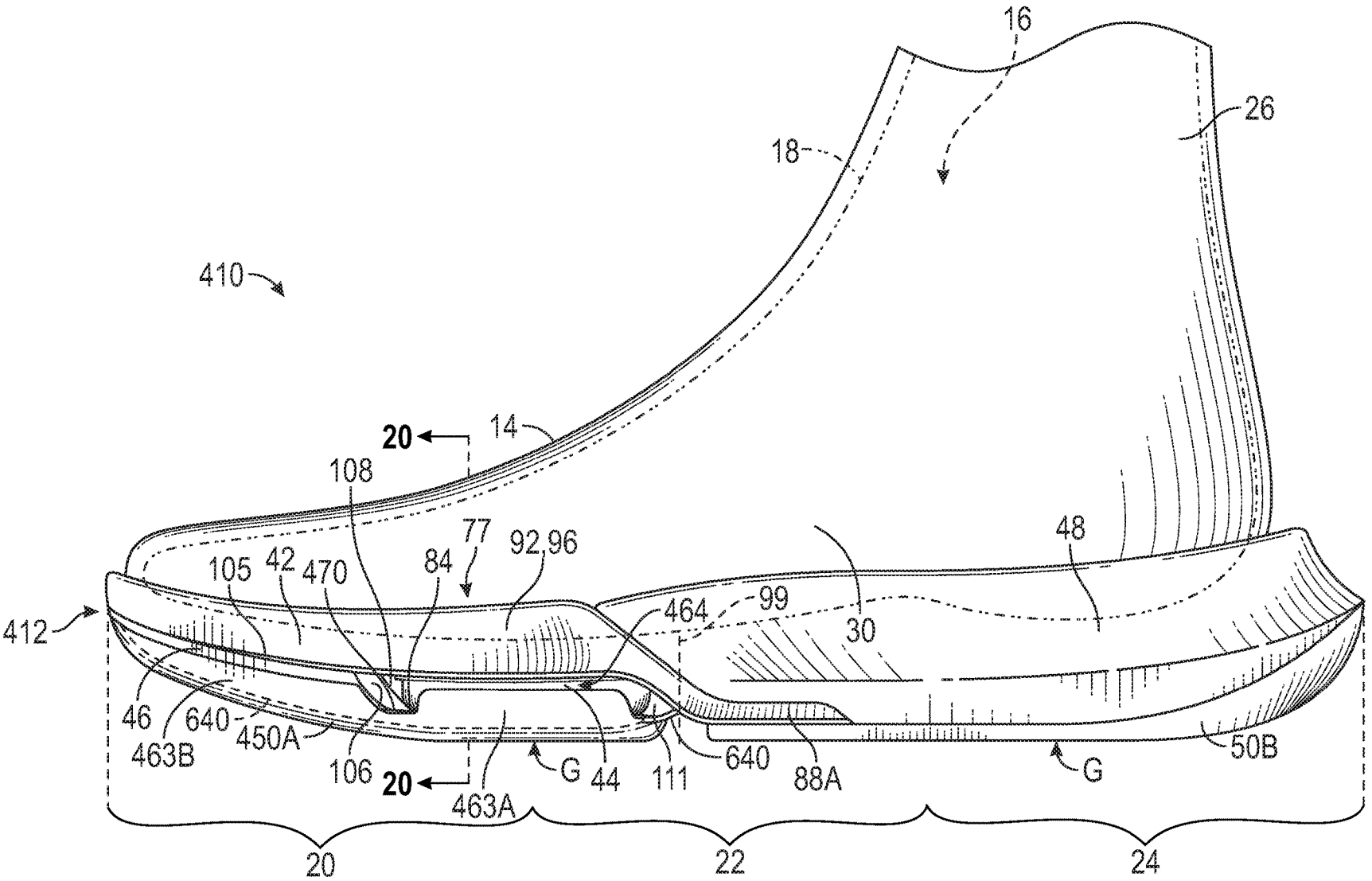
FIG. 19 is a medial side view of an article of footwear including a sole structure and an upper secured to the sole structure in an alternative aspect of the disclosure.
Figure 20:
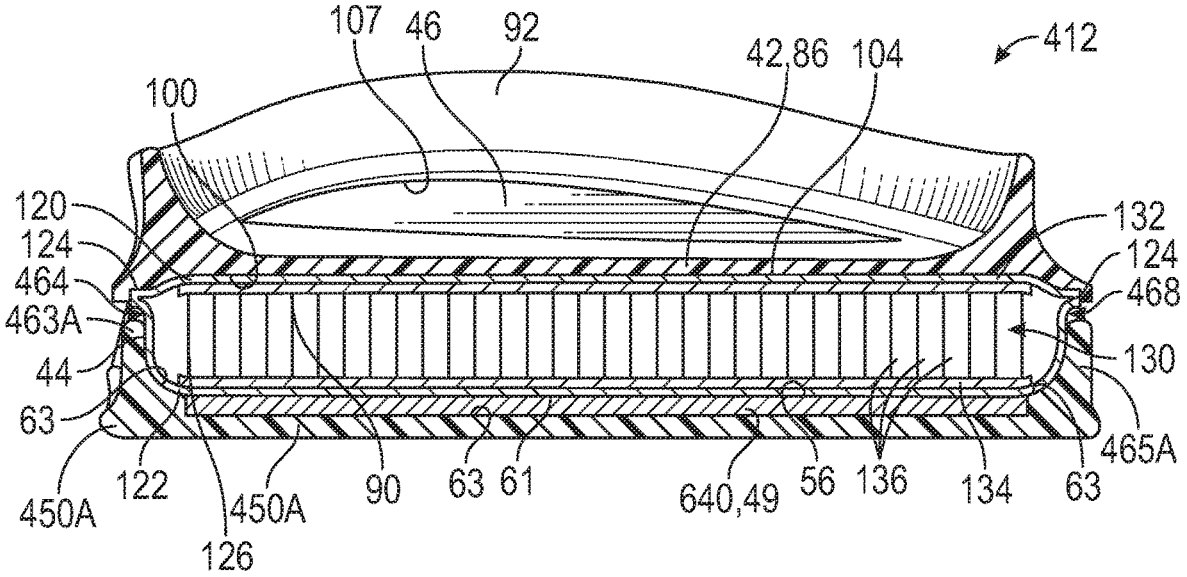
FIG. 20 is a cross-sectional view of the sole structure of FIG. 19 taken at lines 20-20 in FIG. 19.
Figure 21:
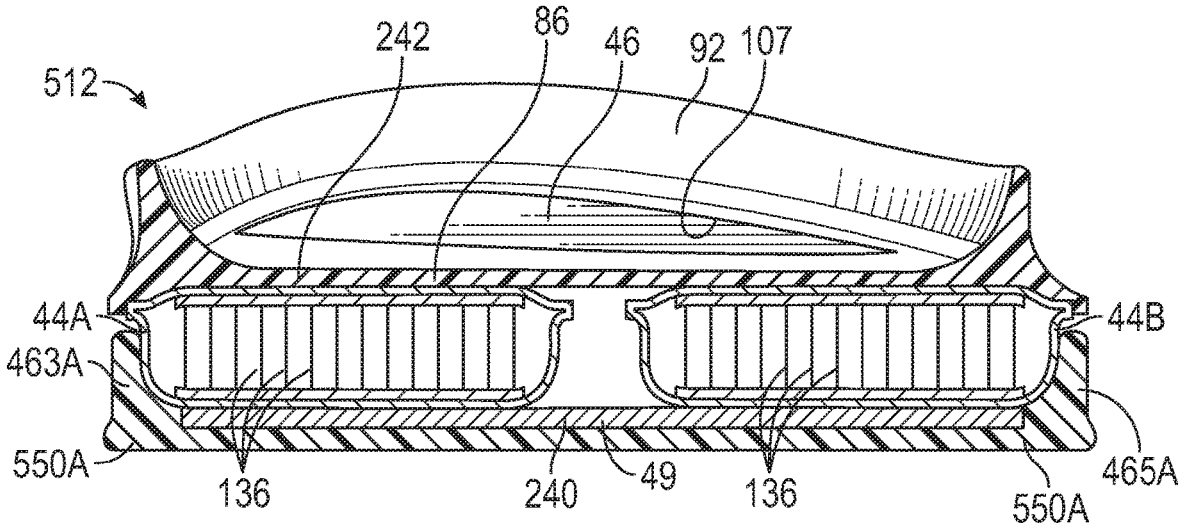
FIG. 21 is a cross-sectional view of an alternative sole structure for the article of footwear of FIG. 19.

FIGS. 19-21 show additional embodiments of articles of footwear and sole structures that are configured and function the same as sole structure 12 except that the forward outsole component is modified to inhibit laterally-outward expansion of the fluid-filled bladder 44 or fluid-filled bladders 44A, 44B. For example, in FIGS. 19 and 20, an article of footwear 410 and sole structure 412 are shown having like components as footwear 10 and sole structure 12, except that the first plate 640 described with respect to FIGS. 22-24 is used (i.e., the first plate 640 does not have a transverse ridge 62 and a transverse groove 64), and the forward outsole component 50A of FIG. 1 is replaced with a forward outsole component 450A in which a medial sidewall 463A and a lateral sidewall 465A of the forward outsole component 450A extend upward onto and are secured to the medial side surface 464 and the lateral side surface 468 of the fluid-filled bladder 44. The forward outsole component 450A also does not have a transverse ridge 51 or transverse groove 53 because the first plate 640 does not have the corresponding transverse ridge 62 and transverse groove 64.

The sidewalls 463A and 465A extend further upward along the side surfaces of the fluid-filled bladder 44 than does outsole component 50A in FIG. 1. As a non-limiting example, the sidewalls 463A, 465A may extend over the lower half of the side surfaces of the fluid-filled bladder 44. This provides greater support for the fluid-filled bladder 44 and reduces its ability to expand transversely (i.e., laterally outward) when under compression. Generally, in a fluid-filled bladder having tethers 136, the portions of the polymeric sheets 120, 122 not secured to the tensile layers 132, 134 more easily expand under compression of the fluid-filled bladder, causing the outer periphery of the fluid-filled bladder 44 to bulge outward (i.e., laterally outward, forward, and rearward, when under compression from above and below). Additionally, the larger sidewalls 463A and 465A may provide greater surface area for bonding of the forward outsole component 450A to the fluid-filled bladder 44, as well as providing traction when the sole structure 12 is positioned with either of the sidewalls 463A, 465A against a ground surface.

The forward outsole component 450A may further wrap upward and be secured to medial and lateral side surfaces of the forefoot midsole unit 46, as best indicated by a second medial sidewall 463B disposed forward of the first medial sidewall 463A in FIG. 19. A second lateral sidewall (not shown) may be secured to the lateral side surface of the forefoot midsole unit 46. Like sidewalls 463A, 465A, the second medial sidewall 463B and a second lateral sidewall, if one is provided, provide greater surface area for bonding of the forward outsole component 450A to the forefoot midsole unit 46, and provide traction when the sole structure 12 is positioned on either of the second sidewalls. The forward outsole component 450A dips downward and defines a notch 470 between the first medial sidewall 463A and the second medial sidewall 463B, providing flexibility of the forward outsole component 450A.

FIG. 21 shows another example of a sole structure 512 that is configured and functions the same as sole structure 12 except that the outsole component 50A is replaced with an outsole component 550A to accommodate the two side-by-side fluid-filled bladders 44A, 44B. The same sidewalls 463A, 465A, 463B and an additional sidewall on the lateral side of the forefoot midsole unit 46, as described with respect to the sole structure 412, are used. Together, the sidewalls 463A and 465A stabilize and inhibit transverse (i.e., laterally outward) expansion of the fluid-filled bladders 44A, 44B when under compression.

Figure 27:
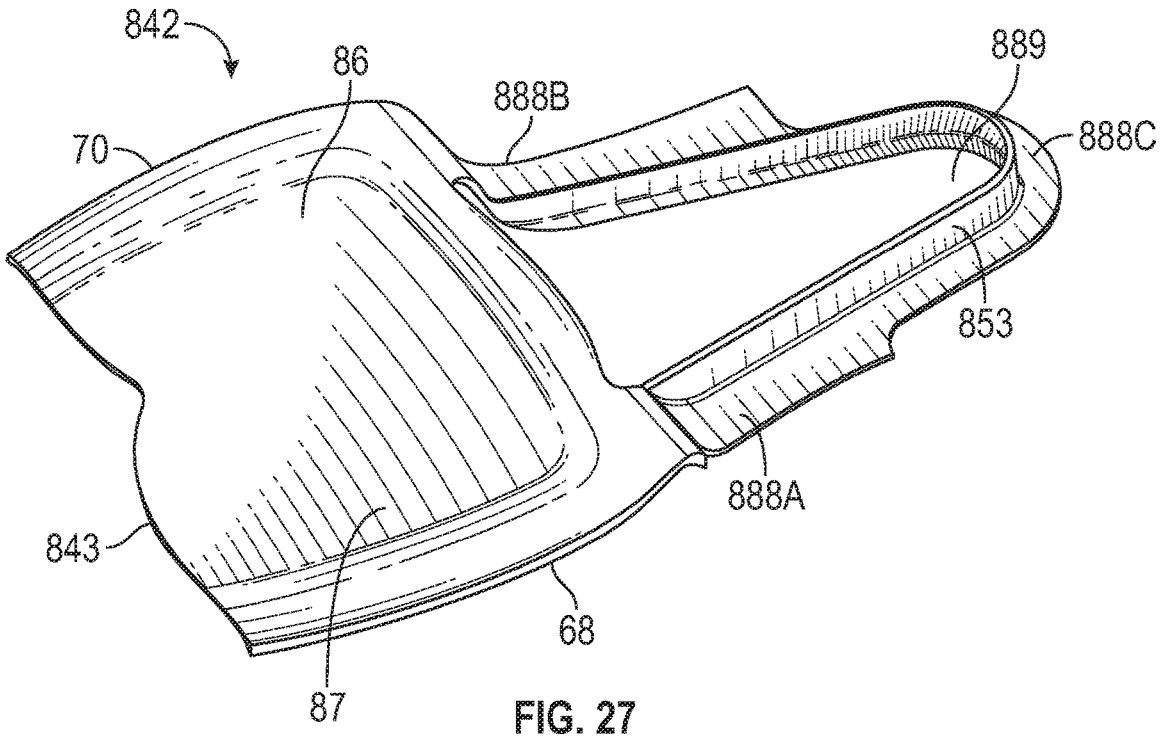
FIG. 27 is a top perspective view of a second plate in an alternative aspect of the disclosure.
Figure 28:
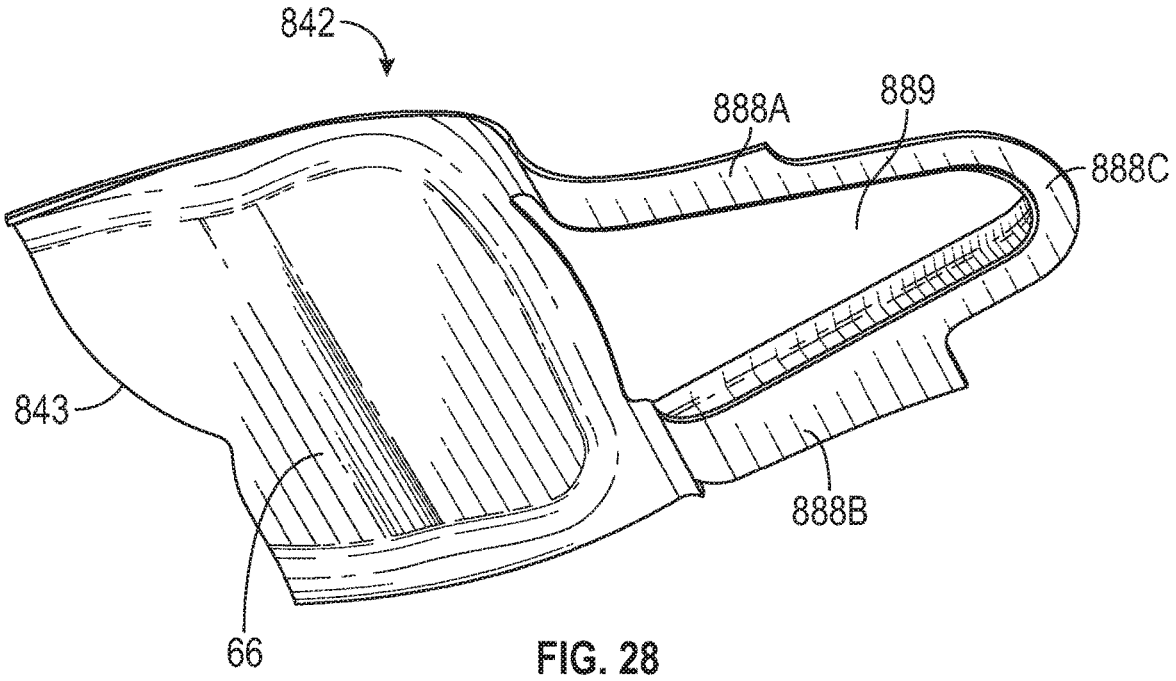
FIG. 28 is a bottom perspective view of the second plate of FIG. 27.
Figure 29:
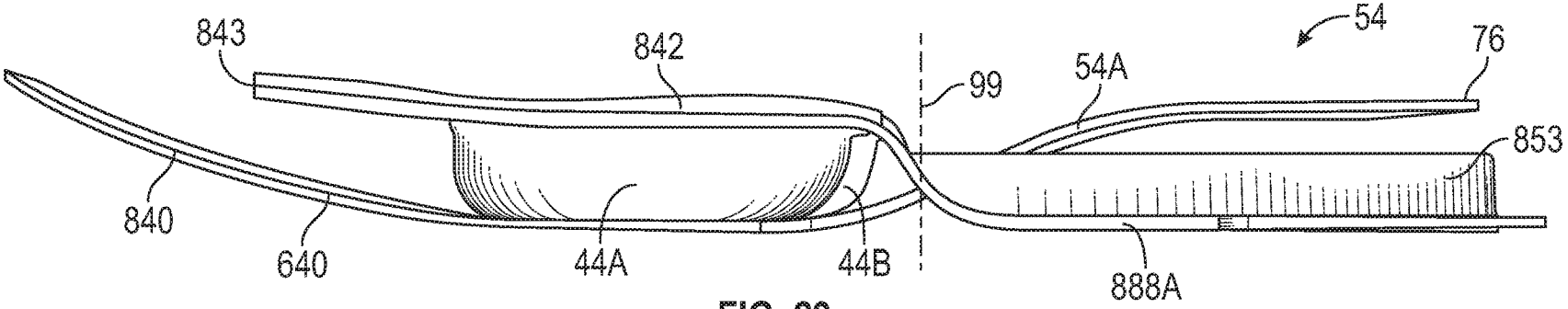
FIG. 29 is a medial side view of first plate of FIG. 23, the second plate of FIG. 27, and the fluid-filled bladders of FIG. 21, with midsole units and outsole components not shown.
Figure 31:
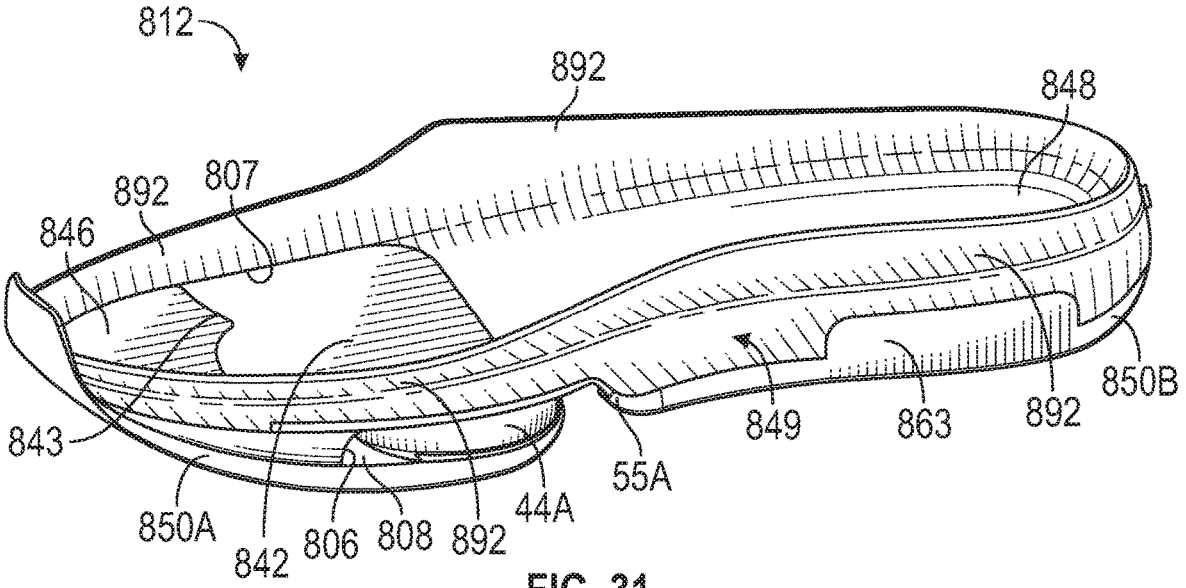
FIG. 31 is a schematic perspective view of a sole structure with the plates and fluid-filled bladders of FIG. 29 and with midsole units and outsole components.

Referring to FIGS. 27 and 28, an alternative embodiment of a second plate 842 includes many of the features of the second plate 42. The second plate 842 ends at a forward edge 843 that is rearward of the forwardmost edge of a forefoot midsole unit 846 when assembled in a sole structure 812 in FIG. 31. Stated differently, the forefoot midsole unit 846 extends forward of a forwardmost edge 843 of the second plate 842. The second plate 842 does not have a through hole above the forefoot midsole unit 846 like that of the second plate 42. Additionally, the second plate 842 does not have an upwardly-extending peripheral wall like that of the second plate 42. Instead of second plate 842 providing a through hole and a peripheral wall, an alternative embodiment of a rear midsole unit 848 has a peripheral wall 892 and defines a through hole 807. When the second plate 842, the fluid-filled bladders 44A, 44B, the first plate 840, the forefoot midsole unit 846, and the rear midsole unit 848 are assembled with forward and rear outsole components 850A, 850B in the sole structure 812 of FIGS. 31-32, the peripheral wall 892 extends forward of the fluid-filled bladders 44A, 44B (only bladder 44A visible in FIG. 31), and upward and away from the second plate 842. The peripheral wall 892 extends around the entire rear midsole unit 848. The through hole 807 extends at least partially over the fluid-filled bladder 44A and partially over the forefoot midsole unit 846. The second plate 842 extends rearward of the terminal end 76 of the tapered posterior portion 54 of the first plate 840, as best shown in FIG. 29. The rear midsole unit 848 overlays and is secured to a rear portion of a proximal side of the second plate 842 over the fluid-filled bladders 44A, 44B, as shown in FIG. 31.

Figure 38:
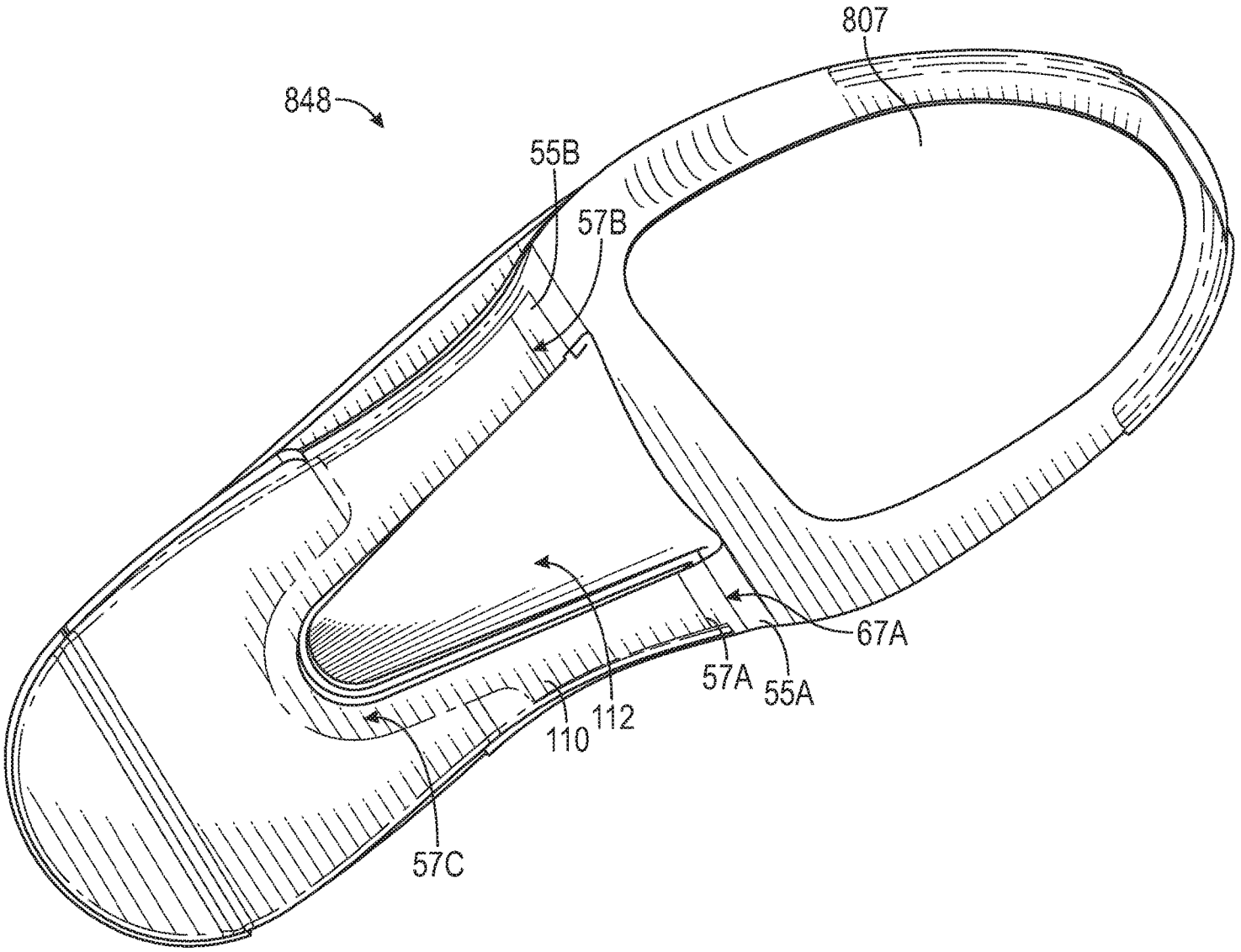
FIG. 38 is a bottom perspective view of a rear midsole unit for the sole structure of FIG. 36.
Figure 39:
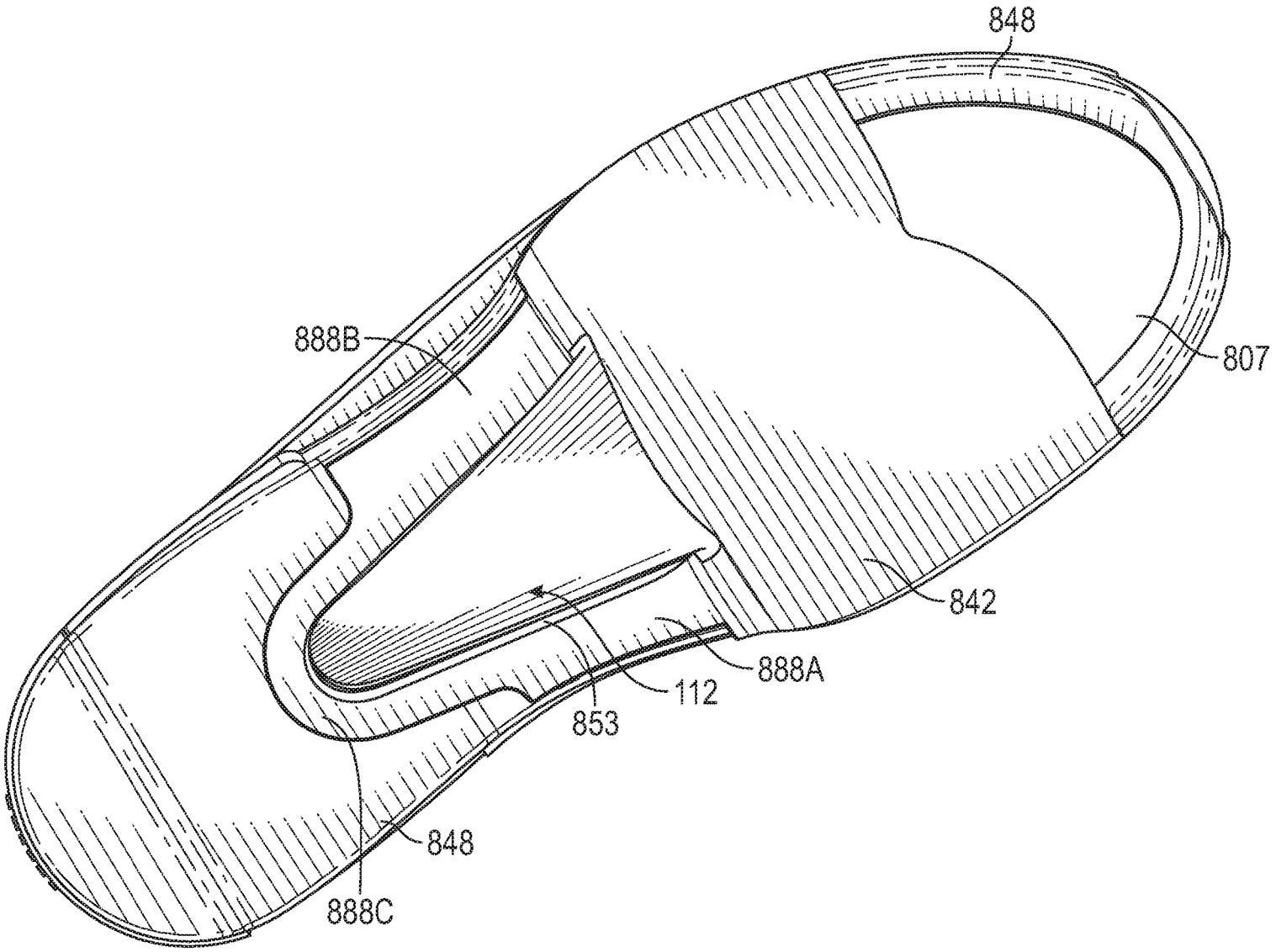
FIG. 39 is a bottom perspective view of the rear midsole unit of FIG. 38 and the second plate of FIG. 27.

Like the second plate 42, the second plate 842 has a medial-side trailing arm 888A and a lateral-side trailing arm 888B that are configured like the medial-side trailing arm 88A and the lateral-side trailing arm 88B, respectively, except that the medial-side trailing arm 888A and the lateral-side trailing arm 888B converge at a rear 888C of the second plate 842 as shown in FIGS. 27-28. The second plate 842 thus defines an opening 889 rearward of the fluid-filled bladders 44A, 44B and bounded by the medial-side trailing arm 888A and the lateral-side trailing arm 888B. As shown in FIG. 38, the rear midsole unit 848 has a medial shoulder 55A and a lateral shoulder 55B are configured to interface flush with and are secured to the medial-side trailing arm 888A and the lateral-side trailing arm 888B, respectively. In fact, the medial shoulder 55A has a recess 57A and the lateral shoulder 55B has a recess 57B in which the trailing arms 888A, 888B are respectively nested. The recesses 57A, 57B continue and are joined at a rear recessed section 57C in which the rear 888C of the second plate 842 is nested.

Figure 30:
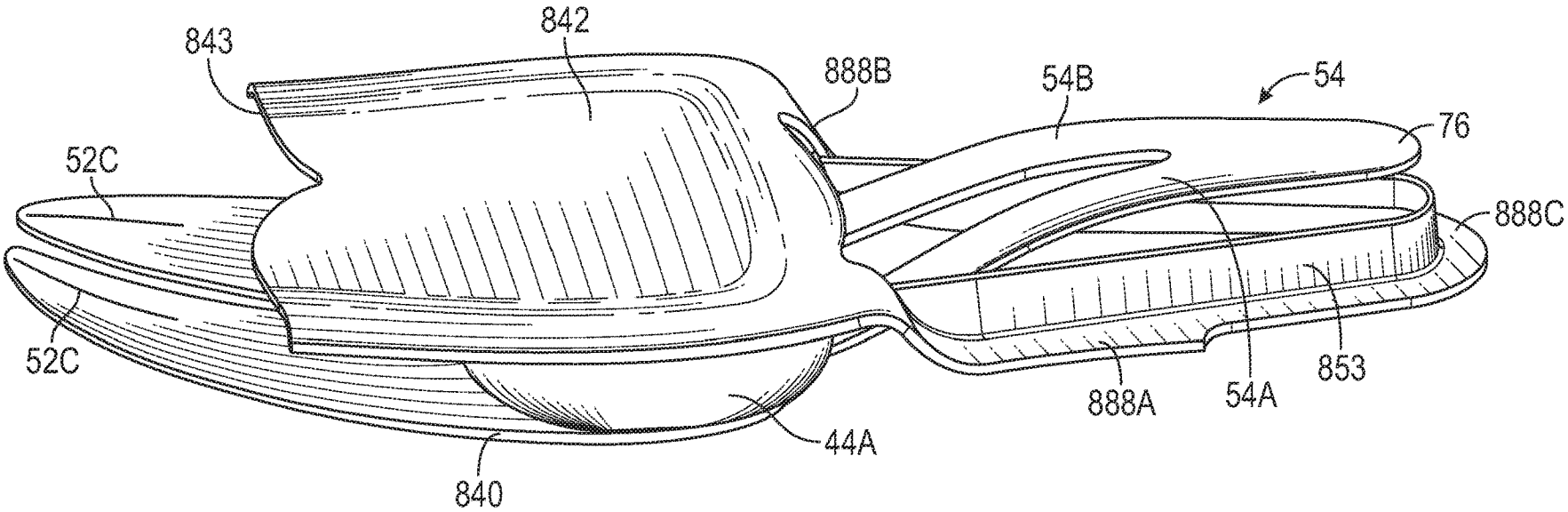
FIG. 30 is a schematic perspective view of the plates and fluid-filled bladders of FIG. 29.

As best shown in FIGS. 27, 29 and 30, the second plate 842 has a continuous wall 853 extending upward from the medial-side trailing arm 888A and the lateral-side trailing arm 888B and around the rear 888C. FIG. 38 shows that the rear midsole unit 848 has a distal side 110 with a recess 112 between the medial shoulder 55A and the lateral shoulder 55B, like that of the rear midsole unit 48. The continuous wall 853 extends upward from the medial-side trailing arm 888A and the lateral-side trailing arm 888B into the recess 112 and interfaces flush with the rear midsole unit 848 in the recess 112. Additionally, the tapered posterior portion 54 of the first plate 840 is seated against and secured to the rear midsole unit 848 in the recess 112, as best shown in FIG. 32.

Figure 35:
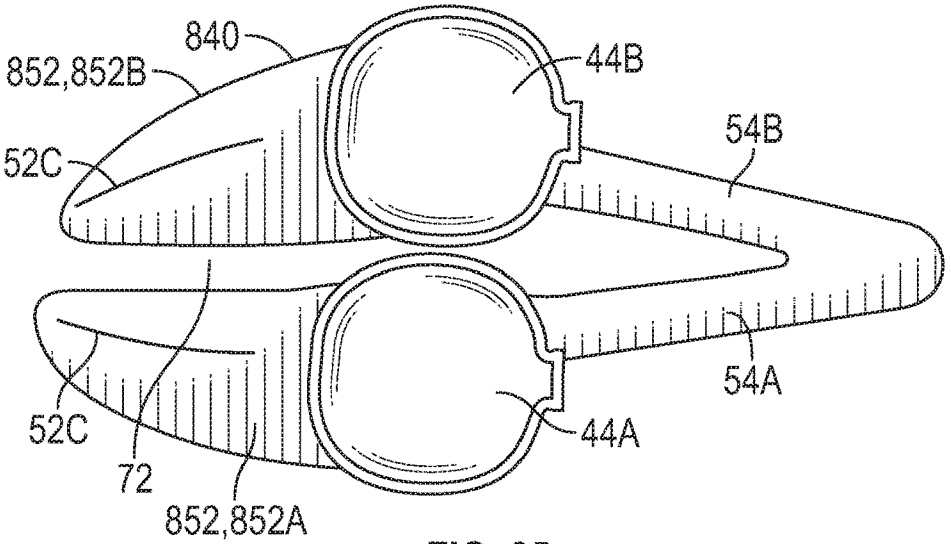
FIG. 35 is a top view of the first plate of FIG. 33 with the fluid-filled bladders of FIG. 21.

As shown in FIG. 35, the first fluid-filled bladder 44A is disposed on a medial projection 852A of the bifurcated portion 852 of the first plate 840, and the second fluid-filled bladder 44B is disposed on a lateral projection 852B of the bifurcated portion, and the slot 72 extends between and below the fluid-filled bladders 44A, 44B.

Figure 36:
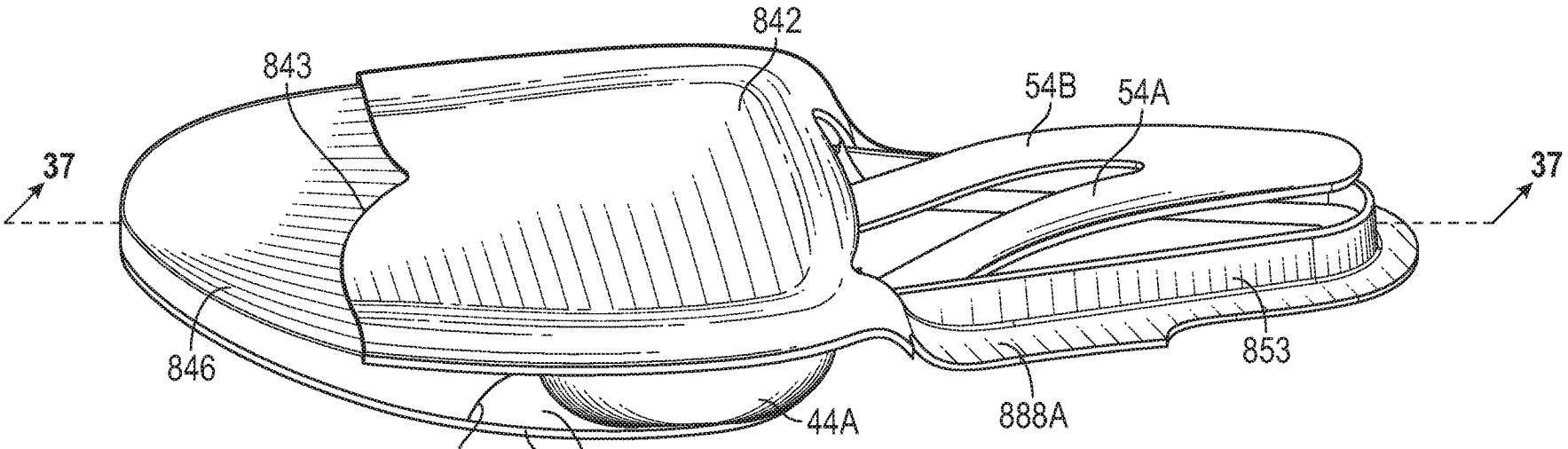
FIG. 36 is a schematic illustration of a sole structure with the first plate and fluid-filled bladders of FIG. 35, the second plate of FIG. 27 and a front midsole unit, and with a rear midsole unit and outsole components not shown.
Figure 37:
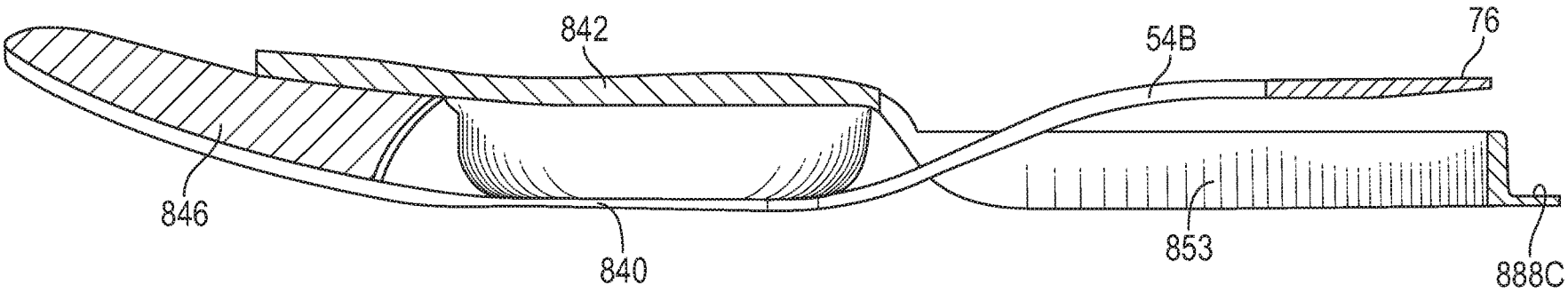
FIG. 37 is a cross-sectional view of the sole structure of FIG. 36 taken at lines 37-37 in FIG. 36.

As shown in FIGS. 31 and 36, a rear extent 806 of the forefoot midsole unit 846 slopes upwardly and toward from the fluid-filled bladders 44A, 44B from the first plate 840 to the second plate 842, with a gap 808 between the rear extent 806 and the bladders 44A, 44B when not under impact loading.

Figure 32:
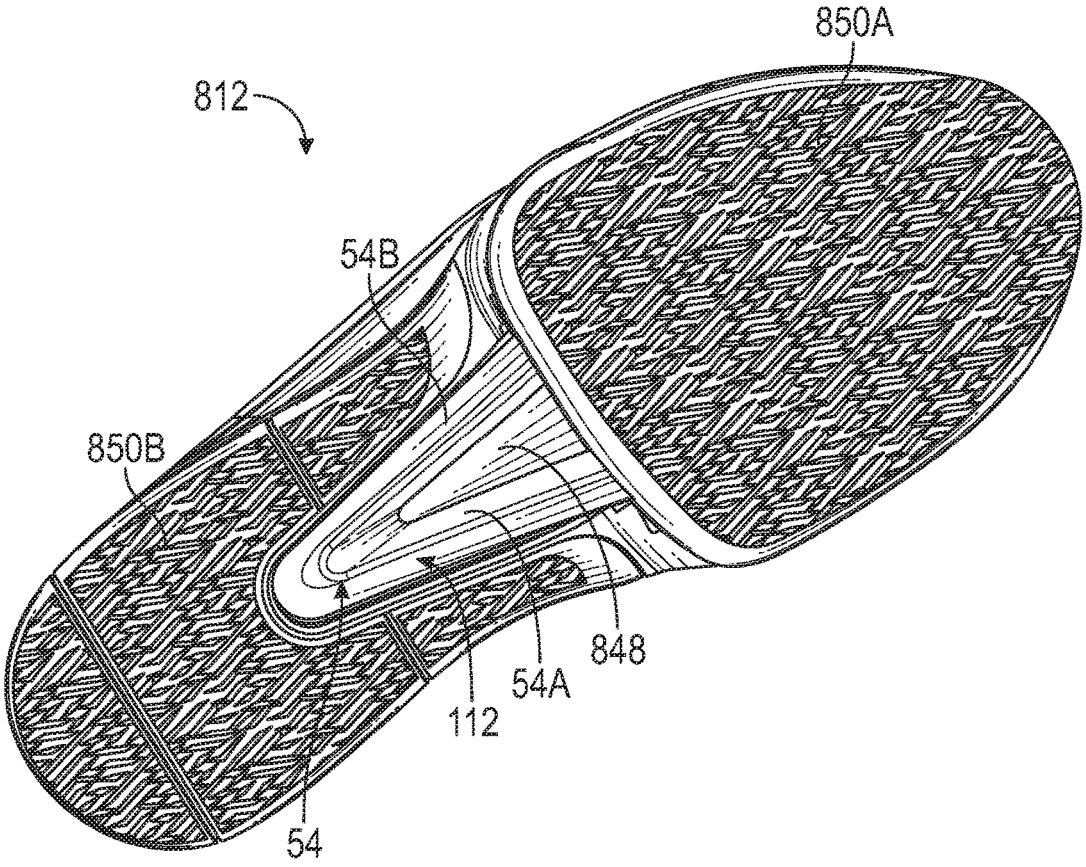
FIG. 32 is a bottom perspective view of the sole structure of FIG. 31.

FIG. 32 shows that the outsole components 850A and 850B are secured to a distal side of the rear midsole unit 848. The outsole component 850B has a first medial sidewall 863 that extends upward onto and is secured to a medial side surface 849 of the rear midsole unit 848, creating a greater surface area for bonding of the rear outsole component 850B to the rear midsole unit 848, as well as providing traction when the sole structure 812 is positioned with the sidewall 863 against a ground surface. The outsole component 850B may have a similar sidewall extending on the lateral side of the rear midsole unit 848.

Figure 40:
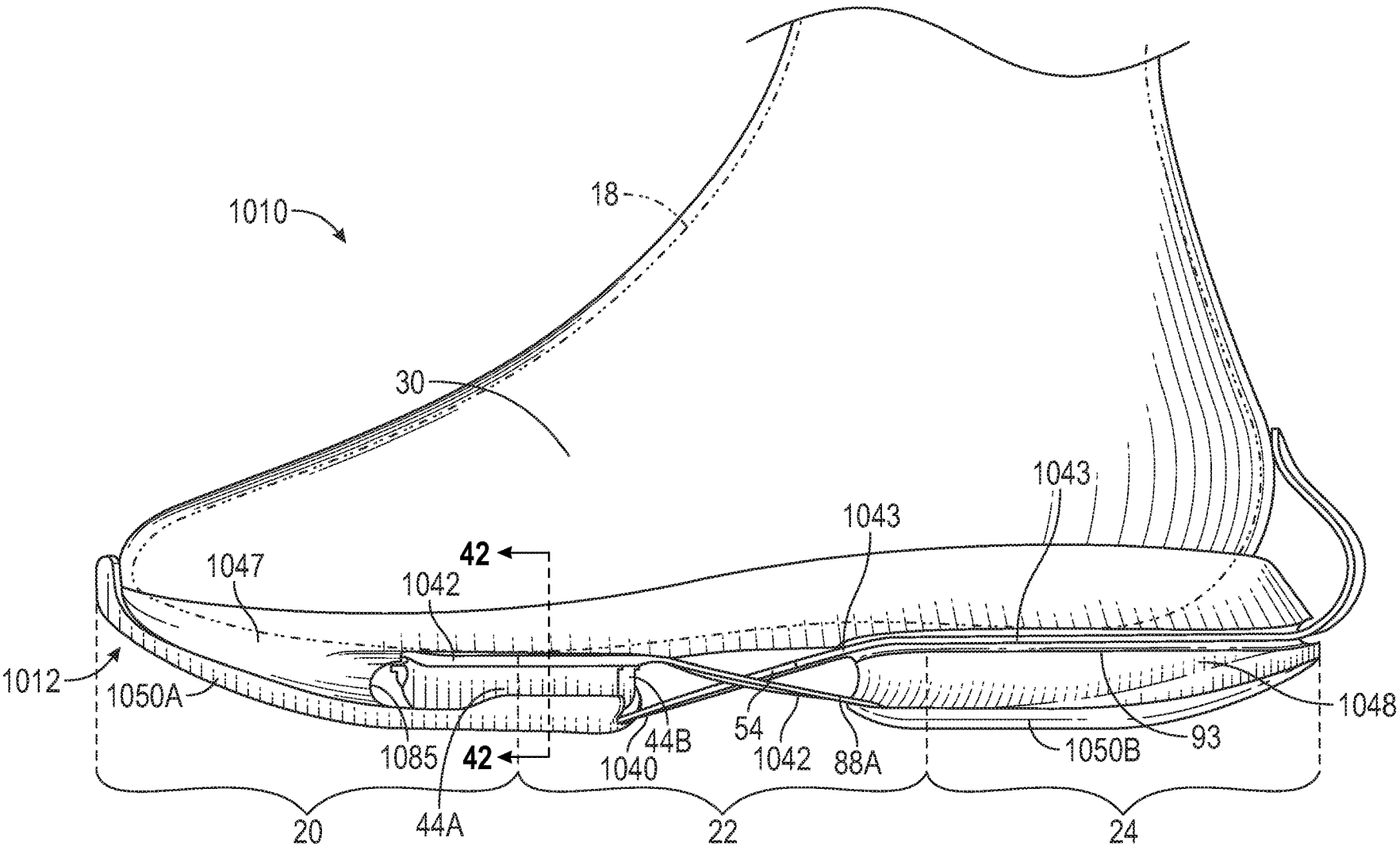
FIG. 40 is a medial side view of an article of footwear including a sole structure and an upper secured to the sole structure in an alternative aspect of the disclosure.
Figure 41:
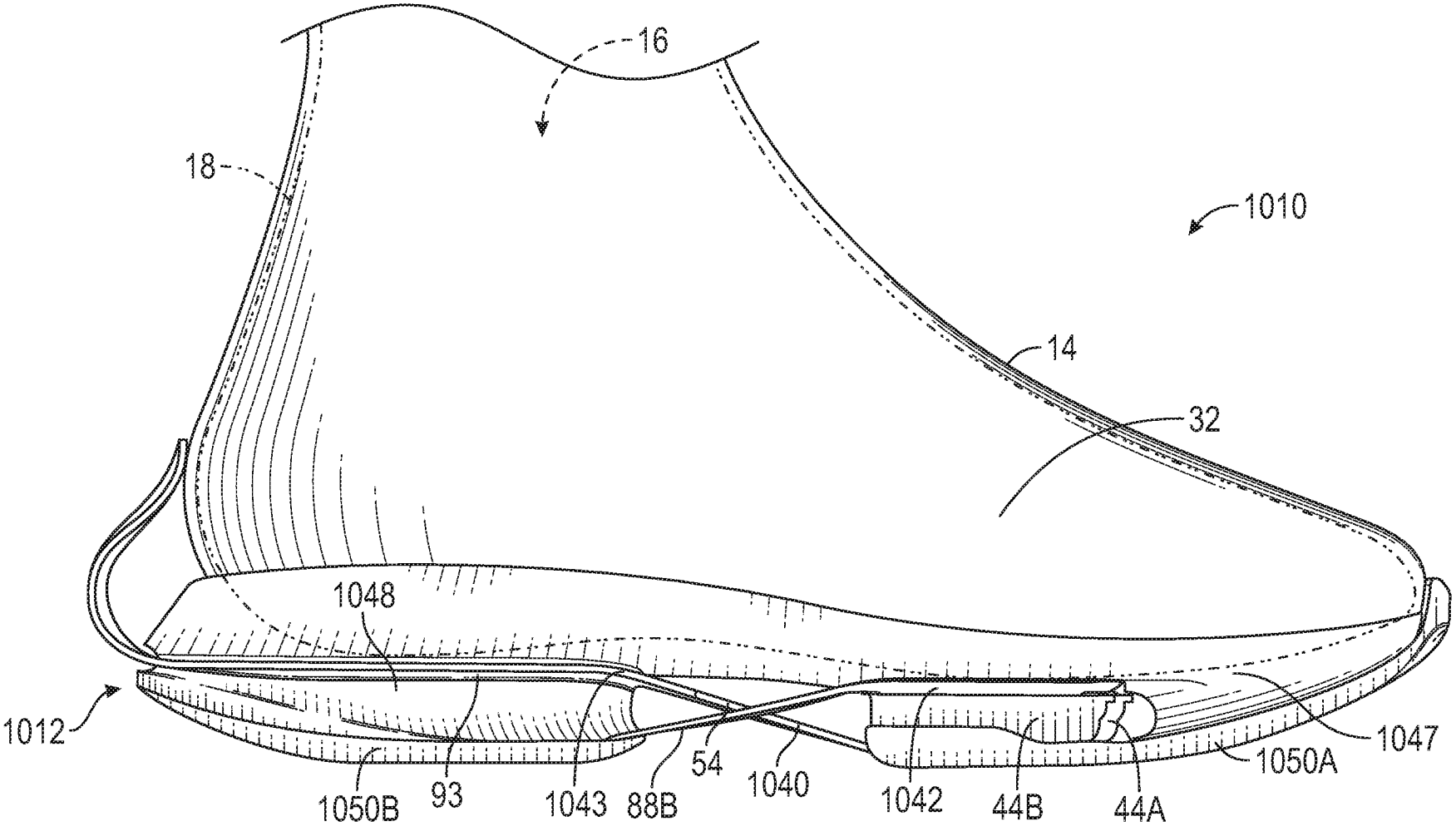
FIG. 41 is a lateral side view of the article of footwear of FIG. 40.

FIGS. 40 and 41 show an article of footwear 1010 with another embodiment of a sole structure 1012 within the scope of the present teachings. The sole structure 1012 has many of the same components as sole structure 12, which are referred to with like reference numbers. The sole structure 1012 includes a first plate 1040, a second plate 1042, and a third plate 1043, each of which is partially visible in FIG. 40. The sole structure 1012 also includes the first and second fluid-filled bladders 44A, 44B disposed between the first and second plates 1040, 1042. In addition to the plates 1040, 1042, 1043 and the fluid-filled bladders 44A, 44B, the sole structure 1012 includes a full-length midsole unit 1047, a rear midsole unit 1048 rearward of the fluid-filled bladders 44A, 44B, and outsole components 1050A, 1050B that establish a ground-contact surface G of the sole structure 1012. Each of the components of the sole structure 1012 is discussed in greater detail with respect to the several figures in which they appear.

Figure 44:
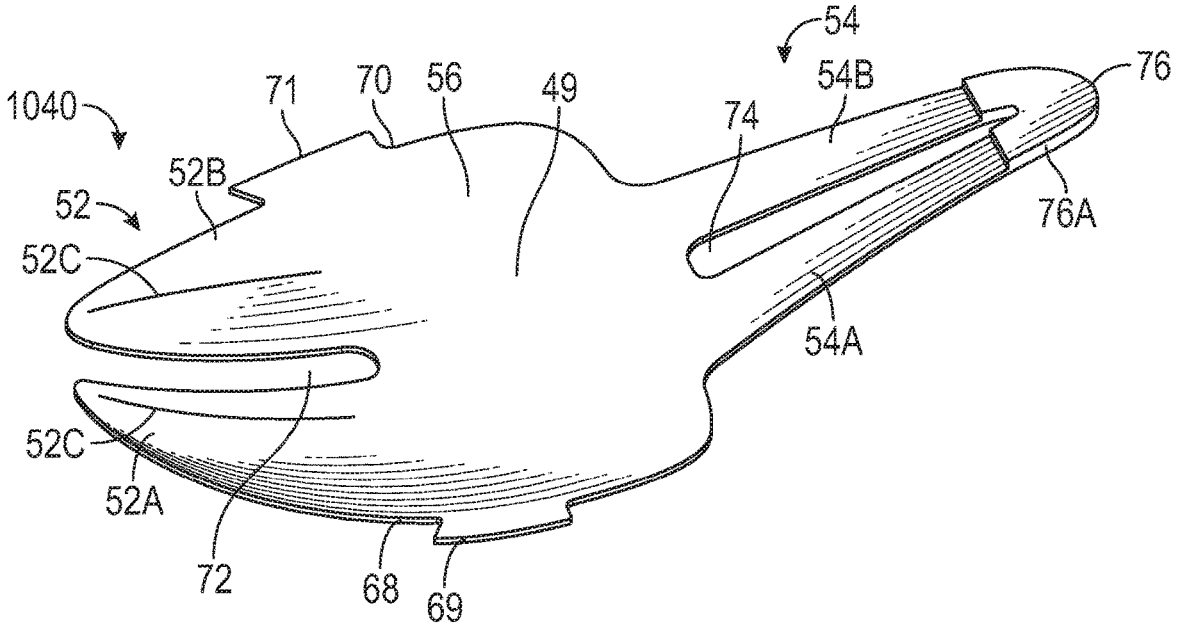
FIG. 44 is a top perspective view of the first plate of the sole structure of FIG. 40.
Figure 45:
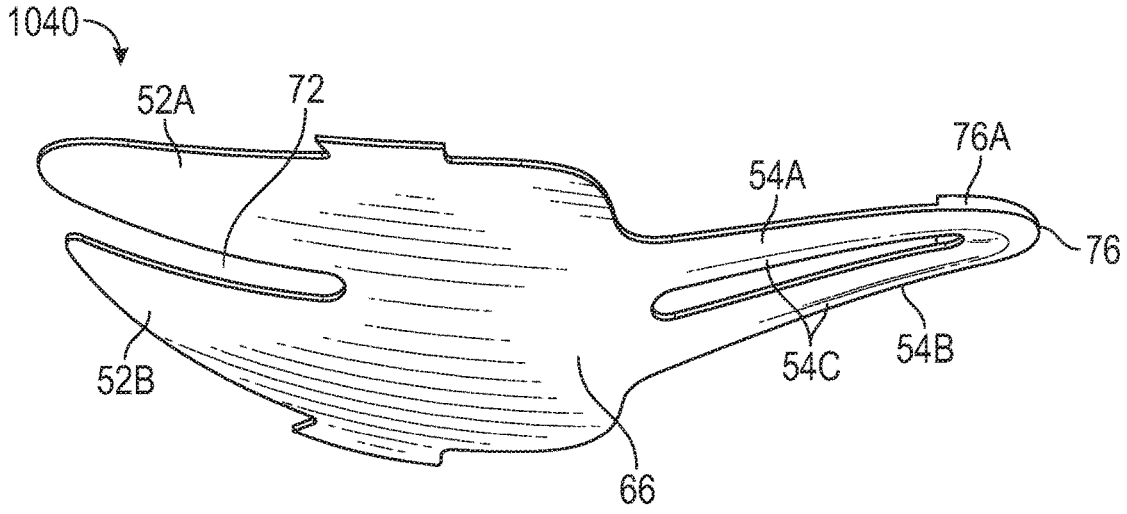
FIG. 45 is a bottom perspective view of the first plate of the sole structure of FIG. 40.

The first plate 1040 is shown in isolation in FIGS. 44 and 45. Similar to first plate 40, the first plate 1040 is a relatively rigid material. For example, in one or more embodiments, the first plate 1040 may be any of the materials described with respect to first plate 40, including a carbon fiber, a carbon fiber composite (such as a carbon fiber-filled nylon), a fiberglass-reinforced nylon, which may be an injected, fiber-reinforced nylon, a fiber strand-lain composite, a thermoplastic elastomer, wood, steel, or another material or combinations of these, but is not limited to these materials. In one non-limiting example, the first plate 1040 may be an injected, fiberglass-reinforced polyamide 11, such as RILSAN® BZM 7 0 TL, available from Arkema Inc. in King of Prussia, Pa. USA. In such an embodiment, the first plate 1040 may have a hardness of approximately 75 on a Shore D durometer scale using an ISO 868 test method, a flexural modulus of approximately 1500 MPa using an ISO 178 test method, and a density of approximately 1.07 grams per cubic centimeters (g/cm$^3$).

Figure 42:
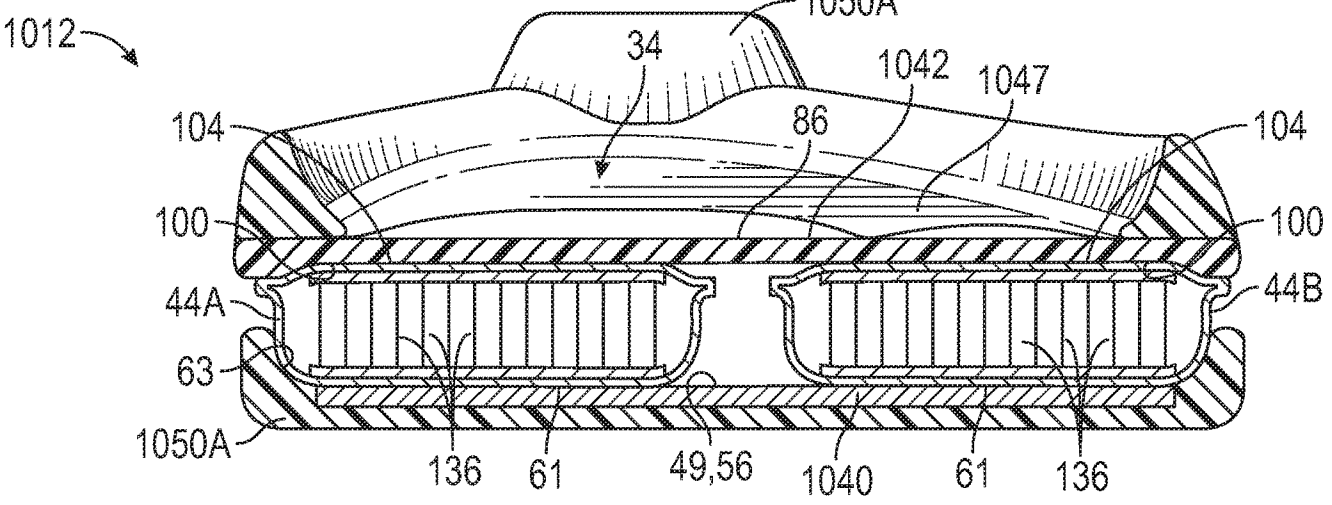
FIG. 42 is a cross-sectional view of the sole structure of FIG. 40 taken at lines 42-42 in FIG. 40.
Figure 43:
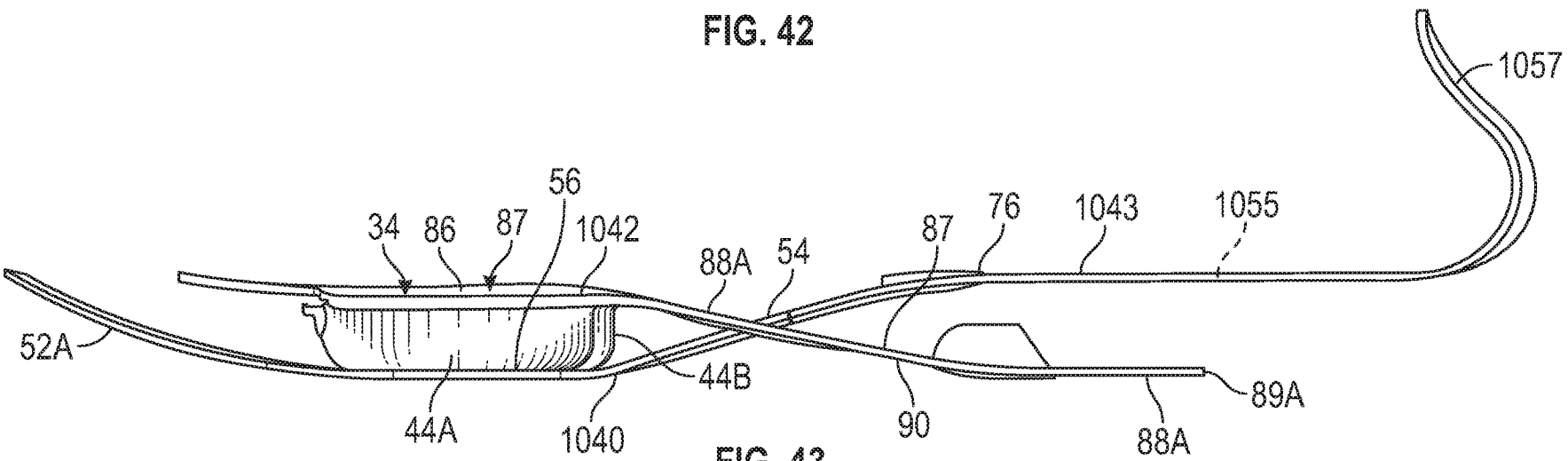
FIG. 43 is a medial side view of first, second, and third plates and fluid-filled bladders of the sole structure of the FIG. 40, with midsole units and outsole components not shown.

Like first plate 40, the first plate 1040 has a central portion 49, a bifurcated portion 52 (also referred to as bifurcated forward portion 52) forward of the central portion 49, and a tapered posterior portion 54 rearward of the central portion 49. The first plate 1040 includes a medial flange 69 at a medial side edge 68 of the first plate 1040, and a lateral flange 71 at a lateral side edge 70 of the first plate 1040. When the first plate 1040 and the fluid-filled bladders 44A, 44B are assembled in the sole structure 1012, the distal sides 61 of the fluid-filled bladders 44A, 44B are seated on the proximal side 56 of the first plate 1040 with the bifurcated portion forward of the fluid-filled bladders 44A, 44B, as best shown in FIG. 43, and the fluid-filled bladders 44A, 44B forward of the tapered posterior portion 54. The proximal side 56 may include a recess similar to recess 58 in which the fluid-filled bladders 44A, 44B are seated. The fluid-filled bladders 44A, 44B extend onto the outsole component 1050A as shown in FIG. 42. The outsole component 1050A also forms a recess 63 that receives and supports the first plate 1040 as well as the medial and lateral extremities of the fluid-filled bladders 44A, 44B, respectively.

Referring to FIGS. 44 and 45, the bifurcated portion 52 of the first plate 1040 includes a medial projection 52A and a lateral projection 52B separated from one another by a slot 72, and each having a respective longitudinally-extending ridge 52C extending upward on the proximal side 56 of the first plate 1040. As described with respect to the plate 1040, the bifurcated portion 52 provides greater medial-lateral flexibility in the forefoot region 20 of the sole structure 1012 than would a plate of like thickness and material but having a continuous, unslotted forward portion, and the ridges 52C strengthen the projections 52A, 52B in comparison to a configuration in which the projections 52A, 52B do not have ridges 52C, and increase the longitudinal bending stiffness of the projections 52A, 52B.

Like first plate 40, the tapered posterior portion 54 of the first plate 1040 includes a medial rail 54A and a lateral rail 54B that are separated from one another by an elongated aperture 74 that begins just rearward of the central portion 49 and ends forward of a terminal end 76 of the tapered posterior portion 54, so that the medial rail 54A and the lateral rail 54B converge just rearward of the aperture 74. As best shown in FIG. 45, the medial rail 54A and the lateral rail 54B each have a respective longitudinally-extending ridge 54C extending downward on the distal side 66 of the first plate 40 to strengthen the rails 54A, 54B and increase their longitudinal bending stiffness in comparison to a configuration in which the rails 54A, 54B do not have ridges 54C.

As best shown in FIG. 43, the first plate 1040 is generally spoon-shaped (i.e., in profile in the longitudinal direction) in the unstressed state to which the first plate 1040 is biased. The terminal end 76 of the first plate 1040 is not as far rearward as is terminal end of first plate 1040, however. The third plate 1043 described herein fits to the first plate 1040 at the terminal end 76 and extends rearward from the first plate 1040 to continue the spoon shape. As described with respect to first plate 40, bending of the first plate 1040 in the longitudinal direction during dorsiflexion will store, as potential energy, at least some of the energy input by the wearer to bend the first plate 1040. The potential energy is then released when the sole structure 1012 pushes away from the ground in a propulsive phase of the gait cycle just prior to toe off, with the first plate 1040 unbending at toe-off to its unstressed, spoon shape at least partially in the direction of forward motion.

Figure 50:
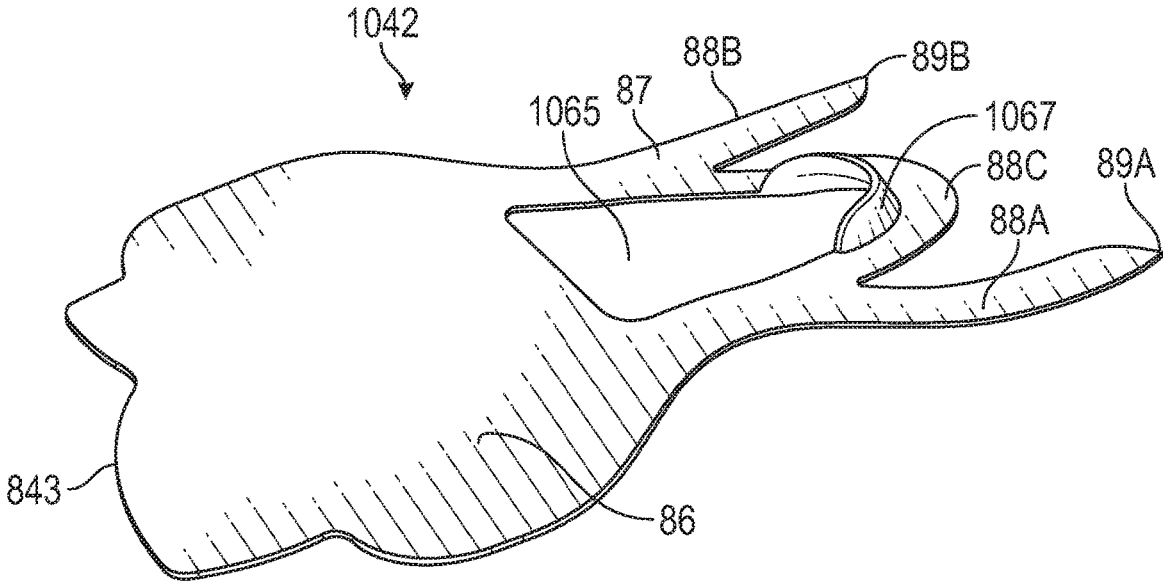
FIG. 50 is a top perspective view of the second plate of the sole structure of FIG. 40.
Figure 51:
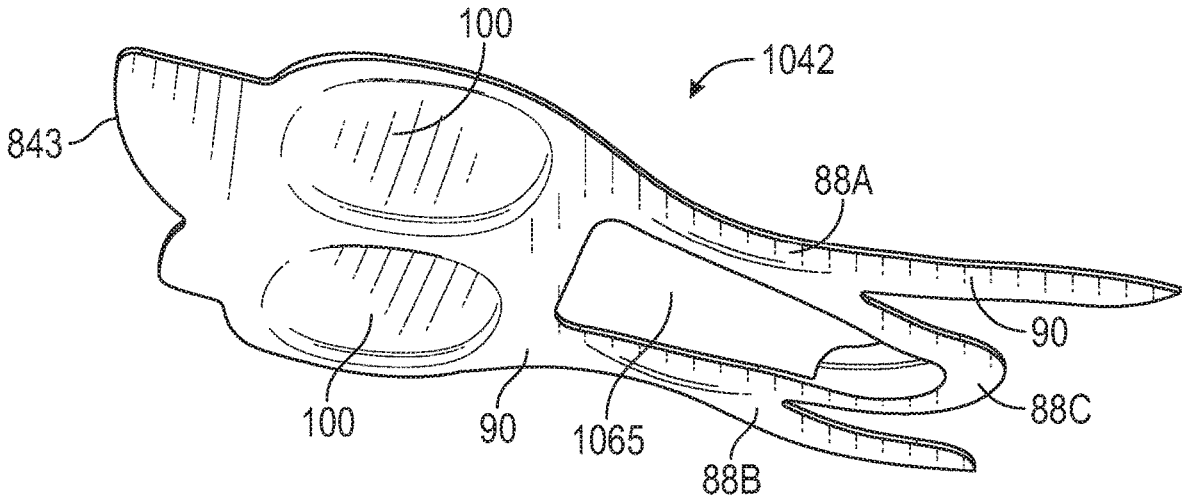
FIG. 51 is a bottom perspective view of the second plate of the sole structure of FIG. 40.

The second plate 1042 is shown in isolation in FIGS. 50 and 51. The second plate 1042 has a medial-side trailing arm 88A and a lateral-side trailing arm 88B, and is supported on a proximal side of the fluid-filled bladders 44A, 44B, with the fluid-filled bladders forward of the medial-side trailing arm 88A and the lateral-side trailing arm 88B, as best shown in FIG. 43.

The second plate 1042 has a central portion 86, a medial-side trailing arm 88A, and a lateral-side trailing arm 88B. As described with respect to the second plate 42, both the medial-side trailing arm 88A and the lateral-side trailing arm 88B are rearward of the central portion 86, and therefore "trail" the central portion 86 in the longitudinal direction of the sole structure 1012. The trailing arms 88A, 88B slope downward and away from the central portion 86 in a rearward direction. The trailing arms 88A, 88B are concave at a proximal side 87 of the second plate 1042, as shown in FIGS. 43 and 50, and are convex at a distal side 90 of the second plate 1042, as shown in FIGS. 43 and 51.

The second plate 1042 defines a through hole 1065 rearward of the central portion 86 between the medial-side trailing arm 88A and the lateral-side trailing arm 88B. The second plate 1042 also includes a wall 1067 extending upward around a rear of the through hole 1065.

As shown in FIG. 51, the distal side 90 of the second plate 1042 may define a pair of slight recesses 100 at the central portion 86. When the second plate 1042 and the fluid-filled bladders 44A, 44B are assembled in the sole structure 1012, the proximal sides 104 of the fluid-filled bladders 44A, 44B are seated on the distal side 90 of the second plate 1042 in the recesses 100, so that the fluid-filled bladders 44A, 44B are nested in the recesses 100, as best shown in FIG. 42. When the sole structure 1012 is secured to the upper 14, the foot 18 is supported on the foot-facing surface 34 (shown in FIGS. 42 and 43) on the proximal side 87 of the central portion 86.

The first plate 1040 may be any of the materials described with respect to plate 40, and the second plate 1042 may be any of the materials described with respect to plate 42. The first plate 1040 may be more rigid than the second plate 1042.

Figure 46:
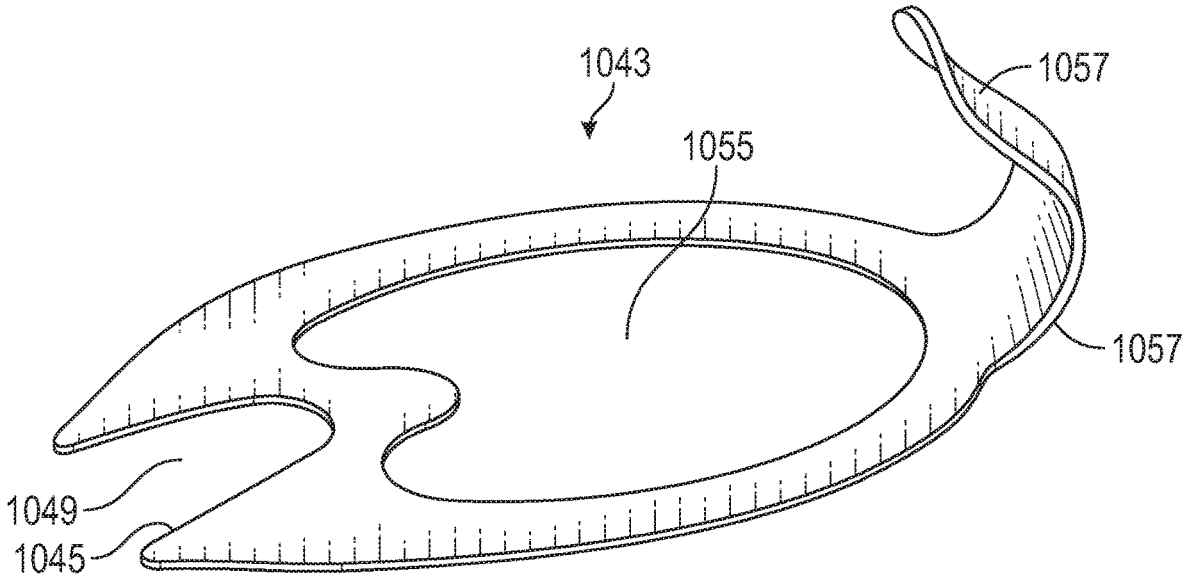
FIG. 46 is a top perspective view of the third plate of the sole structure of FIG. 40.
Figure 47:
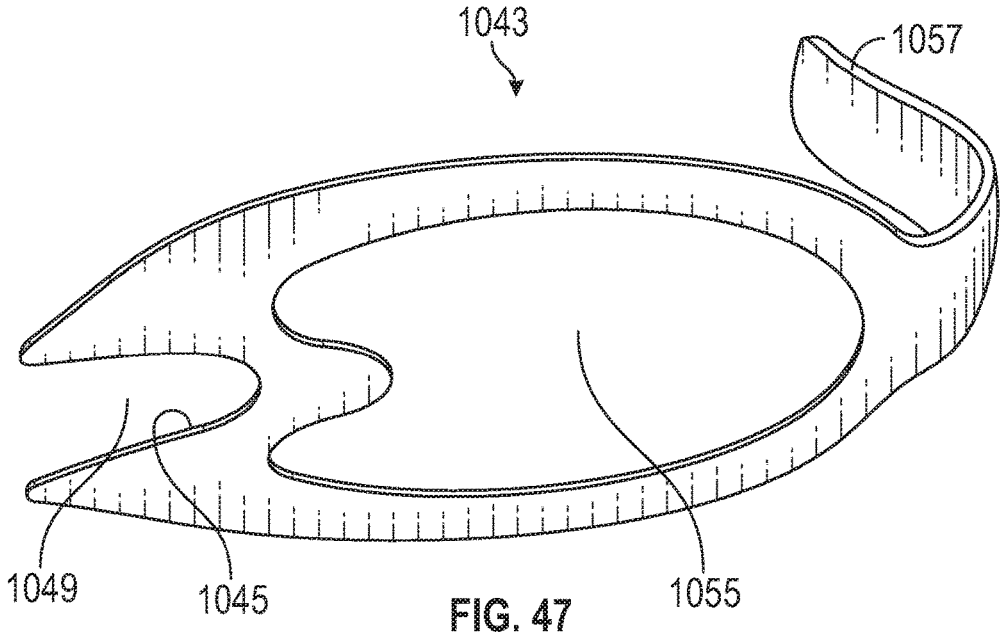
FIG. 47 is a bottom perspective view of the third plate of the sole structure of FIG. 40.
Figure 48:
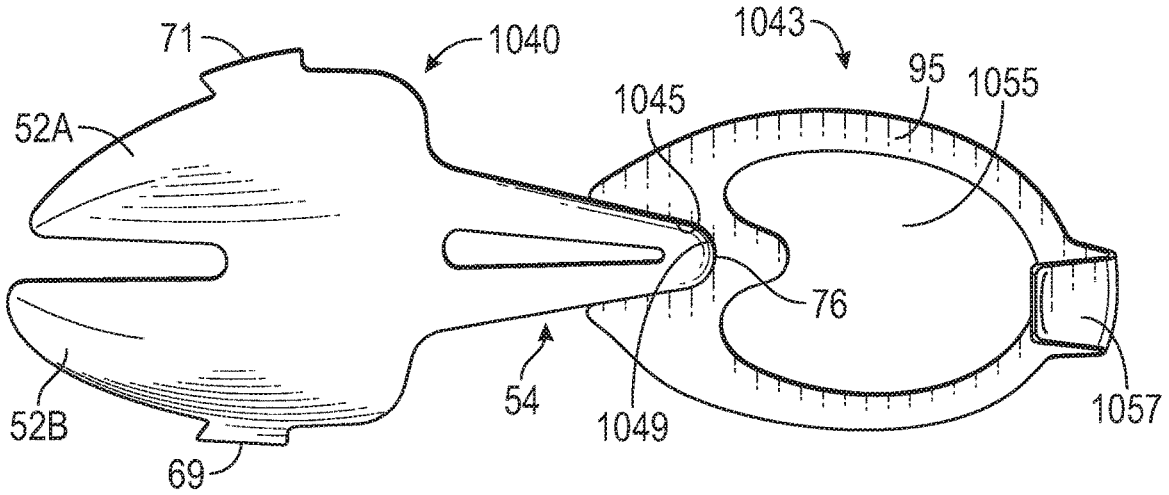
FIG. 48 is a top view of the first and third plates of the sole structure of FIG. 40 interfit with one another.
Figure 49:
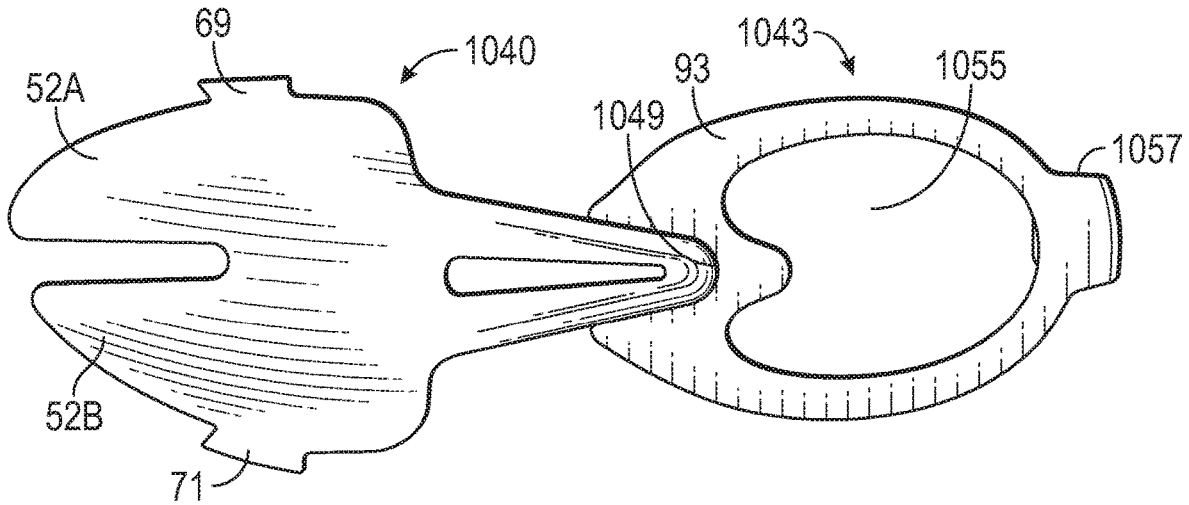
FIG. 49 is a bottom view of the first and third plates of the sole structure of FIG. 40 interfit with one another.

The sole structure 1012 also includes the third plate 1043 shown in isolation in FIGS. 46 and 47. The third plate 1043 has a forward edge 1045 that defines a notch 1049. As shown in FIGS. 48-49, the tapered posterior portion 54 of the first plate 1040 is configured to fit within the notch 1049, with the third plate 1043 extending rearward from the first plate 1040. For example, the tapered posterior portion 54 may be press-fit, thermally bonded, and/or adhered to the third plate 1043 in the notch 1049, with the terminal end 76 against the forward edge 1045, and with the tapered posterior portion 54 completely filling the notch 1049. As shown in FIG. 44, the tapered posterior portion 54 is thickened at the terminal end 76, providing a side surface 76A with increased area for better securement to the third plate 1043. By fitting the first and third plates 1040, 1043 together in this manner, a more complex shape may be achieved than if a single unitary plate is used. Additionally, the first and third plates 1040, 1043 may be of different materials.

Figure 56:
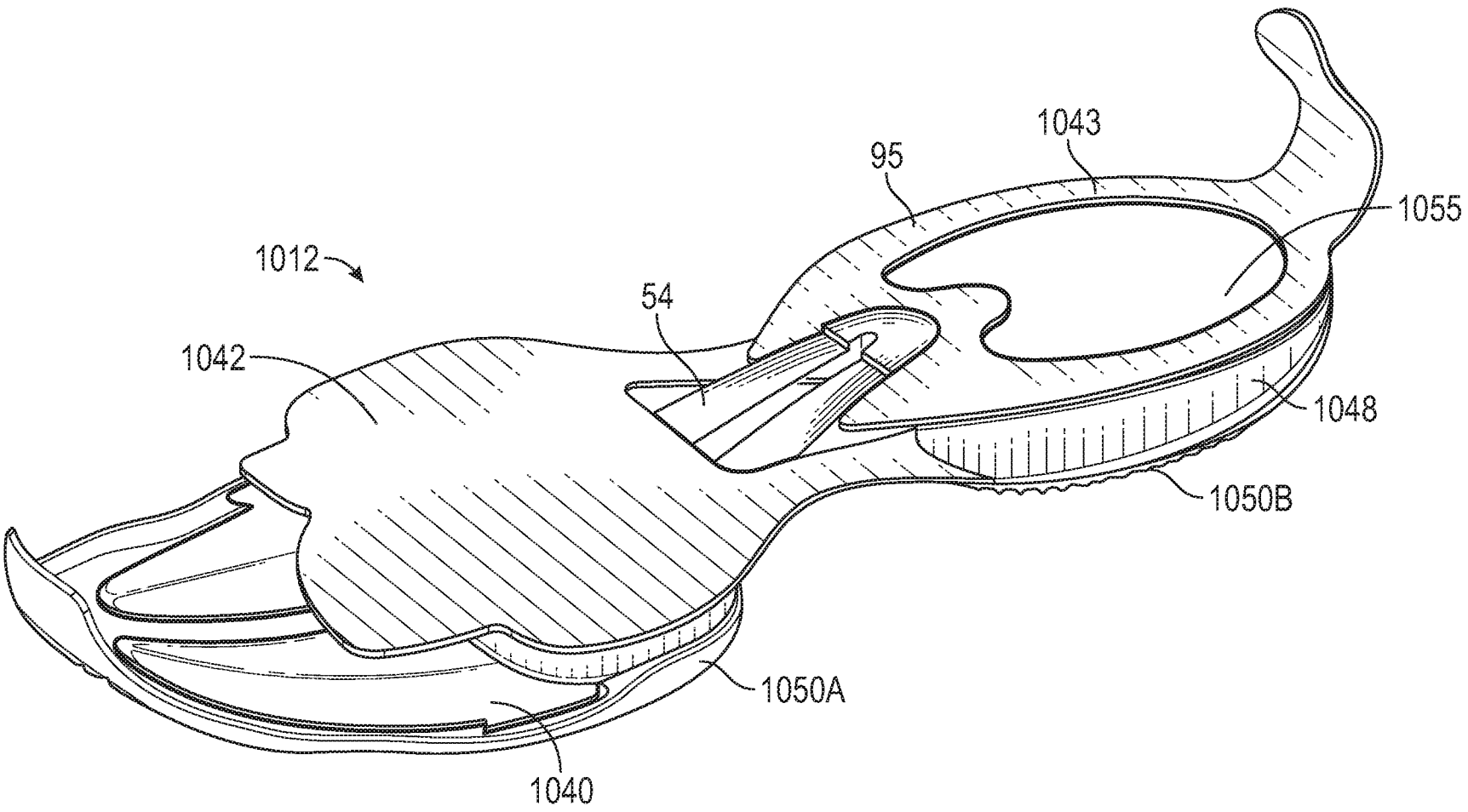
FIG. 56 is a perspective view of the sole structure of FIG. 40 with the full-length midsole unit not shown.
Figure 57:
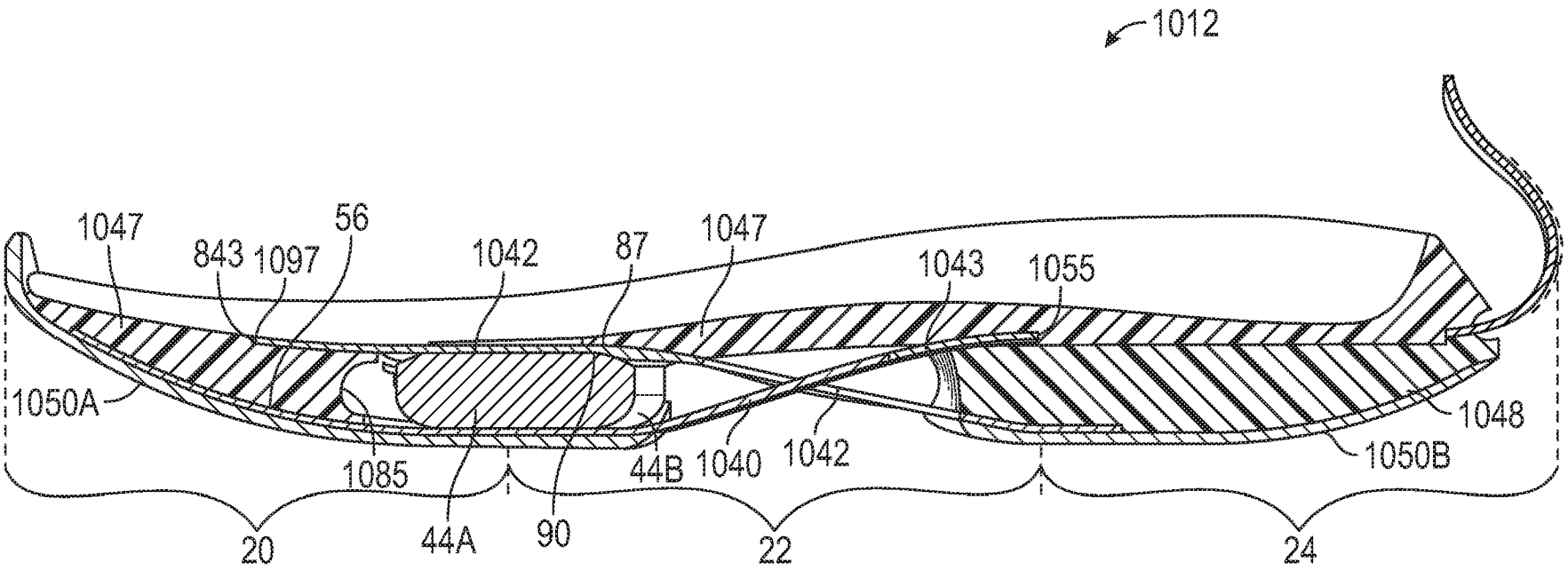
FIG. 57 is a cross-sectional view of the sole structure of FIG. 40 taken along lines 57-57 in FIG. 52.

The third plate 1043 has a through hole 1055 that is best shown in FIGS. 46-49 and 56. When the third plate 1043 is assembled in the sole structure 1012, the through hole 1055 is in the heel region 24 of the sole structure 1012, as indicated by FIGS. 43 and 57. The third plate 1043 includes an elongated tail 1057 curving upward and forward from a rear of the third plate 1043. For example, the elongated tail 1057 may be used as a lever on which the opposite foot pushes to remove the article of footwear 1010 from the foot 18.

FIG. 43 shows only the fluid-filled bladders 44A, 44B, the first plate 1040, the second plate 1042, and the third plate 1043 in their relative positions when the sole structure 1012 is assembled. The full-length midsole unit 1047, the rear midsole unit 1048, and the outsole components 1050A, 1050B are not shown in order to best view the fluid-filled bladders 44A, 44B, the first plate 1040, the second plate 1042, and the third plate 1043.

Figure 52:
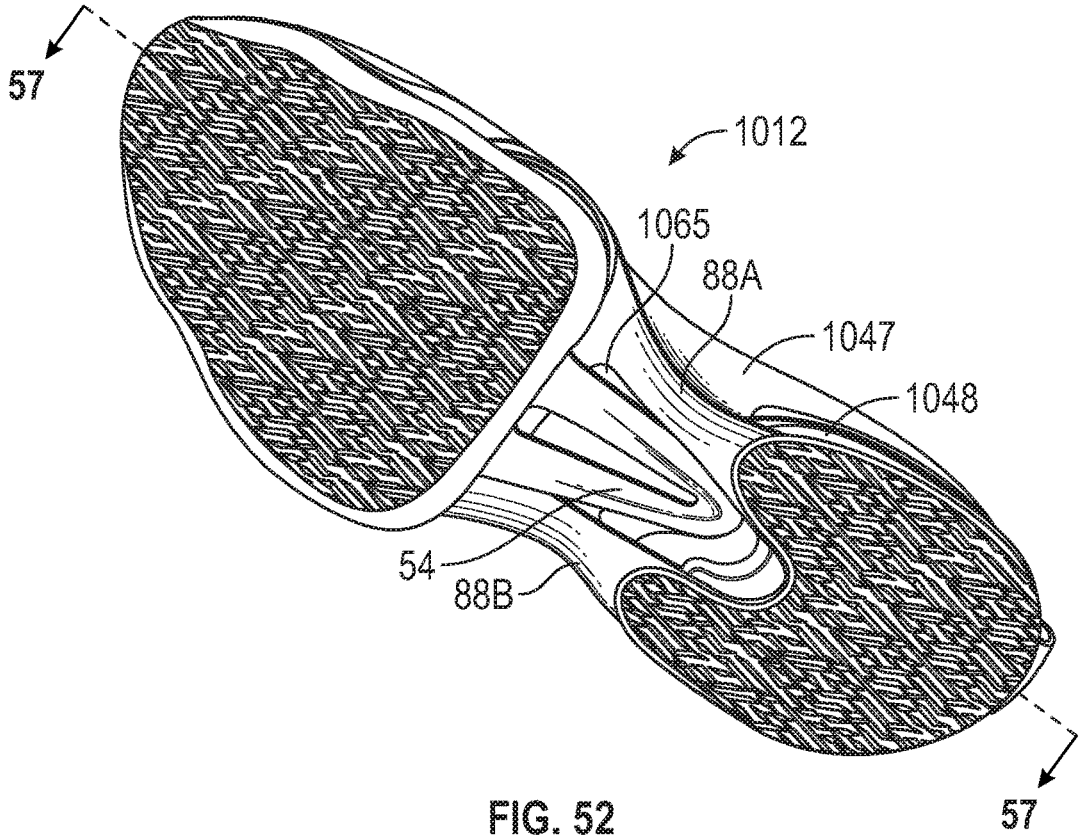
FIG. 52 is a bottom perspective view of the sole structure of FIG. 40 including outsole components.

As shown in FIG. 43, the tapered posterior portion 54 ascends rearward of the fluid-filled bladders 44A, 44B between the medial-side trailing arm 88A and the lateral-side trailing arm 88B, and the medial-side trailing arm 88A and the lateral-side trailing arm 88B descend rearward of the fluid-filled bladders 44A, 44B. The medial-side trailing arm 88A and the lateral-side trailing arm 88B are disposed above the first plate 1040 just rearward of the fluid-filled bladders 44A, 44B, and descend to below the tapered posterior portion 54 rearward of the fluid-filled bladders 44A, 44B. The tapered posterior portion 54 ascends from below the medial-side trailing arm 88A and the lateral-side trailing arm 88B to above the medial-side trailing arm 88A and the lateral-side trailing arm 88B between the fluid-filled bladders 44A, 44B and a terminal end 76 of the tapered posterior portion 54. The second plate 1042 extends further rearward than the terminal end 76 of the tapered posterior portion 54 of the first plate 1040. The tapered posterior portion 54 of the first plate 1040 ascends rearward through the through hole 1065 of the second plate 1042 as best shown in FIG. 52. The third plate 1043 ascends rearward from the first plate 1040 above the medial-side trailing arm 88A and the lateral-side trailing arm 88B.

As best shown in FIGS. 40 and 41, the tapered posterior portion 54, the medial-side trailing arm 88A and the lateral-side trailing arm 88B are exposed in the midfoot region 22 of the sole structure 1012. For example, at least portions of these components where they cross one another are exposed and visible from a medial side view (see FIG. 40), from a lateral side view (see FIG. 41), and/or from a bottom view (see FIG. 52) of the sole structure 1012.

Referring to FIGS. 42 and 43, the fluid-filled bladders 44A, 44B are supported by the first plate 1040 on the proximal side 56 of the central portion 49 of the first plate 1040 and forward of the tapered posterior portion 54. The central portion 86 of the second plate 1042 is supported by the fluid-filled bladders 44A, 44B on proximal sides 104 of the fluid-filled bladders 44A. 44B and forward of the medial-side trailing arm 88A and the lateral-side trailing arm 88B. The tapered posterior portion 54 ascends rearward of the fluid-filled bladders 44A, 44B through the through hole 1065 of the second plate 1042 and between the medial-side trailing arm 88A and the lateral-side trailing arm 88B (i.e., inward of the trailing arms 88A, 88B in the transverse direction of the sole structure 1012). The medial-side trailing arm 88A and the lateral-side trailing arm 88B descend rearward of the fluid-filled bladders 44A, 44B. Between the fluid-filled bladders 44A, 44B and the terminal ends 89A, 89B of the trailing arms 88A, 88B, the medial-side trailing arm 88A and the lateral-side trailing arm 88B descend from forward portions of the trailing arms 88A, 88B which are at a position above the first plate 1040 to terminal ends 89A, 89B of the medial-side trailing arm 88A and the lateral-side trailing arm 88B, respectively, which are at a position lower than (i.e., below) at least a rear portion of the tapered posterior portion 54.

Between the fluid-filled bladders 44A, 44B and the terminal end 76 of the tapered posterior portion 54, the rails 54A, 54B ascend from a position below the medial-side trailing arm 88A and the lateral-side trailing arm 88B at forward portions of the rails 54A, 54B, to a position above the medial-side trailing arm 88A and the lateral-side trailing arm 88B. The terminal end 76 of the tapered posterior portion 54 of the first plate 1040 is forward of the terminal ends 89A, 89B of the trailing arms 88A, 88B. The first plate 1040 extends from the forefoot region 20 to the midfoot region 22 and not in the heel region 24, the third plate extends from the midfoot region 22 to the heel region 24 and not in the forefoot region 20, and the second plate 1042 extends in the forefoot region 20, the midfoot region 22, and part of the heel region 24.

The full-length midsole unit 1047 and the rear midsole unit 1048 are generally a more compliant material than the plates 1040, 1042, 1043, and provide cushioning and energy return. For example, the full-length midsole unit 1047 and the rear midsole unit 1048 may comprise an ethylene-vinyl acetate (EVA) foam, another foam, or another material that has a lower compressive stiffness than the plates 1040, 1042, 1043. This enables the phalanges of the foot 18 to grip the forefoot portion of the full-length midsole unit 1047 with greater ease than would be afforded by a stiffer component by compressing the forefoot portion of the full-length midsole unit 1047 during dorsiflexion in a propulsive phase of the gait cycle, just prior to toe off.

As best shown in FIGS. 40 and 41, the rear midsole unit 1048 extends rearward of the fluid-filled bladders 44A, 44B. The rear midsole unit 1048 has a medial shoulder 55A (see FIG. 54) interfacing with and secured to the medial-side trailing arm 88A (see FIG. 53), and a lateral shoulder 55B (see FIG. 54) interfacing with and secured to the lateral-side trailing arm (see FIG. 53). The medial shoulder 55A may interface flush with the medial-side trailing arm 88A, and the lateral shoulder 55B may interface with flush with the lateral-side trailing arm 88B. The medial-side trailing arm 88A may nest in a recess 57A of the medial shoulder 55A, and the lateral-side trailing arm 88B may nest in a recess 57B of the lateral shoulder 55B. The recesses 57A, 57B continue and are joined at a rear recessed section 57C (see FIG. 54) in which the rear 88C (see FIG. 55) of the second plate 1042 is nested.

Figure 54:
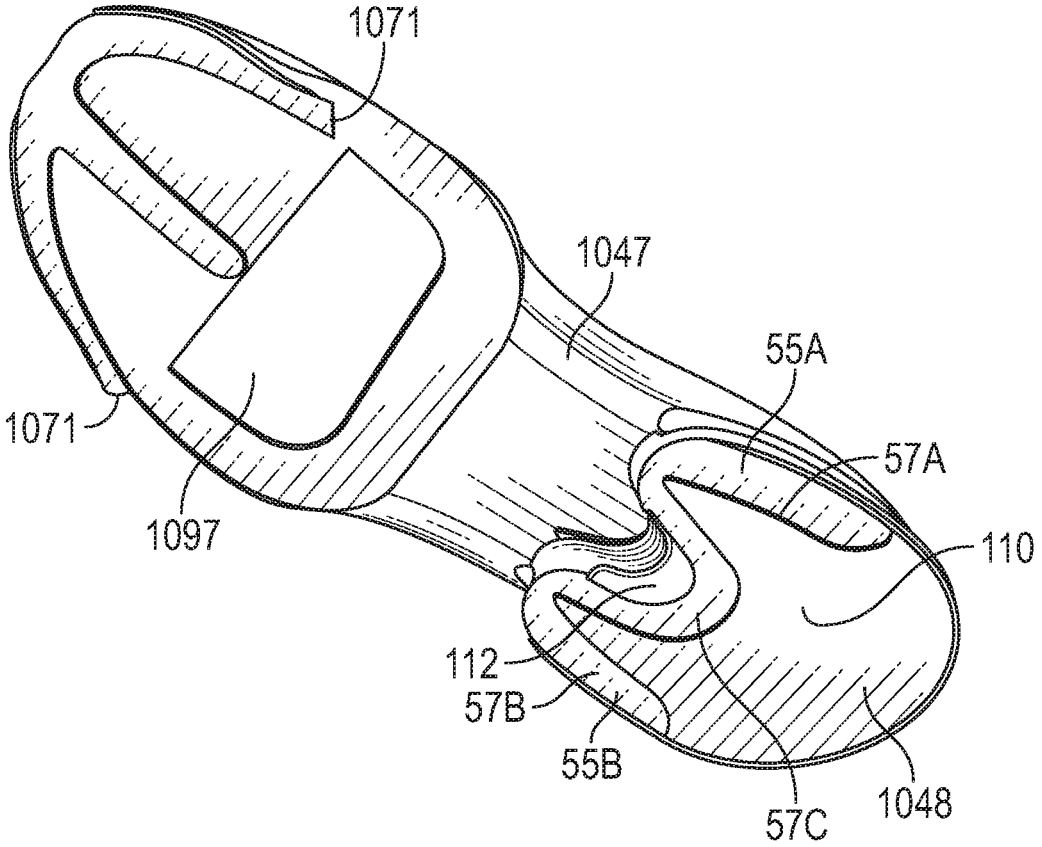
FIG. 54 is a bottom perspective view of midsole components of the sole structure of FIG. 40.

The wall 1067 of the second plate 1042 extends upward between the medial-side trailing arm 88A and the lateral-side trailing arm 88B around the rear 88C. FIG. 54 shows that the rear midsole unit 1048 has a distal side 110 with a recess 112 between the medial shoulder 55A and the lateral shoulder 55B, like that of the rear midsole unit 48. The continuous wall 1067 extends upward into the recess 112 and interfaces flush with the rear midsole unit 1048 in the recess 112 as shown in FIG. 52. Additionally, the tapered posterior portion 54 of the first plate 1040 is seated against and secured to the rear midsole unit 1048 in the recess 112.

The rear midsole unit 1048 is secured to a distal side 93 of the third plate 1043 as shown in FIGS. 40 and 41. Additionally, the rear midsole unit 1048 is exposed at a proximal side 95 of the third plate 1043 at the through hole 1055 of the third plate 1043, as shown in FIG. 56.

The full-length midsole unit 1047 extends from the forefoot region 20 to the heel region 24 of the sole structure 1012 as best shown in FIGS. 40, 42, and 57. As shown in FIG. 57, the full-length midsole unit 1047 is supported on and interfaces with the proximal side 56 of the first plate 1040 in the forefoot region 20 forward of the fluid-filled bladders 44A, 44B and forward of the forward edge 843 of the second plate 1042. The full-length midsole unit 1047 also interfaces with the proximal side 87 of the second plate 1042 forward of the medial-side trailing arm 88A and the lateral-side trailing arm 88B. The full-length midsole unit 1047 interfaces with the proximal side 95 of the third plate 1043.

Figure 55:
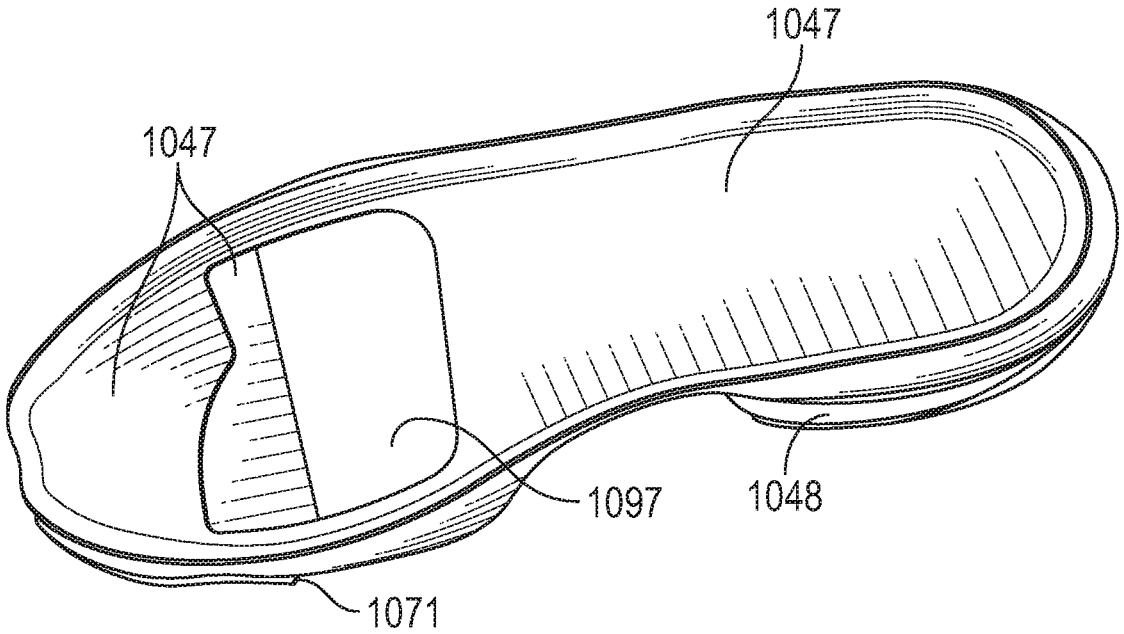
FIG. 55 is a top perspective view of midsole components of the sole structure of FIG. 40.

As shown in FIGS. 40 and 57, the full-length midsole unit 1047 extends over the through hole 1055 of the third plate 1043 and interfaces with the proximal side of the rear midsole unit 1048 at the through hole 1055 of the third plate 1043. As shown in FIGS. 54, 55, and 57, the full-length midsole unit 1047 has a through hole 1097. It is apparent in FIG. 57 that the through hole 1097 is disposed over the second plate 1042 so that the proximal side of the second plate 1042 is exposed at the through hole 1097 of the full-length midsole unit 1047. The fluid-filled bladders 44A, 44B are disposed at a distal side 90 of the second plate 1042 under the through hole 1097 as shown in FIG. 57.

The through holes 1055, 1097 are placed in accordance with desired loading of the components of the sole structure 1012 by the foot. For example, the heel of the foot 18 will be supported directly on the stacked midsole units 1047, 1048 at the through hole 1097. Because the midsole units 1047, 1048 are of lower stiffness than the third plate 1043, the cushioning properties of the midsole units 1047, 1048 will be experienced directly by the heel, without the stiffer third plate 1043 intervening in the area of the through hole 1097. The ball of the foot 18 will be supported directly on the second plate 1042 at the through hole 1097, without the less stiff, full-length midsole unit 1047 intervening between the second plate 1042 and the ball of the foot 18. Accordingly, loads transmitted at the ball of the foot 18 at the through hole 1097 will be directly distributed by the second plate 1042 over the fluid-filled bladders 44A, 44B, without transmitting through the less stiff midsole unit 1047.

As best shown in FIGS. 40 and 57, the full-length midsole unit 1047 has a wall 1085 forward of the fluid-filled bladders 44A, 44B and extending in the vertical direction from the first plate 1040 to the second plate 1042. The surface of the wall 1085 curves forward between the first plate 1040 and the second plate 1042. The wall 1085 may be spaced apart from the forward surfaces of the bladders 44A, 44B when the sole structure 1012 is under steady-state loading, and may act as a reaction surface that limits forward deformation of the bladders 44A, 44B when the sole structure 1012 is under dynamic loading.

Figure 53:
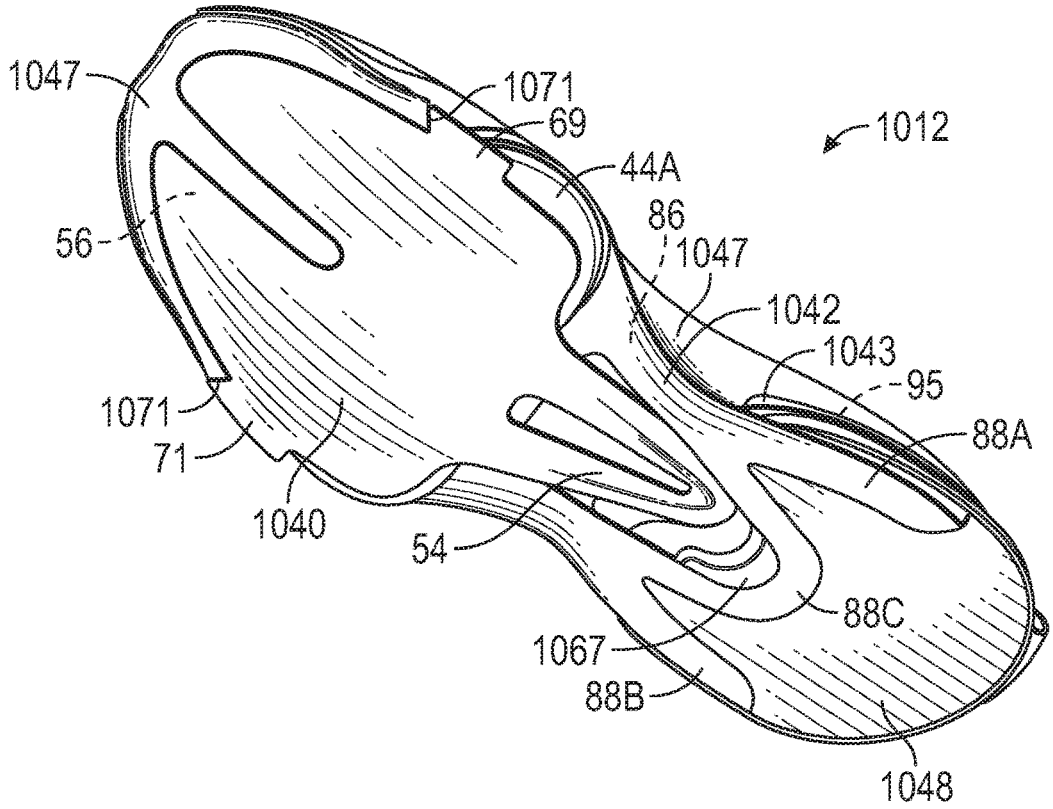
FIG. 53 is a bottom perspective view of the sole structure of FIG. 40 with outsole components not shown.

The medial flange 69 and the lateral flange 71 are disposed against a rear face 1071 of a downwardly extending portion of the full-length midsole unit 1047 in the forefoot region 20 forward of the fluid-filled bladders 44A, 44B as shown in FIG. 53. The flanges 69, 71 and the rear face 1071 are locating features that are positioned against one another to correctly align the full-length midsole unit 1047 with the first plate 1040.

Figure 58:
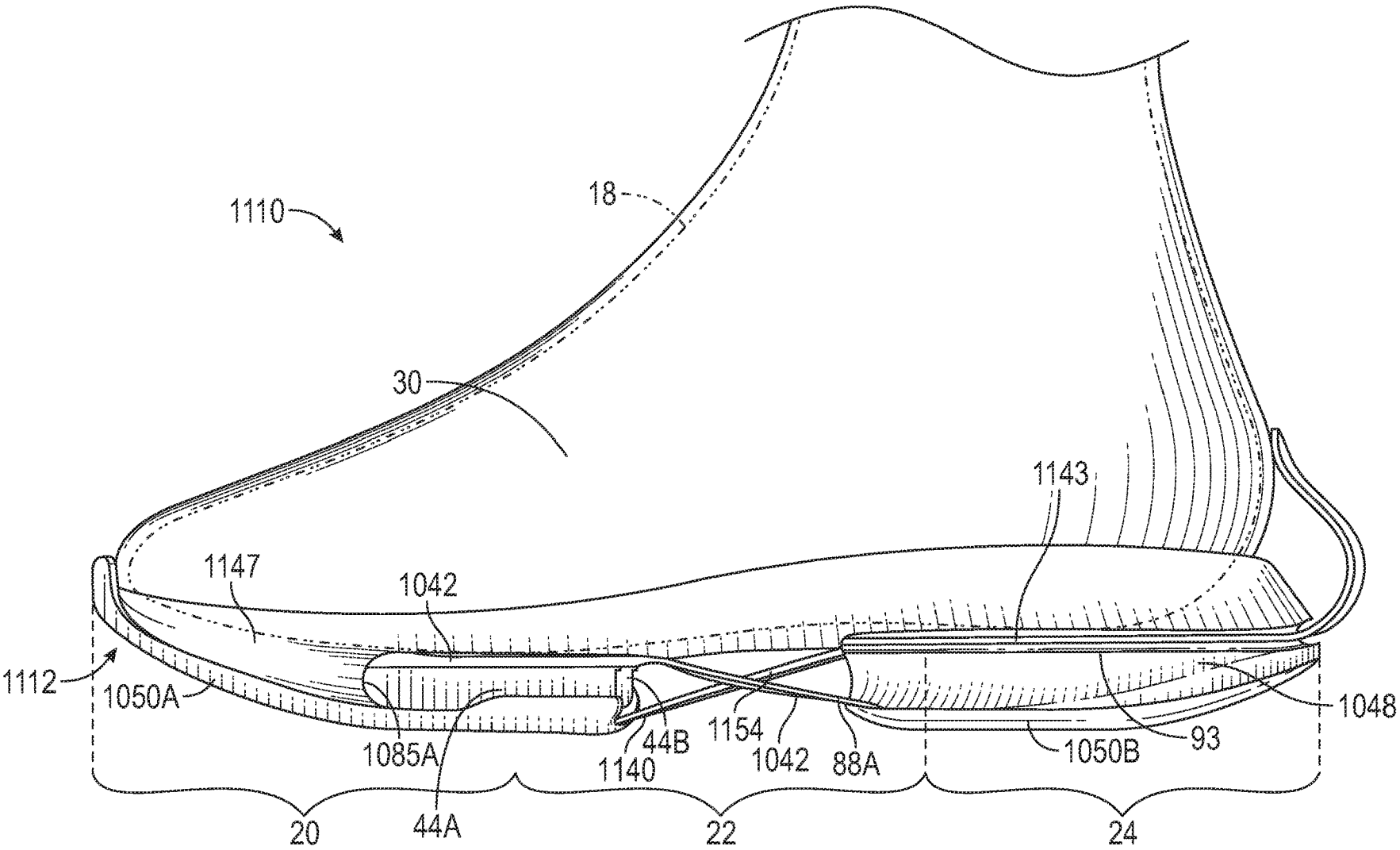
FIG. 58 is a medial side view of an article of footwear including a sole structure and an upper secured to the sole structure in an alternative aspect of the disclosure.
Figure 59:
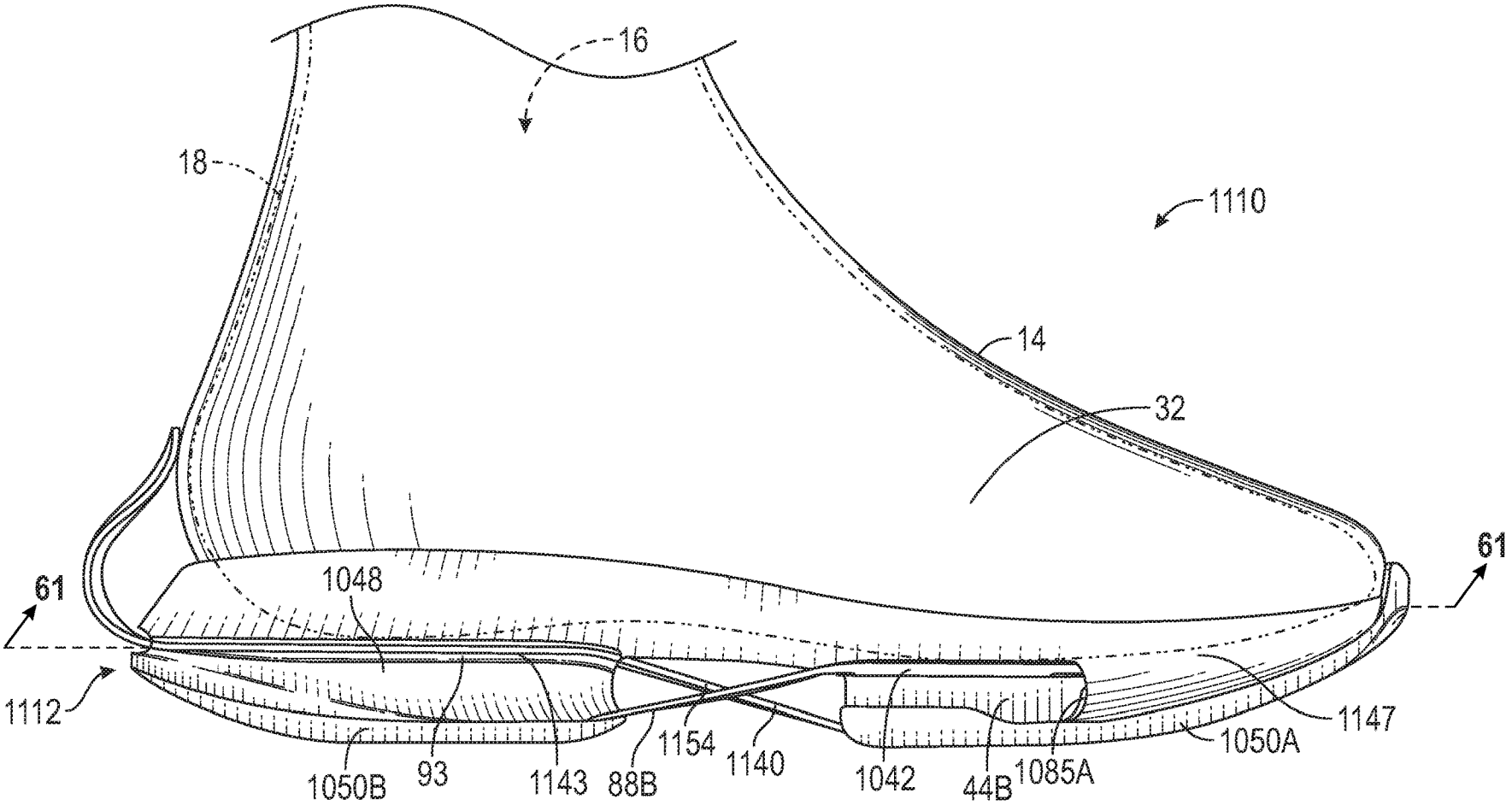
FIG. 59 is a lateral side view of the article of footwear of FIG. 58.

FIGS. 58 and 59 show an article of footwear 1110 with another embodiment of a sole structure 1112 within the scope of the present teachings. The sole structure 1112 has many of the same components as sole structure 1012, which are referred to with like reference numbers. The sole structure 1112 includes a first plate 1140, the second plate 1042 as previously described, and a third plate 1143, each of which is partially visible in FIG. 58. The sole structure 1112 also includes the first and second fluid-filled bladders 44A (show in FIG. 58), 44B (shown in FIG. 59) disposed between the first and second plates 1140, 1042. In addition to the plates 1140, 1042, 1143 and the fluid-filled bladders 44A, 44B, the sole structure 1112 includes a full-length midsole unit 1147, the rear midsole unit 1048 (as previously described) rearward of the fluid-filled bladders 44A, 44B, and outsole components 1050A, 1050B (as previously described) that establish a ground-contact surface G of the sole structure 1112. Each of the components of the sole structure 1112 is discussed in greater detail with respect to the several figures in which they appear.

Figure 60:
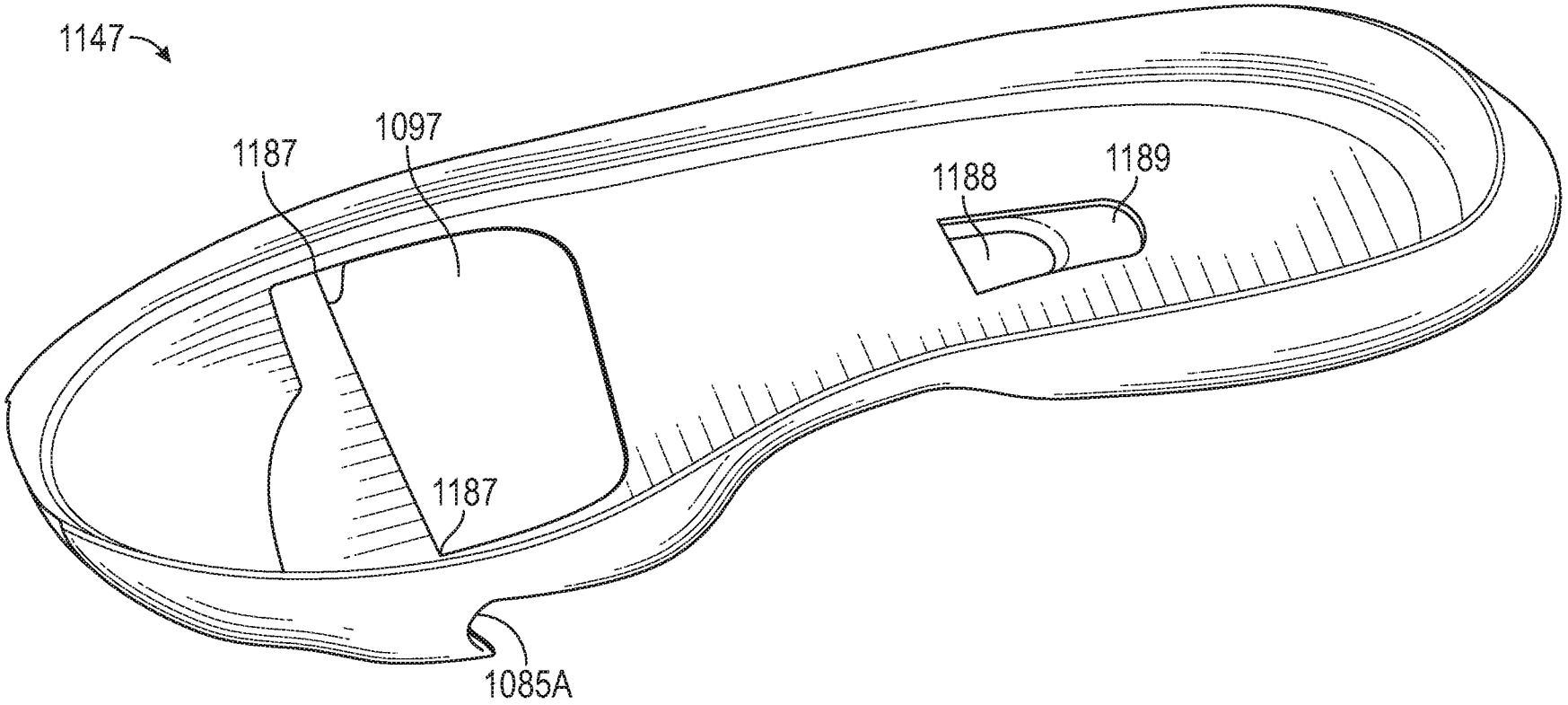
FIG. 60 is a top perspective view of the full-length midsole unit of the article of footwear of FIG. 58.
Figure 61:
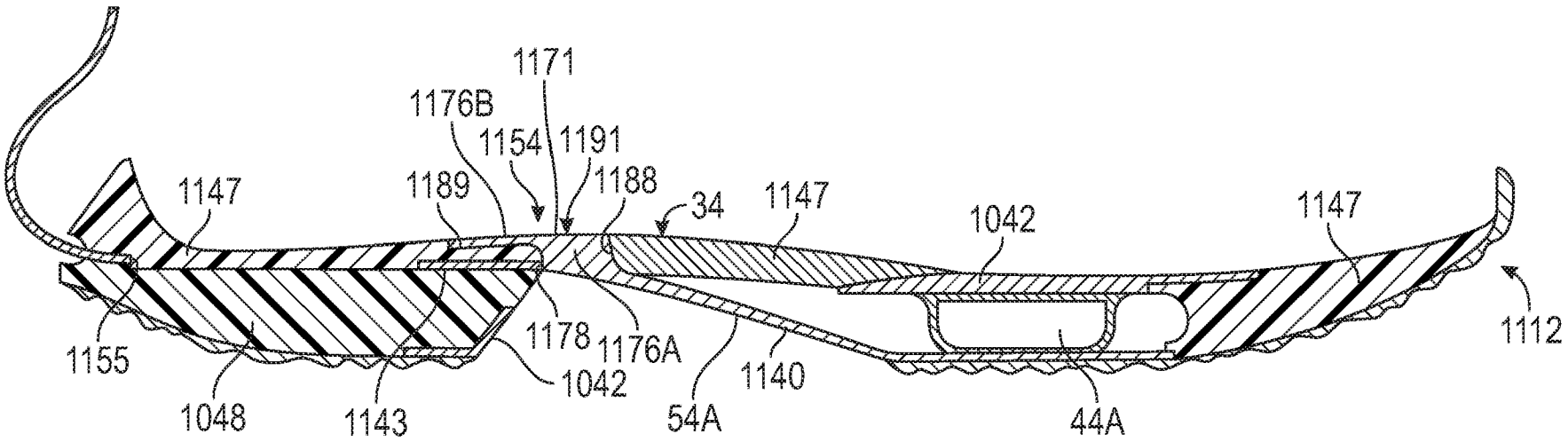
FIG. 61 is a cross-sectional view of the sole structure of FIG. 59 taken at lines 61-61 in FIG. 59.
Figure 62:
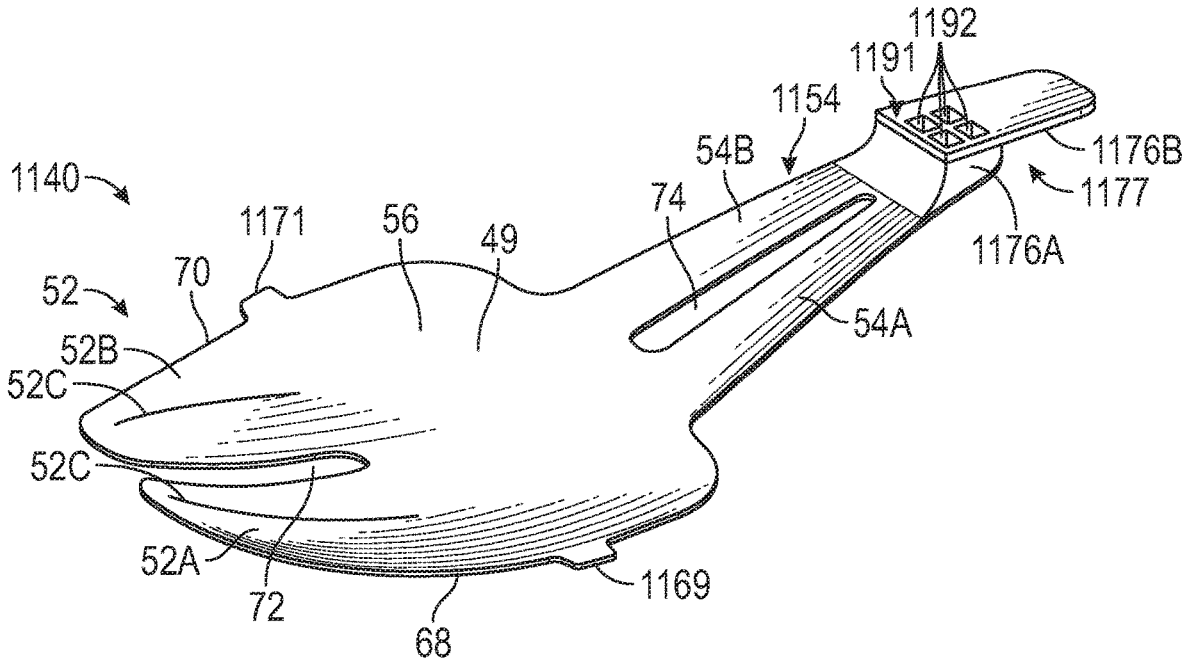
FIG. 62 is a top perspective view of the first plate of the sole structure of FIG. 58.
Figure 63:
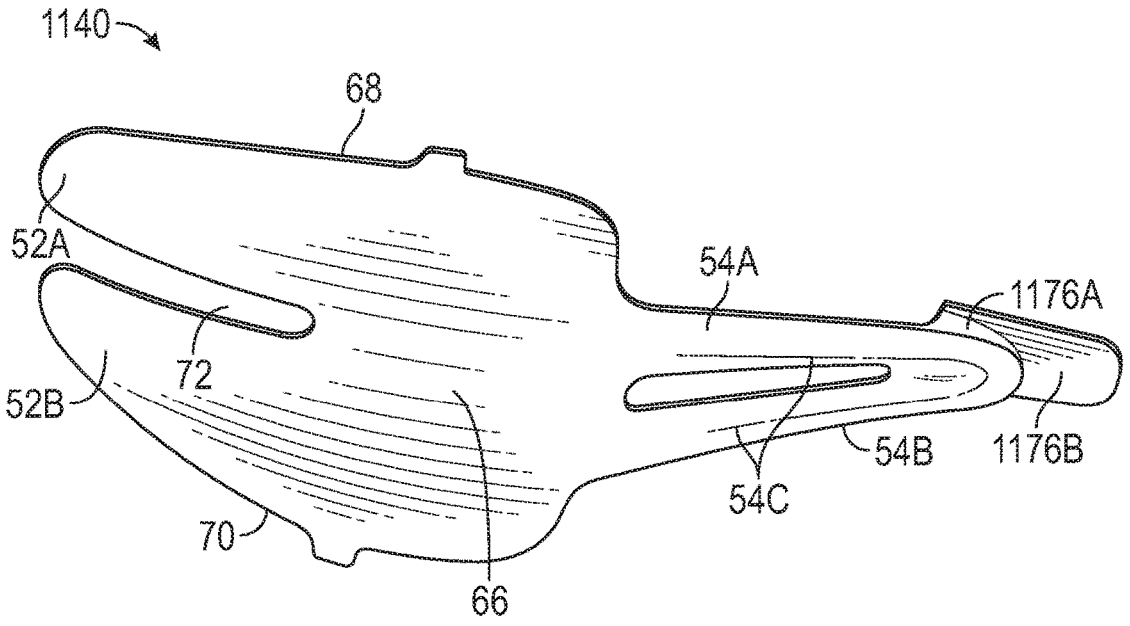
FIG. 63 is a bottom perspective view of the first plate of the sole structure of FIG. 58.

As can be seen in FIGS. 58 and 59, the full-length midsole unit 1147 is configured substantially similarly to full-length midsole unit 1047. Like midsole unit 1047, the full-length midsole unit 1147 extends from the forefoot region 20 to the heel region 24 of the sole structure 1112, and extends over and is supported on and interfaces with a proximal side of the first plate 1140 in the forefoot region 20 forward of the second plate 1042, with the proximal side of the second plate 1042 forward of the medial-side trailing arm 88A and the lateral-side trailing arm 88B, and with the proximal side of the third plate 1143 in the heel region 24. The front wall 1085A is closer to the bladders 44A, 44B, and has less curvature than the front wall 1085 of midsole unit 1047. As best shown in FIG. 60, notches 1187 are included at the front edge of the through hole 1097, which may be referred to as a front through hole. Additionally, the full length midsole unit 1147 also has a through hole 1188 closer to the heel region 24 and disposed over the rear midsole unit 1048 in the assembled sole structure 1112. The through hole 1188 may be referred to as a rear through hole. A recess 1189 in the foot-facing surface 34 of the midsole unit 1147 is immediately rearward of and in communication with the through hole 1188. The through hole 1188 is provided to accommodate the tapered posterior portion 1154 of the first plate 1140, which extends through the through hole 1188 in the midsole unit 1147 and is secured to the foot-facing surface 34 of the midsole unit 1147, as shown in FIG. 61. FIG. 61 is taken at a cross-section through the medial rail 54A. FIGS. 62 and 63 show the first plate 1140 having many of the same features as first plate 1040. The first plate 1140 includes flanges 1169, 1171 that serve the same function as flanges 69, 71 of first plate 1040, but are reduced in fore-aft length.

Figure 64:
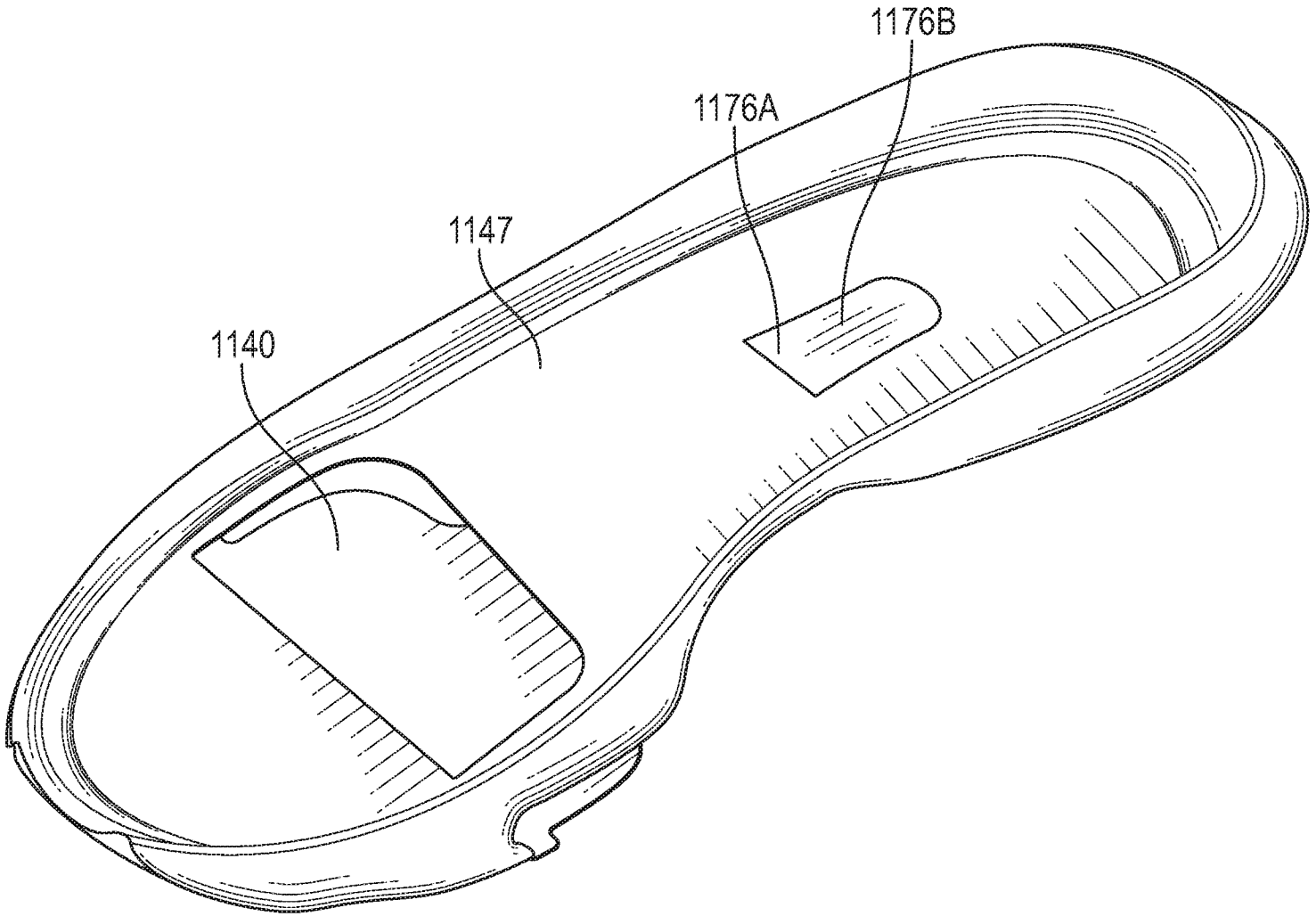
FIG. 64 is a top perspective view of the full-length midsole unit of FIG. 60 assembled to the first plate if FIG. 62.

The tapered posterior portion 1154 includes a stepped rear 1177 with a relatively thick leg 1176A and a relatively thin leg 1176B extending rearward from the relatively thick leg 1176A. As best shown in FIG. 61, when the sole structure 1112 is assembled, the relatively thick leg 1176A extends through the through hole 1188 and the relatively thin leg 1176B extends over the midsole unit 1147 and is seated in the recess 1189 on the foot-facing surface 34 of the midsole unit 1147. FIG. 64 shows the first plate 1140 assembled to the midsole unit 1147, with other components of the sole structure 1112 removed for clarity. The relatively thin leg 1176B is bonded to the foot-facing surface 34 in the recess 1189 with adhesive, thermal bonding, or otherwise. The foot-facing surface 1191 of the stepped rear 1177 is flush with the foot-facing surface 34 of the midsole unit 1147, as shown in FIG. 61. A strobel (not shown) may be bonded to the foot-facing surface 34 of the midsole unit 1147, including the foot-facing surface 1191 of the stepped rear 1177.

The side surface 1176C (shown in FIG. 62) of the relatively thick leg 1176A may be bonded to the surface of the midsole unit 1147 bounding the through hole 1188. The relative thickness of leg 1176A provides the side surface 1176C with more surface area than would a thinner leg, for better securement to the midsole unit 1147. Due to this relative thickness, the foot-facing surface 1191 of the tapered posterior portion 1154 at the stepped rear includes a plurality of recesses 1192 in a foot-facing surface of the tapered posterior portion. The recesses 1192 reduce the weight of the first plate 1140. Additionally, the recesses 1192 reduce the thickness of the relatively thick leg 1176A at the foot-facing surface 1191, effectively creating a matrix of thin walls surrounding the recesses 1192. In embodiments in which the first plate 1140 is injection molded, thinner walls allow for better material flow and less overall shrinkage than would a thicker molded section.

Figure 65:
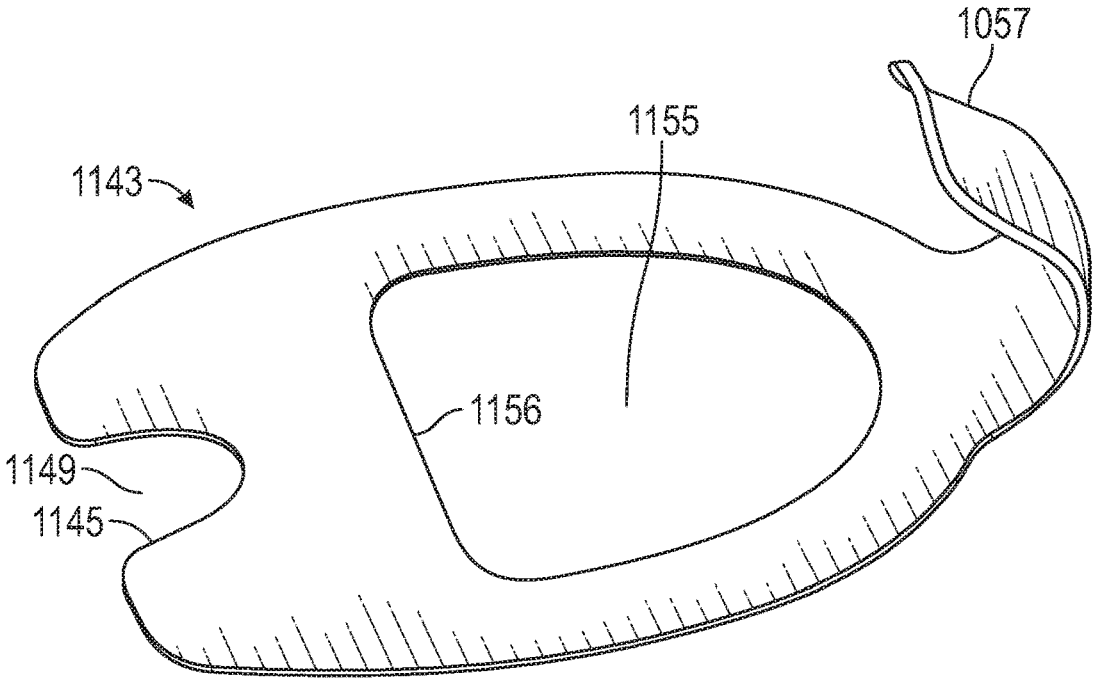
FIG. 65 is a top perspective view of the third plate of the sole structure of FIG. 58.
Figure 66:
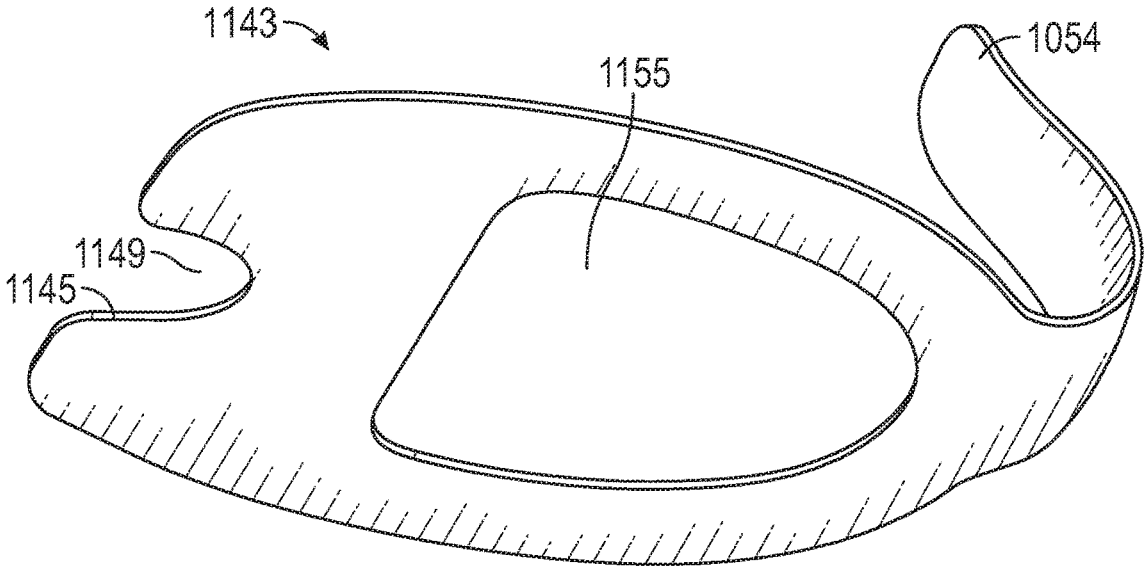
FIG. 66 is a bottom perspective view of the third plate of the sole structure of FIG. 68.
Figure 67:
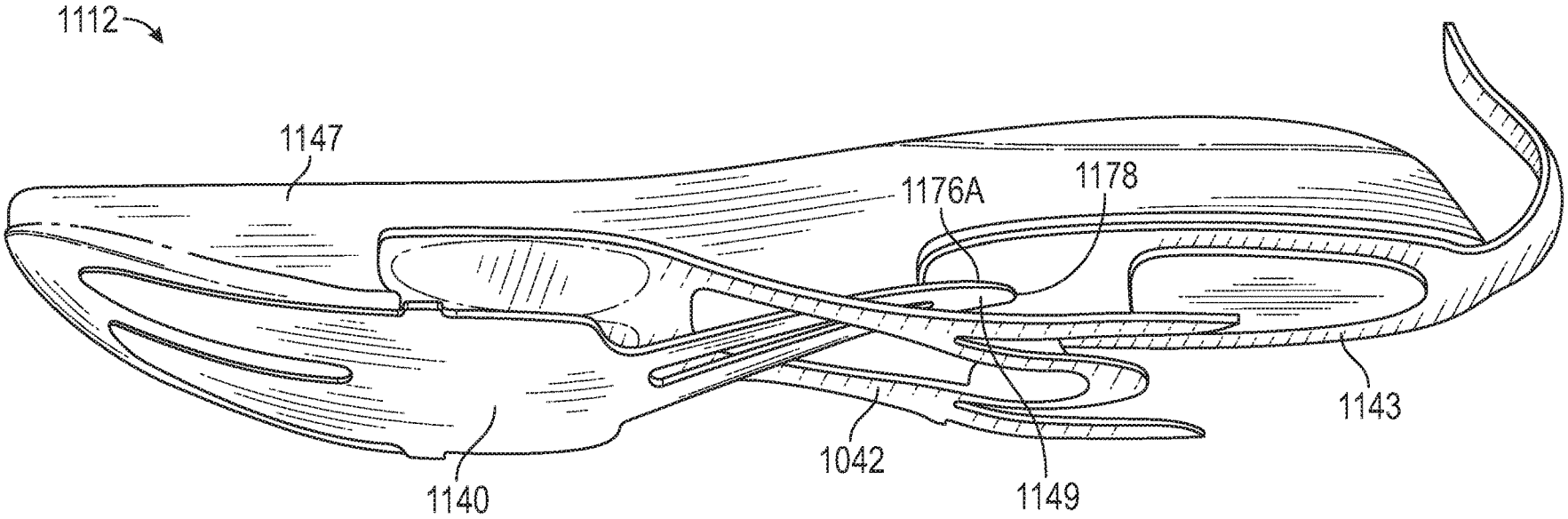
FIG. 67 is a bottom perspective view of the full-length midsole unit and the first, second, and third plates of the sole structure of FIG. 58 assembled to one another.
Figure 68:
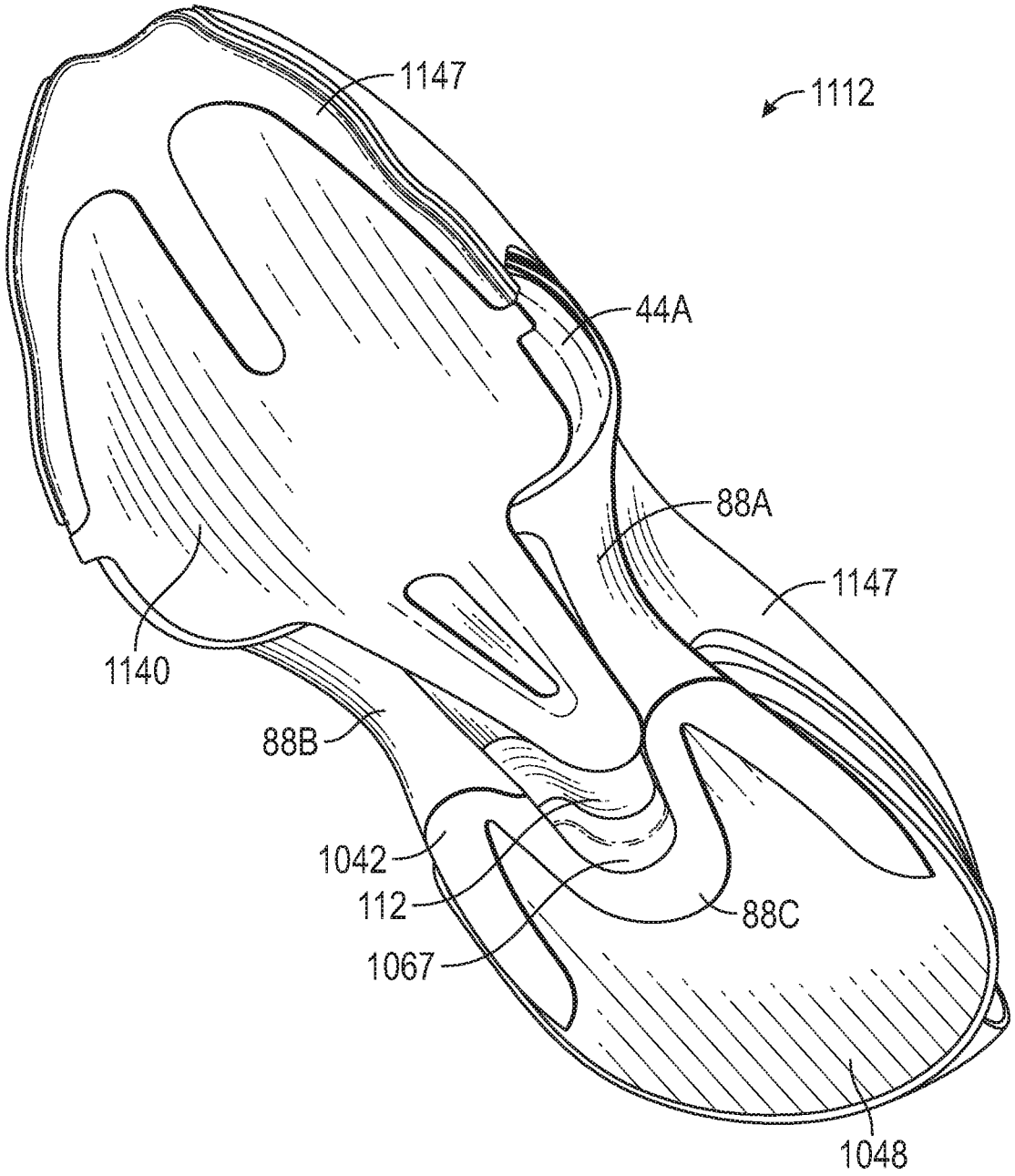
FIG. 68 is a bottom perspective view of the full-length midsole unit and the first, second, and third plates of the sole structure of FIG. 58 assembled to one another and including the rear midsole unit and fluid-filled bladders.

FIGS. 65 and 66 show the third plate 1143 having many of the same features as the third plate 1043. The opening 1155 has a straighter forward edge 1156 and the forward edge 1145 of the third plate 1143 has a shallower notch 1149 than notch 1049 of third plate 1043. As shown in FIG. 67, in which the rear midsole unit outsole components 1050A, 1050B are removed for clarity, the rear 1178 of the relatively thick leg 1176A abuts the third plate 1143 in the notch 1149. Referring again to FIG. 61, the third plate 1143 underlies the relatively thin leg 1176B of the first plate 1140 with a portion of the midsole unit 1147 disposed between the first plate 1140 and the third plate 1143 and the rear midsole unit 1048 below the third plate 1143 (e.g., the components are vertically stacked in order from top to bottom first plate 1140, midsole unit 1147, third plate 1143, and rear midsole unit 1048). As shown in FIG. 68, the rear sole midsole unit 1048 is configured to interfit with the second plate 1042 and the first plate 1140 in a similar manner as described with respect to the corresponding components of sole structure 1012.

Figure 69:
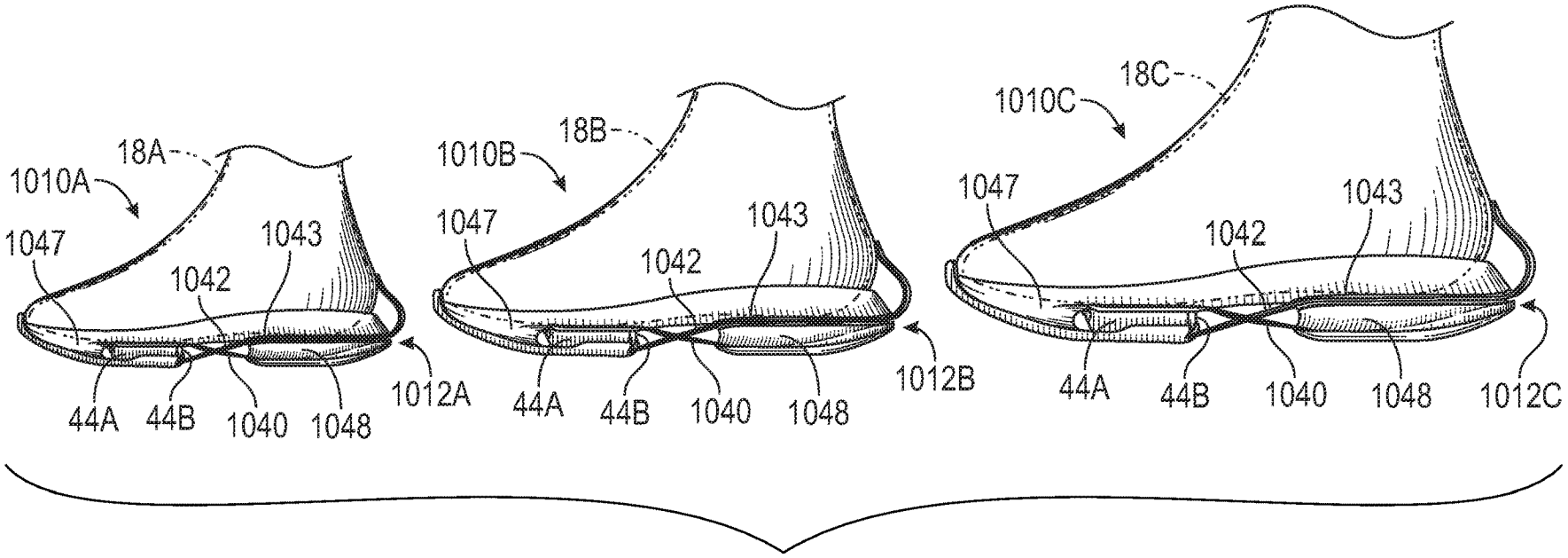
FIG. 69 is a schematic illustration of articles of footwear of three different size ranges.

Various embodiments of sole structures, including those described herein, may provide the most desirable combination of support and cushioning when the inflation pressure of the one or more fluid-filled bladders is correlated with footwear size. For example, FIG. 69 shows three articles of footwear 1010A, 1010B, 1010C, each having the same components as the article of footwear 1010 described herein but being of a different footwear size. Each of the articles of footwear 1010A, 1010B, 1010C has a corresponding sole structure 1012A, 1012B, and 1012C configured the same as the sole structure 1012 described herein, with a first plate 1040, a second plate 1042, and a fluid-filled bladder, such as bladders 44A, 44B, supported on a proximal side of the first plate 1040. The second plate 1042 is supported on a proximal side of the fluid-filled bladders 44A, 44B.

Each of the articles of footwear 1010A, 1010B, 1010C is included in a different range of footwear sizes. For example, a first range of footwear sizes may be referred to as Range A, and may include men's United States (U.S.) footwear sizes 6-9. Article of footwear 1010A is a men's U.S. size 8 corresponding with a foot 18A measured as a men's U.S. size 8, and is therefore included in Range A. A second range of footwear sizes may be referred to as Range B, and may include men's U.S. footwear sizes 9.5 to 12. Article of footwear 1010B is a men's U.S. size 11 corresponding with a foot 18B measured as a men's U.S. size 11, and is therefore included in Range B. A third range of footwear sizes may be referred to as Range C, and may include men's U.S. footwear sizes 12.5-15. Article of footwear 1010C is a men's U.S. size 14 corresponding with a foot 18C measured as a men's U.S. size 14, and is therefore included in Range C. The plural size ranges as well as the specification of the footwear as "men's" footwear are for purposes of example only. The method applies equally to women's footwear, unisex footwear, and children's or youth footwear. The number of ranges of sizes under the method may include two or more, and is not limited to three ranges as in the example.

Because the articles of footwear 1010A, 1010B, 1010C are of different footwear sizes, some or all of the corresponding components such as the plates 1040, 1042, 1043 and/or the fluid-filled bladders 44A, 44B may be of corresponding different sizes. For example, the plates 1040, 1042, 1043 and the fluid-filled bladders 44A, 44B as shown are smaller for article of footwear 1010A than for article of footwear 1010B.

A wearer with a foot 18A having a footwear size within the first range of footwear sizes (Range A) is likely to be of a lower weight than a wearer with a foot 18B having a footwear size within the second range of footwear sizes (Range B). Wearers with footwear sizes in Ranges A or B are both likely to be of a lower weight than a wearer with a foot 18C having a footwear size within the third range of footwear sizes (Range C). Accordingly, the compressive loads borne by sole structure 1012A are likely to be lower than the compressive loads borne by sole structure 1012B, which are likely to be lower than the compressive loads borne by sole structure 1012C.

The cushioning response of the bladders 44A, 44B is in part a function of the inflation pressures of the bladders 44A, 44B. Generally, a bladder 44A will have a stiffer response if it is inflated to a higher pressure than it will when inflated to a lower pressure. To provide generally the same cushioning feel to wearers of different compressive loads, the inflation pressure of the bladders 44A, 44B should generally correspond with the magnitude of the compressive load.

Accordingly, a method of manufacturing footwear sole structures comprises assembling sole structures for plural ranges of footwear sizes, such as sole structures 1012A, 1012B, 1012C uses fluid-filled bladders 44A, 44B that have a predetermined inflation pressure. The predetermined inflation pressure is different for at least two of the ranges of footwear sizes. In one example, the predetermined inflation pressure of the fluid-filled bladders 44A, 44B assembled in the sole structure 1012A of the footwear 1010A for the first range of footwear sizes (Range A) is less than the predetermined inflation pressure of the fluid-filled bladders 44A, 44B assembled in the sole structure 1012B of the footwear 1010B for the second range of footwear sizes (Range B), which is less than the predetermined inflation pressure of the fluid-filled bladders 44A, 44B assembled in the sole structure 1012C of the footwear 1010C for the third range of footwear sizes (Range C). For example, the predetermined inflation pressure for the third range of footwear sizes (Range C) may be about 10 pounds per square inch (psi) greater than the predetermined inflation pressure for the first range of footwear sizes (Range A). In one example, the predetermined inflation pressure for the second range of footwear sizes (Range B) may be from about 2 psi to about 5 psi greater than the predetermined inflation pressure for the first range of footwear sizes (Range A), and the predetermined inflation pressure for the third range of footwear sizes (Range C) may be from about 2 psi to about 5 psi greater than the predetermined inflation pressure for the second range of footwear sizes (Range B).

The predetermined inflation pressure for the first range of footwear sizes (Range A) may be up to about 18 pounds per square inch (psi), the predetermined inflation pressure for the second range of footwear sizes (Range B) may be from about 18 psi to about 22 psi, and the predetermined inflation pressure for the third range of footwear sizes (Range C) may be from about 22 psi to about 25 psi. For example, the predetermined inflation pressure for the first range of footwear sizes (Range A) may be 15 psi, the predetermined inflation pressure for the second range of footwear sizes (Range B) may be 20 psi, and the predetermined inflation pressure for the third range of footwear sizes (Range C) may be 25 psi.

The method may include inflating the fluid-filled bladders 44A, 44B to the predetermined inflation pressure corresponding with the footwear size range of the sole structure in which the bladders 44A, 44B are to be assembled, and sealing the fluid-filled bladders 44A, 44B so that the predetermined inflation pressure is retained to the extent possible, which may be dependent in part upon the material of the bladders 44A, 44B. Although the method is described with respect to the article of footwear 1010 and the sole structure 1012, the method may be applied to the manufacturing of any of the articles of footwear and sole structures described herein.

The following Clauses provide example configurations of a sole structure for an article of footwear disclosed herein.

Clause 1: A sole structure for an article of footwear, the sole structure comprising: a first plate; a fluid-filled bladder supported on the first plate; a second plate supported on the fluid-filled bladder with the fluid-filled bladder disposed between the first plate and the second plate; and wherein the first plate ascends rearward of the fluid-filled bladder and the second plate descends rearward of the fluid-filled bladder with a posterior portion of the first plate above a posterior portion of the second plate rearward of the fluid-filled bladder.

Clause 2: The sole structure of Clause 1, wherein: the posterior portion of a first one of the first plate or the second plate includes one or both of a medial-side trailing arm and a lateral-side trailing arm; and the posterior portion of a second one of the first plate or the second plate is disposed adjacent to the one or both of the medial-side trailing arm and the lateral-side trailing arm.

Clause 3: The sole structure of Clause 2, wherein the one or both of the medial-side trailing arm and the lateral-side trailing arm and the posterior portion of the second one of the first plate or the second plate are exposed in a midfoot region of the sole structure.

Clause 4: The sole structure of any of Clauses 2-3, wherein the first one of the first plate or the second plate include both the medial-side trailing arm and the lateral-side trailing arm, and the medial side trailing arm and the lateral side trailing arm converge at a rear of the first one of the first plate or the second plate.

Clause 5: The sole structure of Clause 4, wherein the posterior portion of the first plate, the medial-side trailing arm, and the lateral-side trailing arm are exposed in a midfoot region of the sole structure.

Clause 6: The sole structure of any of Clauses 2-5, wherein the posterior portion of the first plate includes a medial rail and a lateral rail that converge forward of a terminal end of the posterior portion of the first plate.

Clause 7: The sole structure of Clause 6, wherein the medial rail and the lateral rail each have a longitudinally-extending ridge extending downward on a distal side of the first plate.

Clause 8: The sole structure of any of Clauses 2-7, wherein a terminal end of the posterior portion disposed adjacent to the at least one of a medial-side trailing arm and the lateral-side trailing arm is rearward of terminal end(s) of the at least one of the medial-side trailing arm and the lateral-side trailing arm.

Clause 9: The sole structure of any of Clauses 2-8, wherein the first one of the first plate or the second plate includes both the medial-side trailing arm and the lateral-side trailing arm which converge at a rear of the first one of the first plate or the second plate.

Clause 10: The sole structure of Clause 9, wherein the second plate has a central portion supported on the fluid-filled bladder, and the second plate defines an opening rearward of the fluid-filled bladder and bounded by the medial-side trailing arm and the lateral-side trailing arm.

Clause 11: The sole structure of any of Clauses 9-10, wherein the second plate includes a continuous wall extending upward from the medial-side trailing arm and the lateral-side trailing arm.

Clause 12: The sole structure of any of Clauses 2-11, wherein the first plate is bifurcated from a forward edge of the first plate rearward to a rear extent of the posterior portion of the first plate where a medial rail and a lateral rail of the first plate converge.

Clause 13: The sole structure of any of Clauses 2-12, wherein the second plate defines a peripheral wall forward of the medial-side trailing arm and the lateral-side trailing arm, and the peripheral wall extends upward and away from the first plate and around a front of a forefoot region of the sole structure.

Clause 14: The sole structure of Clause 13, further comprising: a rear midsole unit extending rearward of the fluid-filled bladder; wherein the rear midsole unit has a medial shoulder interfacing flush with and secured to the medial-side trailing arm, and a lateral shoulder interfacing flush with and secured to the lateral-side trailing arm; and wherein the rear midsole unit defines a peripheral wall extending forward of the fluid-filled bladder, and upward and away from the second plate, the rear midsole unit defining a through hole extending at least partially over the fluid-filled bladder.

Clause 15: The sole structure of Clause 14, wherein: the rear midsole unit has a distal side with a recess between the medial shoulder and the lateral shoulder; and the posterior portion of the first plate is seated against and secured to the rear midsole unit in the recess.

Clause 16: The sole structure of Clause 15, further comprising: an outsole component secured to the distal side of the rear midsole unit; wherein a first medial sidewall of the outsole component extends upward onto and is secured to a medial side surface of the rear midsole unit.

Clause 17: The sole structure of any of Clauses 2-5, further comprising: a rear midsole unit including a medial shoulder interfacing with and secured to the medial-side trailing arm and a lateral shoulder interfacing with and secured to the lateral-side trailing arm.

Clause 18: The sole structure of Clause 17, wherein the medial-side trailing arm nests in a recess of the medial shoulder, and the lateral-side trailing arm nests in a recess of the lateral shoulder.

Clause 19: The sole structure of Clause 18, wherein: the rear midsole unit has a recess between the medial shoulder and the lateral shoulder; and the second plate includes a wall extending upward into the recess and interfacing with the rear midsole unit in the recess.

Clause 20: The sole structure of any of Clauses 2-5, further comprising: a midsole unit extending in a heel region of the sole structure; wherein the midsole unit has a through hole in the heel region; and wherein the posterior portion of the first plate extends through the through hole in the midsole unit and is seated on a foot-facing surface of the midsole unit.

Clause 21: The sole structure of Clause 20, wherein: the posterior portion of the first plate includes a stepped rear with a relatively thick leg extending through the through hole and a relatively thin leg extending rearward from the relatively thick leg over the midsole unit; and the relatively thin leg is seated in a recess on the foot-facing surface of the midsole unit.

Clause 22: The sole structure of any of Clauses 20-21, further comprising: a third plate having a forward edge that defines a notch; wherein the posterior portion of the first plate is configured to fit within the notch with the third plate extending rearward from the first plate above the medial-side trailing arm and the lateral-side trailing arm; wherein the midsole unit is a full-length midsole unit extending from a forefoot region to the heel region of the sole structure; and wherein the full-length midsole unit is supported on and interfaces with a proximal side of the first plate in the forefoot region forward of the second plate, with the proximal side of the second plate forward of the medial-side trailing arm and the lateral-side trailing arm, and with the proximal side of the third plate.

Clause 23: The sole structure of any of Clauses 1-19, further comprising: a third plate having a forward edge that defines a notch; wherein the posterior portion of the first plate is configured to fit within the notch with the third plate extending rearward from the first plate.

Clause 24: The sole structure of Clause 23, wherein the third plate defines a through hole in a heel region of the sole structure; and the sole structure further comprising: a rear midsole unit secured to a distal side of the third plate and exposed at a proximal side of the third plate at the through hole of the third plate.

Clause 25: The sole structure of any of Clauses 23-24, wherein the third plate includes an elongated tail curving upward and forward from a rear of the third plate.

Clause 26: The sole structure of any of Clauses 23-25, further comprising: a full-length midsole unit extending from a forefoot region of the sole structure to a heel region of the sole structure; wherein the full-length midsole unit is supported on and interfaces with a proximal side of the first plate in the forefoot region forward of the second plate, with the proximal side of the second plate, and with the proximal side of the third plate.

Clause 27: The sole structure of Clause 26, wherein the full-length midsole unit has a through hole disposed over the second plate and the proximal side of the second plate is exposed at the through hole of the full-length midsole unit.

Clause 28: The sole structure of Clause 27, wherein the fluid-filled bladder is disposed at a distal side of the second plate under the through hole of the full-length midsole unit.

Clause 29: The sole structure of any of Clauses 26-28, wherein the full-length midsole unit has a wall extending from the first plate to the second plate forward of the fluid-filled bladder and curving forward between the first plate and the second plate.

Clause 30: The sole structure of any of Clauses 24-29, wherein: the first plate includes a medial flange at a medial side edge of the first plate and a lateral flange at a lateral side edge of the first plate; and the medial flange and the lateral flange are disposed against a rear face of a downwardly extending portion of the full-length midsole unit in the forefoot region forward of the fluid-filled bladder.

Clause 31: The sole structure of Clause 26, wherein the third plate defines a through hole in a heel region of the sole structure, and the sole structure further comprising: a rear midsole unit secured to a distal side of the third plate and exposed at a proximal side of the third plate at the through hole of the third plate; and wherein the full-length midsole unit extends over the through hole of the third plate and interfaces with the rear midsole unit at the through hole of the third plate.

Clause 32: The sole structure of Clause 1, wherein: the second plate has a central portion supported on the fluid-filled bladder; the second plate defines a through hole rearward of the central portion; and the posterior portion of the first plate ascends rearward through the through hole of the second plate.

Clause 33: The sole structure of Clause 32, wherein the second plate includes a wall extending upward around a rear of the through hole of the second plate.

Clause 34: The sole structure of any of Clauses 1-11, wherein the first plate includes a bifurcated portion forward of the fluid-filled bladder.

Clause 35: The sole structure of Clause 34, wherein the bifurcated portion includes a medial projection and a lateral projection, each of the medial projection and the lateral projection having a longitudinally-extending ridge extending upward on a proximal side of the first plate.

Clause 36: The sole structure of any of Clauses 1-35, wherein the proximal side of the first plate defines a recess, and a distal side of the fluid-filled bladder is seated in the recess.

Clause 37: The sole structure of any of Clauses 1-36, wherein a distal side of the second plate defines a recess, and the proximal side of the fluid-filled bladder is nested in the recess.

Clause 38: The sole structure of any of Clauses 1-37, wherein the fluid-filled bladder includes a plurality of tethers spanning between and operatively connecting an upper interior surface of the fluid-filled bladder to a lower interior surface of the fluid-filled bladder.

Clause 39: The sole structure of any of Clauses 1-38, wherein the fluid-filled bladder is a first fluid-filled bladder, and the sole structure further comprising: a second fluid-filled bladder disposed adjacent to the first fluid-filled bladder between the first plate and the second plate.

Clause 40: The sole structure of Clause 39, wherein the second fluid-filled bladder includes a plurality of tethers spanning between and operatively connecting an upper interior surface of the second fluid-filled bladder to a lower interior surface of the second fluid-filled bladder.

Clause 41: The sole structure of any of Clauses 39-40, wherein: the first plate includes a bifurcated portion; the first fluid-filled bladder is disposed on a medial projection of the bifurcated portion; and the second fluid-filled bladder is disposed on a lateral projection of the bifurcated portion.

Clause 42: The sole structure of any of Clauses 1-41 wherein the first plate is more rigid than the second plate.

Clause 43: The sole structure of any of Clauses 1-42, wherein the first plate comprises one of, or any combination of two or more of, a carbon fiber, a carbon fiber composite, a carbon fiber-filled nylon, a fiberglass-reinforced nylon, a fiber strand-lain composite, a thermoplastic elastomer, wood, or steel.

Clause 44: The sole structure of Clause 43, wherein the first plate comprises a fiberglass-reinforced polyamide 11 having a hardness of approximately 75 on a Shore D durometer scale.

Clause 45: The sole structure of any of Clauses 43-44, wherein the second plate comprises thermoplastic polyurethane.

Clause 46: The sole structure of Clause 45, wherein the second plate comprises an injected thermoplastic polyurethane having a hardness of approximately 95 on a Shore A durometer scale.

Clause 47: The sole structure of any of Clauses 1-11, wherein the first plate is undivided forward of the fluid-filled bladder.

Clause 48: The sole structure of any of Clauses 1-19, wherein the first plate has a transverse ridge on a proximal side of the first plate forward of the fluid-filled bladder, and a transverse groove on a distal side of the first plate aligned with the transverse ridge.

Clause 49: The sole structure of any of Clauses 1-19, further comprising: a forefoot midsole unit disposed forward of the fluid-filled bladder between the first plate and the second plate.

Clause 50: The sole structure of Clause 49, wherein the second plate defines a through hole forward of the fluid-filled bladder, and the forefoot midsole unit is disposed at the through hole of the second plate.

Clause 51: The sole structure of any of Clauses 49-50, wherein a rear extent of the forefoot midsole unit slopes upwardly and away from the fluid-filled bladder from the first plate to the second plate.

Clause 52: The sole structure of any of Clauses 49-51, wherein a rear extent of the forefoot midsole unit slopes upwardly and toward the fluid-filled bladder from the first plate to the second plate.

Clause 53: The sole structure of any of Clauses 49-52, wherein the forefoot midsole unit extends forward of a forwardmost edge of the second plate.

Clause 54: The sole structure of any of Clauses 1-25, further comprising: an outsole component having a first medial sidewall secured to a medial side surface of the fluid-filled bladder.

Clause 55: The sole structure of Clause 54, further comprising: a forefoot midsole unit disposed forward of the fluid-filled bladder between the first plate and the second plate; and wherein the outsole component includes a second medial sidewall that wraps upward and is secured to a medial side surface of the forefoot midsole unit forward of the first medial sidewall, and the outsole component defines a notch between the first medial sidewall and the second medial sidewall.

Clause 56: A method of manufacturing footwear sole structures, the method comprising: assembling sole structures for plural ranges of footwear sizes, each of the sole structures comprising: a first plate; a second plate; a fluid-filled bladder supported on a proximal side of the first plate; wherein the second plate is supported on a proximal side of the fluid-filled bladder; wherein the fluid-filled bladder has a predetermined inflation pressure; and wherein the predetermined inflation pressure is different for at least two of the plural ranges of footwear sizes.

Clause 57: The method of Clause 56, wherein: the plural ranges of footwear sizes include a first range and a second range; the footwear sizes included in the first range are smaller than the footwear sizes included in the second range; and the predetermined inflation pressure for the first range is less than the predetermined inflation pressure for the second range.

Clause 58: The method of Clause 57, wherein: the plural ranges of footwear sizes further include a third range; the footwear sizes included in the third range are larger than the footwear sizes included in the second range; and the predetermined inflation pressure for the third range is greater than the predetermined inflation pressure for the second range.

Clause 59: The method of Clause 58, wherein the predetermined inflation pressure for the third range is about 10 pounds per square inch (psi) greater than the predetermined inflation pressure for the first range.

Clause 60: The method of any of Clauses 58-59, wherein the first range includes men's United States (U.S.) sizes 6 to 9, the second range includes men's U.S. sizes 9.5 to 12, and the third range includes men's U.S. sizes 12.5 to 15.

Clause 61: The method of any of Clauses 58-60, wherein: the predetermined inflation pressure for the second range is from about 2 pounds per square inch (psi) to about 5 psi greater than the predetermined inflation pressure for the first range; and the predetermined inflation pressure for the third range is from about 2 psi to about 5 psi greater than the predetermined inflation pressure for the second range.

Clause 62: The method of any of Clauses 58-61, wherein: the predetermined inflation pressure for the first range is up to about 18 pounds per square inch (psi); the predetermined inflation pressure for the second range is from about 18 psi to about 22 psi; and the predetermined inflation pressure for the third range is from about 22 psi to about 25 psi.

Clause 63: The method of any of Clauses 56-62, further comprising: inflating the fluid-filled bladder to the predetermined inflation pressure; and sealing the fluid-filled bladder.

Clause 64: The method of any of Clauses 56-63, wherein the first plate ascends rearward of the fluid-filled bladder and the second plate descends rearward of the fluid-filled bladder with a posterior portion of the first plate above a posterior portion of the second plate rearward of the fluid-filled bladder.

Clause 65: The method of any Clause 64, wherein: the posterior portion of a first one of the first plate or the second plate includes one or both of a medial-side trailing arm and a lateral-side trailing arm; and the posterior portion of a second one of the first plate or the second plate is disposed adjacent to the one or both of the medial-side trailing arm and the lateral-side trailing arm.

Clause 66: The method of Clause 65, wherein the second plate includes both of the medial-side trailing arm and the lateral-side trailing arm which descend to below the posterior portion of the first plate rearward of the fluid-filled bladder.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A sole structure for an article of footwear, the sole structure comprising:

a first plate;

a fluid-filled bladder supported on the first plate;

a second plate supported on the fluid-filled bladder with the fluid-filled bladder disposed between the first plate and the second plate;

wherein the first plate ascends rearward of the fluid-filled bladder in a direction from a forefoot region of the sole structure toward a heel region of the sole structure and the second plate descends rearward of the fluid-filled bladder in the direction from the forefoot region of the sole structure toward the heel region of the sole structure with a posterior portion of the first plate above a posterior portion of the second plate rearward of the fluid-filled bladder;

wherein the posterior portion of the second plate includes one or both of a medial-side trailing arm and a lateral-side trailing arm; and the posterior portion of the first plate is disposed adjacent to and inward of the one or both of the medial-side trailing arm and the lateral-side trailing arm in a transverse direction of the sole structure.

2. The sole structure of claim 1, wherein the one or both of the medial-side trailing arm and the lateral-side trailing arm and the posterior portion of the second plate are exposed in a midfoot region of the sole structure.

3. The sole structure of claim 1, wherein the second plate includes both the medial-side trailing arm and the lateral-side trailing arm, and the medial side trailing arm and the lateral side trailing arm converge at a rear of the second plate.

4. The sole structure of claim 3, further comprising:

a rear midsole unit including a medial shoulder interfacing with and secured to the medial-side trailing arm and a lateral shoulder interfacing with and secured to the lateral-side trailing arm.

5. A sole structure for an article of footwear, the sole structure comprising:

a first plate;

a fluid-filled bladder supported on the first plate;

a second plate supported on the fluid-filled bladder with the fluid-filled bladder disposed between the first plate and the second plate;

wherein the first plate ascends rearward of the fluid-filled bladder and the second plate descends rearward of the fluid-filled bladder with a posterior portion of the first plate above a posterior portion of the second plate rearward of the fluid-filled bladder;

a midsole unit extending in a heel region of the sole structure;

wherein the midsole unit has a through hole in the heel region; and wherein the posterior portion of the first plate extends through the through hole in the midsole unit and is seated on a foot-facing surface of the midsole unit.

6. The sole structure of claim 5, wherein:

the posterior portion of the first plate includes a stepped rear with a relatively thick leg extending through the through hole and a relatively thin leg extending rearward from the relatively thick leg over the midsole unit; and wherein the relatively thin leg is seated in a recess on the foot-facing surface of the midsole unit.

7. A sole structure for an article of footwear, the sole structure comprising:

a first plate;

a fluid-filled bladder supported on the first plate;

a second plate supported on the fluid-filled bladder with the fluid-filled bladder disposed between the first plate and the second plate;

wherein the first plate ascends rearward of the fluid-filled bladder and the second plate descends rearward of the fluid-filled bladder with a posterior portion of the first plate above a posterior portion of the second plate rearward of the fluid-filled bladder; and a third plate having a forward edge that defines a notch; wherein the posterior portion of the first plate is configured to fit within the notch with the third plate extending rearward from the first plate.

8. The sole structure of claim 7, wherein the third plate defines a through hole in a heel region of the sole structure; and the sole structure further comprising:

a rear midsole unit secured to a distal side of the third plate and exposed at a proximal side of the third plate at the through hole of the third plate.

9. The sole structure of claim 7, further comprising:

a full-length midsole unit extending from a forefoot region of the sole structure to a heel region of the sole structure; wherein the full-length midsole unit is supported on and interfaces with a proximal side of the first plate in the forefoot region forward of the second plate, with the proximal side of the second plate, and with the proximal side of the third plate.

10. The sole structure of claim 9, wherein the full-length midsole unit has a through hole disposed over the second plate and the proximal side of the second plate is exposed at the through hole of the full-length midsole unit.

11. The sole structure of claim 10, wherein the fluid-filled bladder is disposed at a distal side of the second plate under the through hole of the full-length midsole unit.

12. The sole structure of claim 1, wherein the fluid-filled bladder is a first fluid-filled bladder, and the sole structure further comprising:

a second fluid-filled bladder disposed adjacent to the first fluid-filled bladder between the first plate and the second plate.

13. The sole structure of claim 1, further comprising:

an outsole component having a first medial sidewall secured to a medial side surface of the fluid-filled bladder.

14. The sole structure of claim 7, wherein a side surface of the relatively thick leg is bonded to the midsole unit.

15. The sole structure of claim 7, wherein a foot-facing surface of the posterior portion at the stepped rear includes a plurality of recesses.

16. The sole structure of claim 5, wherein:

the posterior portion of the second plate includes one or both of a medial-side trailing arm and a lateral-side trailing arm; and the posterior portion of the first plate is disposed adjacent to and inward of the one or both of the medial-side trailing arm and the lateral-side trailing arm in a transverse direction of the sole structure.

17. The sole structure of claim 16, wherein the one or both of the medial-side trailing arm and the lateral-side trailing arm and the posterior portion of the second plate are exposed in a midfoot region of the sole structure.

18. The sole structure of claim 16, wherein the second plate includes both the medial-side trailing arm and the lateral-side trailing arm, and the medial side trailing arm and the lateral side trailing arm converge at a rear of the second plate.

19. The sole structure of claim 18, wherein the midsole unit includes a medial shoulder interfacing with and secured to the medial-side trailing arm and a lateral shoulder interfacing with and secured to the lateral-side trailing arm.

20. The sole structure of claim 5, wherein the fluid-filled bladder is a first fluid-filled bladder, and the sole structure further comprising:

a second fluid-filled bladder disposed adjacent to the first fluid-filled bladder between the first plate and the second plate.

* * * * *